US007492671B2

(12) United States Patent
Ogasawara

(10) Patent No.: US 7,492,671 B2
(45) Date of Patent: Feb. 17, 2009

(54) ANALOG RADIO-CONTROLLED TIMEPIECE

(75) Inventor: Kenji Ogasawara, Chiba (JP)

(73) Assignee: Seiko Instruments Inc. (JP)

( * ) Notice: Subject to any disclaimer, the term of this patent is extended or adjusted under 35 U.S.C. 154(b) by 0 days.

(21) Appl. No.: 12/011,913

(22) Filed: Jan. 30, 2008

(65) Prior Publication Data

US 2008/0186809 A1 Aug. 7, 2008

(30) Foreign Application Priority Data

| | | |
|---|---|---|
| Jan. 31, 2007 | (JP) | 2007-027017 |
| Feb. 6, 2007 | (JP) | 2007-027013 |
| Feb. 6, 2007 | (JP) | 2007-027014 |
| Feb. 6, 2007 | (JP) | 2007-027015 |
| Feb. 6, 2007 | (JP) | 2007-027018 |
| Dec. 10, 2007 | (JP) | 2007-318553 |

(51) Int. Cl.

| | |
|---|---|
| ***G04C 11/02*** | (2006.01) |
| ***G04B 19/22*** | (2006.01) |
| ***G04B 19/24*** | (2006.01) |
| ***G04B 19/20*** | (2006.01) |

(52) U.S. Cl. ..... 368/47; 368/21; 368/28; 368/37

(58) Field of Classification Search ..... 368/10, 368/21, 28, 35, 37, 46, 47, 52
See application file for complete search history.

(56) References Cited

U.S. PATENT DOCUMENTS

| | | | | |
|---|---|---|---|---|
| 4,196,583 | A * | 4/1980 | Komaki | 368/73 |
| 4,290,129 | A * | 9/1981 | Ushikoshi | 368/66 |
| 4,459,031 | A * | 7/1984 | Perucchi | 368/69 |
| 5,202,858 | A * | 4/1993 | Kanzaki | 368/71 |
| 5,265,070 | A | 11/1993 | Minowa | 368/47 |
| 5,289,437 | A * | 2/1994 | Leuenberger et al. | 368/37 |
| 5,299,177 | A * | 3/1994 | Koch | 368/73 |
| 5,446,702 | A * | 8/1995 | Mossuz et al. | 368/37 |
| 5,668,781 | A * | 9/1997 | Jeannet et al. | 368/28 |
| 7,027,362 | B2 * | 4/2006 | Lizzi et al. | 368/37 |
| 2003/0117902 | A1 | 6/2003 | Suzuki et al. | 368/47 |

FOREIGN PATENT DOCUMENTS

| | | |
|---|---|---|
| JP | 2001311788 | 9/2001 |
| JP | 2003014870 | 1/2003 |
| JP | 2003114288 | 4/2003 |
| JP | 2003121571 | 4/2003 |
| JP | 2003167073 | 6/2003 |

* cited by examiner

*Primary Examiner*—Vit W Miska
(74) *Attorney, Agent, or Firm*—Adams & Wilks

(57) ABSTRACT

It is made possible to display a time instant and a reception sensitivity even during a standard radio signal is received, without adding a special constitution as much as possible. A reception circuit receives and outputs a time code included in the standard radio signal, through an antenna, and a control circuit corrects a time instant being clocked to a time instant corresponding to the time code. In a case where the reception sensitivity of the standard radio signal is displayed, the control circuit judges the reception sensitivity of the standard radio signal on the basis of the time code from the reception circuit, and controls such that, by rotation-controlling a date indicator by referring to a reception sensitivity versus date indicator position correspondence table, the reception sensitivity is displayed by date letters of the date indicator and a time instant display is performed by time instant hands.

31 Claims, 30 Drawing Sheets

| RECEPTION SENSITIVITY | WEAK | MEDIUM | STRONG |
|---|---|---|---|
| DATE INDICATOR POSITION | 1 | 2 | 3 |

| RECEPTION SENSITIVITY | WEAK | MEDIUM | STRONG |
|---|---|---|---|
| DATE INDICATOR POSITION | | | |

| RECEPTION STATION | JAPAN 1 | JAPAN 2 | THE USA | UK | GERMANY |
|---|---|---|---|---|---|
| FREQUENCY | 40kHz | 60kHz | 60kHz | 60kHz | 77.5kHz |
| DATE INDICATOR POSITION | 4 | 6 | 6 | 6 | 7 |

| RECEPTION STATION | JAPAN 1 | JAPAN 2 | THE USA | UK | GERMANY |
|---|---|---|---|---|---|
| FREQUENCY | 40kHz | 60kHz | 60kHz | 60kHz | 77.5kHz |
| DATE INDICATOR POSITION | 40 | 60 | 60 | 60 | 77.5 |

FIG. 26

| THE USA STANDARD TIME | EASTERN STANDARD TIME | CENTRAL STANDARD TIME | MOUNTAIN STANDARD TIME | PACIFIC STANDARD TIME |
|---|---|---|---|---|
| TIME DIFFERENCE FROM GMT | - 5 HOURS | - 6 HOURS | - 7 HOURS | - 8 HOURS |
| DATE INDICATOR POSITION | 5 | 6 | 7 | 8 |

FIG. 31

| THE USA STANDARD TIME | EASTERN STANDARD TIME | CENTRAL STANDARD TIME | MOUNTAIN STANDARD TIME | PACIFIC STANDARD TIME |
|---|---|---|---|---|
| TIME DIFFERENCE FROM GMT | - 5 HOURS | - 6 HOURS | - 7 HOURS | - 8 HOURS |
| DATE INDICATOR POSITION | EST | CST | MST | PST |

FIG. 34

| RECEPTION SITUATION | RECEPTION STATION SELECTION | FIRST TIME DATA OBTAINMENT | SECOND TIME DATA OBTAINMENT | RECEPTION SUCCESS |
|---|---|---|---|---|
| DATE INDICATOR POSITION | 1 | 2 | 3 | 4 |

FIG. 37

| RECEPTION SITUATION | RECEPTION STATION SELECTION | FIRST TIME DATA OBTAINMENT | SECOND TIME DATA OBTAINMENT | RECEPTION SUCCESS |
|---|---|---|---|---|
| DATE INDICATOR POSITION | ■□□□ | ■■□□ | ■■■□ | ■■■■ |

ANALOG RADIO-CONTROLLED TIMEPIECE

BACKGROUND OF THE INVENTION

1. Field of the Invention

The present invention relates to an analog radio-controlled timepiece receiving, by radio, a standard radio signal including a time code denoting a present time instant, thereby performing a time instant correction on the basis of the time code.

2. Description of the Related Art

From olden times, there is utilized the radio-controlled timepiece receiving, by radio, the standard radio signal including the time code denoting the present time instant, thereby correcting a time instant in an inside of the radio-controlled timepiece to a time instant corresponding to the time code. Even in a case where a clock error occurs in the radio-controlled timepiece, by correcting the time instant on the basis of the received time code, the time instant can be displayed by being corrected to an accurate time instant.

In a case where the time instant correction is performed by being coincided with the standard radio signal, there is a case where a user wishes to know a reception information on whether or not the standard radio signal can be received, which station's standard radio is being received, or the like. In a conventional analog radio-controlled timepiece, in a case where the reception information is notified to the user, there are issues like the below.

For example, firstly, in order to perform the time instant correction by being coincided with the standard radio signal, since whether or not the standard radio signal can be received is an issue, there is developed an analog radio-controlled timepiece made so as to display a degree (reception sensitivity) of whether or not the standard radio signal can be accurately received (for example, refer to JP-A-2003-114288 Gazette (Paragraphs [0009]-[0017], FIG. 1-FIG. 5), and JP-A-2003-121571 Gazette (Paragraphs [0014]-[0018], FIG. 1 -FIG. 7, FIG. 9)).

In the above conventional analog radio-controlled timepiece, there is made such that the reception sensitivity of the standard radio signal is displayed by a position of a second hand. By this, it becomes possible that the user know the reception sensitivity of the standard radio signal.

However, in the above conventional analog radio-controlled timepiece, since there is made such that the reception sensitivity is displayed by the second hand during a reception of the standard radio signal, there is an issue that the present time instant is not understandable. Further, there is an issue that a reception sensitivity expression is not very understandable. Additionally, there occurs such a restriction that symbols H, M, L and the like for displaying a high sensitivity, a medium sensitivity, a low sensitivity and the like must be marked in positions, in which the second hand points out the reception sensitivity, in a case of the analog radio-controlled timepiece.

Secondly, in the radio-controlled timepiece, there is developed one made so as to be capable of receiving plural kinds of standard radios (e.g., standard radios of plural countries).

For example, in the JP-A-2003-121571 Gazette, there is disclosed an analog radio-controlled timepiece made so as to display the standard radio from which station (reception station) is being received.

In the analog radio-controlled timepiece of the JP-A-2003-121571 Gazette, there is made such that the reception station is displayed by the position of the second hand. By this, it becomes possible that the user can know from which reception station the standard radio signal is being received.

However, in the above conventional analog radio-controlled timepiece, since there is constituted such that the reception station is displayed by the second hand, the second hand cannot display the present time instant, so that there is an issue that an accurate present time instant is not understandable.

Further, there is an issue for the user that it is difficult to discriminate which reception station the signal was received from. In order to facilitate the discrimination of the reception station, there occurs such an issue that a special constitution, such as marking a station name or the like, must be added to a position in which the second hand points out the reception station.

Thirdly, depending on a use environment or the like of the radio-controlled timepiece, there is the fact that the standard radio signal cannot be normally received and, in this case, the radio-controlled timepiece cannot be corrected to an accurate time instant. Accordingly, since there is a fear that the time instant display becomes not accurate, in a case where there is used without knowing the fact that the standard radio signal could not be made normal, there is an issue that the user misapprehends the time instant.

In order to solve the issues like these, there is developed an analog radio-controlled timepiece made so as to display a reception result of the standard radio signal (for example, refer to JP-A-200.3-14870 Gazette (Paragraphs [0009] [0033], FIG. 1-FIG. 5). By this, the user can know whether or not the standard radio signal could be normally received, and an judgment on whether or not the time instant being displayed is accurate becomes possible.

However, in the above analog radio-controlled timepiece of the JP-A-2003-14870 Gazette, since there is constituted such that whether or not the signal was normally received is displayed by an indication hand for displaying the time instant, the present time instant cannot be displayed during a reception success or failure is displayed, so that there is an issue that the accurate present time instant is not understandable.

Further, there is an issue for the user that it is difficult to discriminate whether or not the signal was normally received.

In order to facilitate the discrimination of whether or not the signal was normally received, it can be considered to constitute such as the fact that plural symbols denoting the reception success or failure be previously provided in the case of the analog radio-controlled timepiece, thereby pointing out the above symbol by the above indication hand in compliance with the reception success or failure. However, there occurs such an issue that a special constitution, such as marking the symbol denoting the reception success or failure to the case, must be added.

Fourthly, depending on a region where the radio-controlled timepiece is used, since there is a case where the standard radio signal to be received and a local time instant differ, there is made so as to display the local time instant by calculating the local time instant by considering a time difference between the region where it is used and the standard radio signal to be received (refer to JP-A-2001-311788 Gazette (Paragraphs [0014]-[0030], FIG. 1-FIG. 4).

For example, in the USA, the GMT (Greenwich Mean Time) is transmitted as the standard radio signal and, further, the whole land of the USA is divided into four time zones. The local time instants in the four regions are EST (Eastern Standard Time=GMT−5 hours), CST (Central Standard Time=GMT−6 hours), MST (Mountain Standard Time=GMT−7 hours) and PST (Pacific Standard Time=GMT−8 hours, and it is necessary to set a time difference information denoting the time difference from the GMT to the radio-controlled timepiece used in each time zone.

By the way, in a case of the analog radio-controlled timepiece, when performing a setting of the time instant information by using time instant hands for displaying the time instant, there is an issue that there becomes necessary a special constitution such as marking a time zone information (time difference from a predetermined time instant, or region name) to the case of the radio-controlled timepiece.

Further, also in a case where a display of the set time zone information is performed by the time instant hands, there becomes necessary such a method as to previously mark the plural time zone information to the case, thereby pointing out a mark corresponding to the set time difference by the time instant hands, so that there is an issue that there becomes necessary a special constitution such as marking the plural time zone information to the case.

Further, there is an issue that the accurate time instant cannot be displayed during the time zone information is being displayed by the time instant hands.

Fifthly, for a convenience of the user, there is developed an analog radio-controlled timepiece made so as to notify a reception progress situation of the standard radio signal (refer to JP-A-2003-167073 Gazette (Paragraphs [0016]-[0051], FIG. 1-FIG. 4).

However, in order to display the reception progress situation, there is constituted so as to display the reception progress situation by providing plural symbols for displaying the reception progress situation in the case of the radio-controlled timepiece and pointing out the symbol complying with the reception progress situation by the indication hands for denoting the time instant.

Accordingly, there is an issue that there becomes necessary a special constitution such that it is necessary to provide the symbol denoting the progress situation in the case.

Further, since there is made so as to display the reception progress situation by the indication hand (e.g., the second hand) displaying the time instant, there is an issue that the present time instant is not understandable during the reception progress situation is being displayed.

Additionally, since the progress situation is displayed by the time instant hands, there is an issue that a progress situation expression is difficult to understand.

SUMMARY OF THE INVENTION

In the present invention, firstly, it is a subject to display the reception information without adding the special constitution.

Secondly, it is a subject to display the reception sensitivity without adding the special constitution. Further, it is a subject to make it possible to display the time instant and the reception sensitivity even during the standard radio signal is being received, without adding the special constitution as much as possible.

Thirdly, it is a subject to make so as to be capable of displaying the reception station without adding the special constitution as much as possible. Further, it is a subject to make it possible to simultaneously display the time instant and the reception station of the standard radio signal even during the standard radio signal is being received, without adding the special constitution as much as possible.

Fourthly, it is a subject to make it possible to display the reception success or failure of the standard radio signal, without adding the special constitution as much as possible. Further, it is a subject to make it possible to simultaneously display the time instant and the reception success or failure of the standard radio signal, without adding the special constitution as much as possible.

Fifthly, it is a subject to make so as to be capable of displaying the time zone information without adding the special constitution as much as possible in the analog radio-controlled timepiece. Further, it is a subject to make it possible to simultaneously display the time instant and the time zone information without adding the special constitution as much as possible.

Sixthly, it is a subject to display the reception progress situation without adding the special constitution. Further, it is a subject to make it possible to display the time instant and the reception progress situation even during the standard radio signal is being received, without adding the special constitution as much as possible.

According to the present invention, there is provided an analog radio-controlled timepiece comprising a reception means receiving, by radio, a standard radio signal including a time code denoting a present time instant; a clock means clocking a time instant; time instant hands analog-displaying a time instant; a 1st motor rotation-driving the time instant hands; a date indicator having a symbol including at least date letters and performing a date display by the date letters; a 2nd motor rotation-driving the date indicator; a time instant correction means correcting the time instant that the clock means is clocking to a time instant corresponding to the time code received by the reception means; and a control means which, by controlling the 1st motor and the 2nd motor in compliance with a clocked time instant of the clock means in an ordinary mode for performing a date and time display, displays a time instant by the time instant hands and displays a date by the date indicator; wherein the control means controls, in a reception information confirmation mode for displaying a reception information of the standard radio signal, the 2nd motor so as to display the reception information by using the date indicator.

The control means controls, in the reception information confirmation mode for displaying the reception information of the standard radio signal, the 2nd motor so as to display the reception information by using the date indicator.

Here, there may be constituted such that the control means controls, in a reception situation confirmation mode for displaying a reception situation of the standard radio signal, the 2nd motor so as to digitally display the reception situation by using the symbol of the date indicator.

Further, according to the present invention, there is provided an analog radio-controlled timepiece comprising a reception means receiving, by radio, a standard radio signal including a time code denoting a present time instant; a clock means clocking a time instant; time instant hands analog-displaying a time-instant; a 1st motor rotation-driving the time instant hands; a date indicator having date letters and performing a date display by the date letters; a 2nd motor rotation-driving the date indicator; a time instant correction means correcting the time instant that the clock means is clocking to a time instant corresponding to the time code received by the reception means; a control means which, by controlling the 1st motor and the 2nd motor in compliance with a clocked time instant of the clock means in an ordinary mode for performing a date and time display, displays a time instant by the time instant hands and displays a date by the date indicator; and a reception sensitivity judgment means judging a reception sensitivity of the standard radio signal received by the reception means; wherein the control means controls, in a reception sensitivity confirmation mode for displaying a reception sensitivity of the standard radio signal, the 2nd motor so as to perform a display complying with a judgment result of the reception sensitivity judgment means by a display of the date indicator.

The control means controls, in the reception sensitivity confirmation mode for displaying the reception sensitivity of the standard radio signal, the 2nd motor so as to perform a display complying with the judgement result of the reception sensitivity judgment means by a display of the date indicator.

Here, there may be constituted such that the control means controls, in the reception sensitivity confirmation mode, the 2nd motor so as to display the judgement result of the reception sensitivity judgment means by the date letters of the date indicator.

Further, there may be constituted such that, in the date indicator there is additionally provided a reception sensitivity display symbol denoting the reception sensitivity, which differs from the date letters, and the control means controls, in the reception sensitivity confirmation mode, the 2nd motor so as to display the judgement result of the reception sensitivity judgment means by the reception sensitivity display symbol of the date indicator.

Further, there may be constituted such that the control means stores a reception sensitivity versus date indicator position correspondence table in which the reception sensitivity of the standard radio signal and a position of the date indicator are corresponded, and controls, in the reception sensitivity confirmation mode, the 2nd motor so as to rotation-drive the date indicator to a position complying with the judgment result of the reception sensitivity judgment means by referring to the reception sensitivity versus date indicator position correspondence table, thereby displaying the judgment result of the reception sensitivity judgment means.

Further, there may be constituted such that it has an operation means, and the control means responds to an operation of the operation means, thereby switching the ordinary mode and the reception sensitivity confirmation mode.

Further, there may be constituted such that the control means shifts a processing to the ordinary mode in a case where a predetermined time elapsed in the reception sensitivity confirmation mode.

Further, there may be constituted such that, in a case where the time instant hands are rotation-driven during the reception of the standard radio signal, the control means controls the 1st motor so as to rotation-drive the time instant hands in an interstice between a pulse signal and a pulse signal, which constitute the time code included in the standard radio signal.

Further, according to the present invention, there is provided an analog radio-controlled timepiece comprising a reception means receiving, by radio, a standard radio signal including a time code denoting a present time instant; a clock means clocking a time instant; time instant hands analog-displaying a time instant; a 1st motor rotation-driving the time instant hands; a date indicator having at least date letters and performing a date display by the date letters; a 2nd motor rotation-driving the date indicator; a time instant correction means correcting the time instant that the clock means is clocking to a time instant corresponding to the time code received by the reception means; a control means which, by controlling the 1st motor and the 2nd motor in compliance with a clocked time instant of the clock means in an ordinary mode for performing a date and time display, displays a time instant by the time instant hands and displays a date by the date indicator; and a judgment means judging a reception station of the standard radio signal received by the reception means; wherein the control means controls, in a reception station confirmation mode for displaying the reception station of the standard radio signal, the 2nd motor so as to perform a display of the reception station, that the judgment means judges, by a display of the date indicator.

The control means controls, in the reception station confirmation mode for displaying the reception station of the standard radio signal, the 2nd motor so as to perform a display of the reception station that the judgment means judged, by a display of the date indicator.

Here, there may be constituted such that the control means controls, in the reception station confirmation mode, the 2nd motor so as to display a numeral of a highest digit of a frequency of the standard radio signal transmitted from the reception station by the date letters of the date indicator.

Further, there may be constituted such that in the date indicator there are additionally provided plural frequency display symbols denoting a frequency of the standard radio signal, which differ from the date letters, and the control means controls, in the reception station confirmation mode, the 2nd motor so as to display the frequency display symbol corresponding to the frequency of the standard radio signal transmitted from the reception station.

Further, there may be constituted such that the control means stores a reception station versus date indicator position correspondence table in which the reception station and a position of the date indicator are corresponded, and controls, in the reception station confirmation mode, the 2nd motor so as to rotation-drive the date indicator to a position complying with the judgment result of the judgment means by referring to the reception station versus date indicator position correspondence table.

Further, there may be constituted such that it has an operation means, and the control means responds to an operation of the operation means, thereby switching the ordinary mode and the reception station confirmation mode.

Further, there may be constituted such that the control means shifts a processing to the ordinary mode in a case where a predetermined time elapsed in the reception station confirmation mode.

Further, there may be constituted such that, in the case where the time instant hands are rotation-driven during the reception of the standard radio signal, the control means controls the 1st motor so as to rotation-drive the time instant hands in the interstice between the pulse signal and the pulse signal, which constitute the time code included in the standard radio signal.

Further, according to the present invention, there is provided an analog radio-controlled timepiece comprising a reception means receiving, by radio, a standard radio signal including a time code denoting a present time instant; a clock means clocking a time instant; time instant hands analog-displaying a time instant; a 1st motor rotation-driving the time instant hands; a date indicator having at least date letters and performing a date display by the date letters; a 2nd motor rotation-driving the date indicator; a time instant correction means correcting the time instant that the clock means is clocking to a time instant corresponding to the time code received by the reception means; a control means which, by controlling the 1st motor and the 2nd motor in compliance with a clocked time instant of the clock means in an ordinary mode for performing a date and time display, displays a time instant by the time instant hands and displays a date by the date indicator; and a judgment means judging a reception success or failure of the standard radio signal by the reception means; wherein the control means controls, in a reception success or failure display mode for displaying the reception success or failure that the judgment means judges, the 2nd motor so as to display the reception success or failure by the date indicator.

The control means controls, in the reception success or failure display mode for displaying the reception success or failure that the judgment means judges, the 2nd motor so as to display the reception success or failure by the date indicator.

Here, there may be constituted such that the control means controls, in the reception success or failure display mode, the 2nd motor so as to display the reception success or failure by the date letters of the date indicator.

Further, there may be constituted such that in the date indicator there is additionally provided a reception success or failure display symbol denoting the reception success or failure, which differs from the date letters, and the control means controls, in the reception success or failure display mode, the 2nd motor so as to display the reception success or failure by the reception success or failure display symbol.

Further, there may be constituted such that the control means controls, in the reception success or failure display mode, the 2nd motor so as to display a reception result in the last time by the reception means, by the date indicator.

Further, there may be constituted such that the control means controls, in the reception success or failure display mode, the 2nd motor such that the date indicator performs a predetermined motion, thereby displaying the fact that a reception in the last time by the reception means was normally performed.

Further, there may be constituted such that the control means has a storage means storing the number of times in which the reception means could not continuously, normally receive the standard-radio signal, and controls, in the reception success or failure display mode, the 2nd motor such that the date indicator displays the date letters corresponding to the number of times stored in the storage means.

Further, there may be constituted such that, in a case where the reception means cannot normally receive the standard radio signal even one time till now, the control means controls, in the reception success or failure display mode, the 2nd motor so as to display an interstice between the date letters and the date letters of the date indicator.

Further, there may be constituted such that it has an operation means, and the control means responds to an operation of the operation means, thereby shifting a processing to the reception success or failure display mode.

Further, there may be constituted such that, in the case where the time instant hands are rotation-driven during the reception of the standard radio signal, the control means controls the 1st motor so as to rotation-drive the time instant hands in the interstice between the pulse signal and the pulse signal, which constitute the time code included in the standard radio signal.

Further, according to the present invention, there is provided an analog radio-controlled timepiece comprising a reception means receiving, by radio, a standard radio signal including a time code denoting a present time instant; a clock means clocking a time instant; time instant hands analog-displaying a time instant; a 1st motor rotation-driving the time instant hands; a date indicator having at least date letters and performing a date display by the date letters; a 2nd motor rotation-driving the date indicator; a time zone information storage means storing a time zone information in a region where a time instant display is performed; a time instant correction means correcting the time instant that the clock means is clocking, on the basis of a time instant that the time code received by the reception means denotes, by considering the time zone information stored in the time zone information storage means; and a control means which, by controlling the 1st motor and the 2nd motor in compliance with a clocked time instant of the clock means in an ordinary mode for performing a date and time display, displays a time instant by the time instant hands and displays a date by the date indicator;

wherein the control means controls, in a time zone information confirmation mode for displaying the time zone information stored in the time zone information storage means, the 2nd motor so as to perform a display of the time zone information by a display of the date indicator.

The control means controls, in the time zone information confirmation mode for displaying the time zone information stored in the time zone information storage means, the 2nd motor so as to perform the display of the time zone information by the display of the date indicator.

Here, there may be constituted such that the control means controls, in the time zone information confirmation mode, the 2nd motor so as to display the time zone information by the date letters of the date indicator.

Further, there may be constituted such that the control means controls, in the time zone information confirmation mode, the 2nd motor so as to display the date letters of the date indicator, which corresponds to a time difference included in the time zone information.

Further, there may be constituted such that in the date indicator there are additionally provided plural time zone information display symbols denoting the time zone information, which differ from the date letters, and the control means controls, in the time zone information confirmation mode, the 2nd motor so as to display the time zone information display symbol corresponding to the time zone information stored in the time zone information storage means.

Further, there may be constituted such that it has a time zone information versus date indicator position correspondence table in which the time zone information and a position of the date indicator are corresponded, and the control means controls, in the time zone information confirmation mode, the second motor so as to rotation-drive the date indicator to a position corresponding to the time zone information stored in the time zone information storage means, by referring to the time zone information versus date indicator position correspondence table.

Further, there may be constituted such that it has an operation means, the time zone information storage means is constituted by a time difference counter, and the time difference counter stores as the time zone information, a time difference set in compliance with an operation frequency of the operation means.

Further, there may be constituted such that the control means responds to an operation of the operation means, thereby switching the ordinary mode and the time zone information confirmation mode.

Further, there may be constituted such that the control means shifts a processing to the ordinary mode in a case where a predetermined time elapsed in the time zone information confirmation mode.

Further, there may be constituted such that in the time zone information storage means there is stored, as the time zone information, a time difference from Greenwich Mean Time in Eastern region, Central region, Mountain region or Pacific region in the USA, and the reception means receives the standard radio signal including the time code denoting the Greenwich Mean Time, and the time instant correction means calculates a time instant on the basis of the Greenwich Mean Time and the time difference stored in the time zone information storage means, thereby correcting the time instant that the clock means is clocking to the calculated time instant.

Further, there may be constituted such that the control means controls, in the time zone information confirmation mode, the 2nd motor such that, in a case where the region concerned with the time zone information displayed by the date letters is the Eastern region, the Central region, the Mountain region or the Pacific region, the date letters "5", "6", "7" or "8"is respectively displayed.

Further, there may be constituted such that, in the case where the time instant hands are rotation-driven during the reception of the standard radio signal, the control means controls the 1st motor so as to rotation-drive the time instant hands in the interstice between the pulse signal and the pulse signal, which constitute the time code included in the standard radio signal.

Further, according to the present invention, there is provided an analog radio-controlled timepiece comprising a reception means receiving, by radio, a standard radio signal including a time code denoting a present time instant; a clock means clocking a time instant; time instant hands analog-displaying a time instant; a 1st motor rotation-driving the time instant hands; a date indicator having date letters and performing a date display by the date letters; a 2nd motor rotation-driving the date indicator; a time instant correction means correcting the time instant that the clock means is clocking to a time instant corresponding to the time code received by the reception means; a control means which, by controlling the 1st motor and the 2nd motor in compliance with a clocked time instant of the clock means in an ordinary mode for performing a date and time display, displays a time instant by the time instant hands and displays a date by the date indicator; and a reception progress situation judgment means judging a reception progress situation of the standard radio signal by the reception means; wherein the control means controls, in a reception mode receiving the standard radio signal the 2nd motor so as to perform a display complying with a judgment result of the reception progress situation judgment means by a display of the date indicator.

The control means controls, in the reception mode receiving the standard radio signal, the 2nd motor so as to perform a display complying with the judgment result of the reception progress situation judgment means by a display of the date indicator.

Here, there may be constituted such that the control means controls, in the reception mode, the 2nd motor so as to display the judgment result of the reception progress situation judgment means by the date letters of the date indicator.

Further, there may be constituted such that in the date indicator there is additionally provided a reception progress situation display symbol denoting the reception progress situation, which differs from the date letters, and the control means controls, in the reception mode, the 2nd motor so as to display the judgment result of the reception progress situation judgment means by the reception progress situation display symbol of the date indicator.

Further, there may be constituted such that the control means stores a reception progress situation versus date indicator position correspondence table in which the reception progress situation of the standard radio signal and a position of the date indicator are corresponded, and controls, in the reception mode, the 2nd motor so as to rotation-drive the date indicator to a position complying with the judgment result of the reception progress situation judgment means by referring to the reception progress situation versus date indicator position correspondence table.

Further, there may be constituted such that, in a case where a time instant display is performed by driving the time instant hands during the reception of the standard radio signal in the reception mode, the control means controls the 1st motor so as to rotation-drive the time instant hands in the interstice between the pulse signal and the pulse signal, which constitute the time code included in the standard radio signal.

According to the present invention, firstly, it becomes possible to display the reception information of the standard radio signal without adding the special constitution.

Secondly, it becomes possible to display the reception sensitivity of the standard radio signal without adding the special constitution. Further, it becomes possible to simultaneously display the time instant and the reception sensitivity of the standard radio signal without adding the special constitution. Further, there becomes possible the reception sensitivity display of the standard radio signal, or the simultaneous display of the time instant and the standard radio signal reception sensitivity without adding the special constitution as much as possible.

Thirdly, it becomes possible to display the reception station of the standard radio signal without adding the special constitution as much as possible. Further, it becomes possible to simultaneously display, even during the reception of the standard radio signal, the time instant and the reception station of the standard radio signal without adding the special constitution as much as possible.

Fourthly, it becomes possible to make such that the reception success or failure of the standard radio signal can be displayed without adding the special constitution as much as possible. Further, it becomes possible that the reception success or failure of the standard radio signal and the time instant can be simultaneously displayed without adding the special constitution as much as possible.

Fifthly, it becomes possible to display the time zone information without adding the special constitution as much as possible. Further, it becomes possible to simultaneously display the time instant and the time zone information without adding the special constitution as much as possible.

Sixthly, it becomes possible to display the reception progress situation without adding the special constitution as much as possible. Further, it becomes possible to display, even during the reception of the standard radio signal, the time instant and the reception progress situation without adding the special constitution as much as possible.

BRIEF DESCRIPTION OF THE DRAWINGS

FIG. 26 is a view showing a time zone information versus date indicator position correspondence table used in the analog radio-controlled timepiece concerned with the seventh embodiment of the present invention;

FIG. 31 is a view showing a time zone information versus date indicator position correspondence table used in the analog radio-controlled timepiece concerned with the eighth embodiment of the present invention;

FIG. 34 is a view showing a reception progress situation versus date indicator position correspondence table used in the analog radio-controlled timepiece concerned with the ninth embodiment of the present invention;

FIG. 37 is a view showing a reception progress situation versus date indicator position correspondence table used in the analog radio-controlled timepiece concerned with the tenth embodiment of the present invention.

DETAILED DESCRIPTION OF THE INVENTION

In explaining a summary of an analog radio-controlled timepiece concerned with an embodiment of the present invention, the analog radio-controlled timepiece concerned with the embodiment of the present invention possesses time instant hands analog-displaying a time instant, a 1st motor rotation-driving the time instant hands, a date indicator having a symbol including at least date letters and performing a date display by the date letters, a 2nd motor rotation-driving the date indicator, a time instant correction means correcting to a time instant corresponding to a received time code, and a control means displaying a time instant by the time instant hands and displaying a date by the date indicator by controlling the 1st motor and the 2nd motor in compliance with a clocked time instant of a clock means in an ordinary mode for performing a date and time display, and the control means is made so as to control, in a reception information confirmation mode for displaying a reception information of the standard radio signal, the 2nd motor so as to display the reception information by using the date indicator.

The above control means can be also made so as to control the 2nd motor such that, in a reception information confirmation mode for displaying a reception situation of the standard radio signal, the reception information is digitally displayed by using a symbol of the date indicator.

Incidentally, as displays of the reception information, there are a display of a reception sensitivity of the standard radio signal, a display of a reception station of the standard radio signal, a display of a reception success or failure, a display of a time zone information, and a display of a reception progress situation as shown as embodiments mentioned later for instance. Further, digitally displaying does mean the fact that the reception information is displayed by a discrete value, not displayed as a value which changes continuously (in an analog). By such display, it becomes possible to display the reception information by using an existing date indicator or by a simple constitution of such a degree as to apply a symbol to the date indicator.

Figure 1:
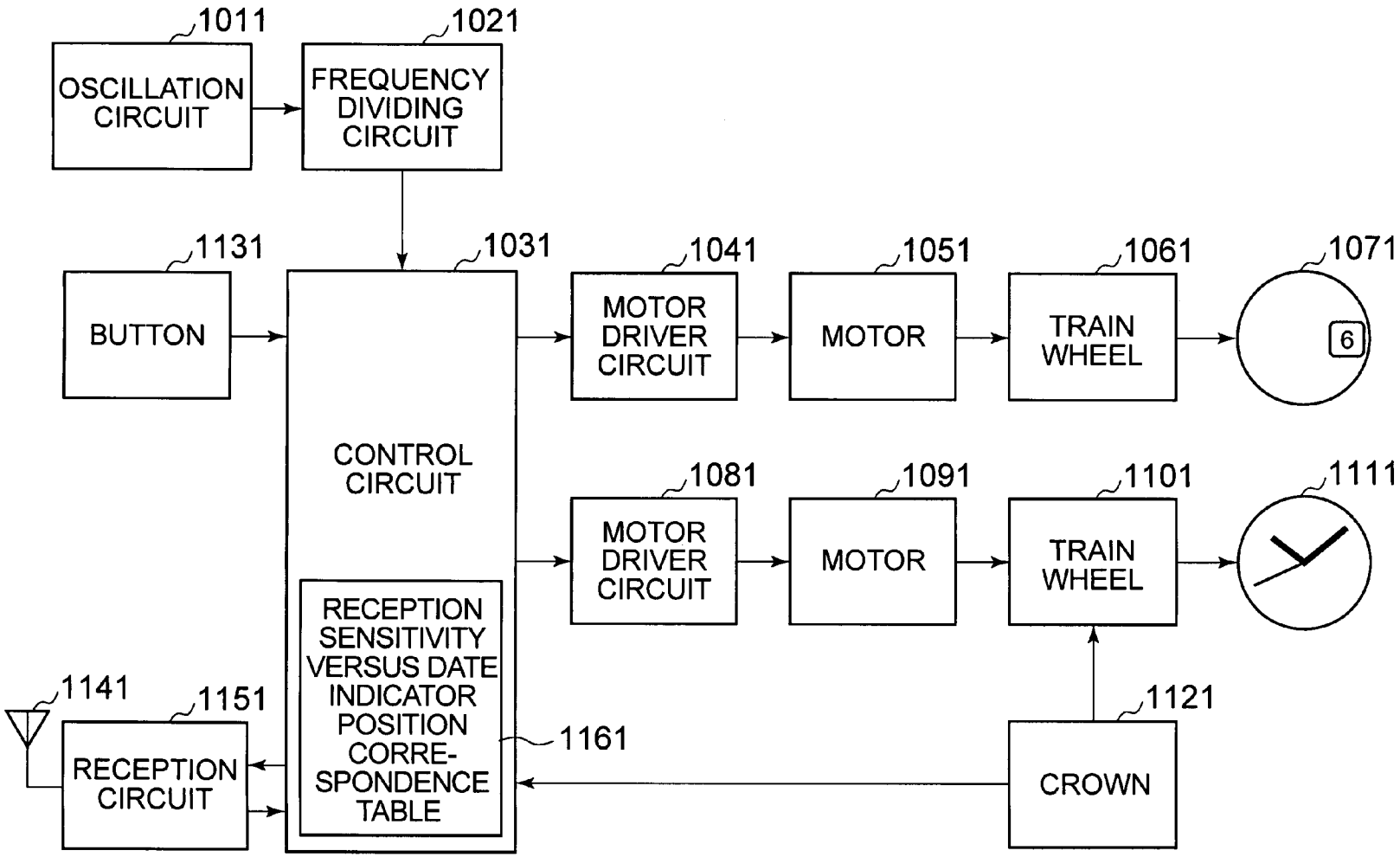
FIG. 1 is a block diagram of an analog radio-controlled timepiece concerned with a first embodiment of the present invention.

FIG. 1 is a block diagram of an analog radio-controlled timepiece concerned with a first embodiment of the present invention, and shows an example of a wristwatch type analog radio-controlled timepiece.

In FIG. 1, the analog radio-controlled timepiece possesses an oscillation circuit 1011 outputting a signal of a predetermined frequency, a frequency dividing circuit 1021 frequency-dividing the signal from the oscillation circuit 1011 to thereby output a time signal becoming a reference of a clock operation, a control circuit 1031 performing the clock operation based on the time signal to thereby perform an output processing of a control signal for a time instant display and a control processing of each constituent element of the analog radio-controlled timepiece or a later-mentioned processing and the like, a motor driver circuit 1081 responding to the control signal from the control circuit 1031 to thereby output a motor drive signal for time instant hands, a motor 1091 rotation-driven by the motor drive signal for time instant hands, a train wheel 1101 transmitting a rotation of the motor 1091, and time instant hands (an hour hand, a minute hand, and a second hand) 1111 rotation-driven by the train wheel 1101.

Further, the analog radio-controlled timepiece possesses a motor driver circuit 1041 responding to a control signal from the control circuit 1031 to thereby output a motor drive signal for the date indicator, a motor 1051 rotation-driven by the motor drive signal for the date indicator, a train wheel 1061 transmitting the rotation of the motor 1051, and a date indicator 1071 rotation-driven by the train wheel 1061. Incidentally, in FIG. 1, there is shown a state in which the date indicator 1071 displays the 6th day.

Further, the analog radio-controlled timepiece possesses an antenna 1141 receiving, by radio, the standard radio signal including the time code, a reception circuit 1151 outputting the time code included in the standard radio signal received by the antenna 1141, a crown 1121 driving the train wheel 1101 by a predetermined manual operation to thereby perform a time instant setting of the time instant hands 1111 and inputting an operation signal complying with the manual operation to the control circuit 1031, and an operation button 1131 capable of being manually operated.

The control circuit 1031 has a storage means in its inside and, in the storage means, there is stored a reception sensitivity versus date indicator position correspondence table 1161 in which a reception level (reception sensitivity) of the standard radio signal received by the antenna 1141 and a rotation position of the date indicator 1071 are corresponded. In the date indicator 1071, date letters denoting dates from 1st day to 31st day are provided by an imprinting or the like.

Here, the antenna 1141 and the reception circuit 1151 constitute a reception means receiving, by radio, the standard radio signal including the time code, the motor 1091 constitutes a 1st motor, and the motor 1051 constitutes a 2nd motor. The crown 1121 and the operation button 1131 constitute an operation means. Further, the control circuit 1031 constitutes a clock means clocking a present time instant by counting a time signal, a time instant correction means correcting the present time instant being clocked to a time instant corresponding to the received time code, a reception sensitivity judgment means judging a reception sensitivity of the standard radio signal received by the antenna 1141, and a control means.

Figures 2, 3:
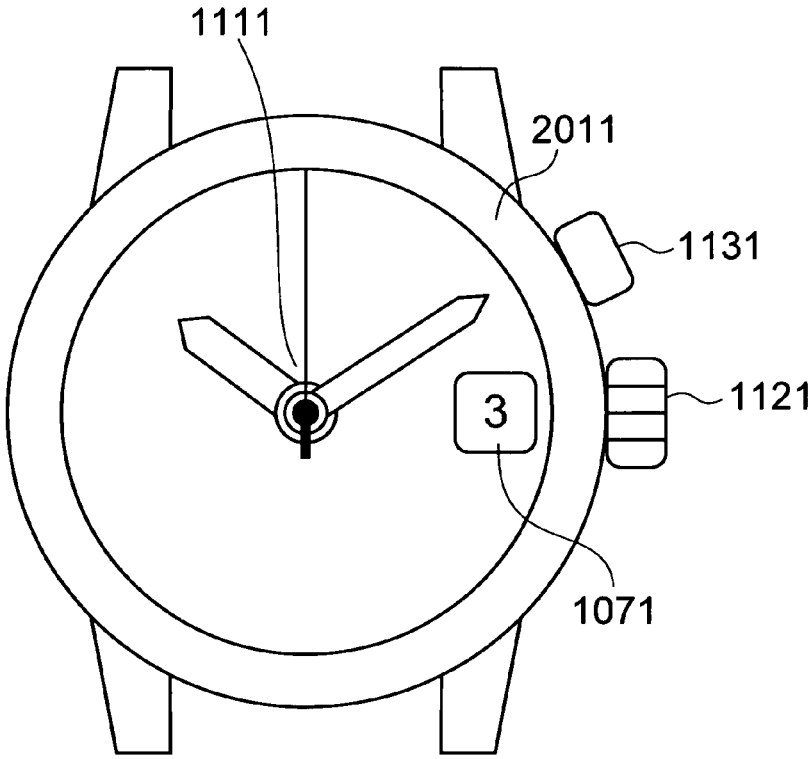
FIG. 2 is an external appearance view of the analog radio-controlled timepiece concerned with the first embodiment of the present invention.
FIG. 3 is a view showing a reception sensitivity versus date indicator position correspondence table used in the analog radio-controlled timepiece concerned with the first embodiment of the present invention.

FIG. 2 is a view showing an external appearance of the analog radio-controlled timepiece concerned with the embodiment of the present invention, and the same reference numeral is applied to the same portion as FIG. 1. Incidentally, 2011 is a case of the analog radio-controlled timepiece.

FIG. 3 is a view showing a content of the reception sensitivity versus date indicator position correspondence table 1161 stored in the control circuit 1031. In the present embodiment, there is constituted such that the reception sensitivity is judged by being divided into three stages of weak, medium and strong. Each of date letters "1", "2 " and "3" of the date indicator 1071 is corresponded to each of the weak, medium and strong reception sensitivities. In FIG. 2, there is shown a case where the reception sensitivity is strong (the date letters of the date indicator 1071 is "3").

Although details of a reception sensitivity display operation are mentioned later, the standard radio signal is received by the antenna 1141, the reception circuit 1051 outputs the time code in the standard radio signal, and the control circuit 1031 judges the reception sensitivity on the basis of the time code (At this time, the control circuit 1031 functions as the reception sensitivity judgment means.), and rotation-controls the date indicator 1071 such that the date letters corresponding to the judged reception sensitivity is displayed by referring to the reception sensitivity versus date indicator position correspondence table 1161 (At this time, the control circuit 1031 functions as the control means.).

As a method in which the control circuit 1031 judges the reception sensitivity, there is, e.g., a method of judging on the basis of a signal level of the time code outputted from the reception circuit 1151, a method of judging the reception sensitivity on the basis of an accurately judged pulse signal number among plural pulse signals, constituting the time code (i.e., it is deemed that the more the pulse signals which could be detected in a predetermined time are, the stronger is the reception sensitivity), or the like.

Figure 4:
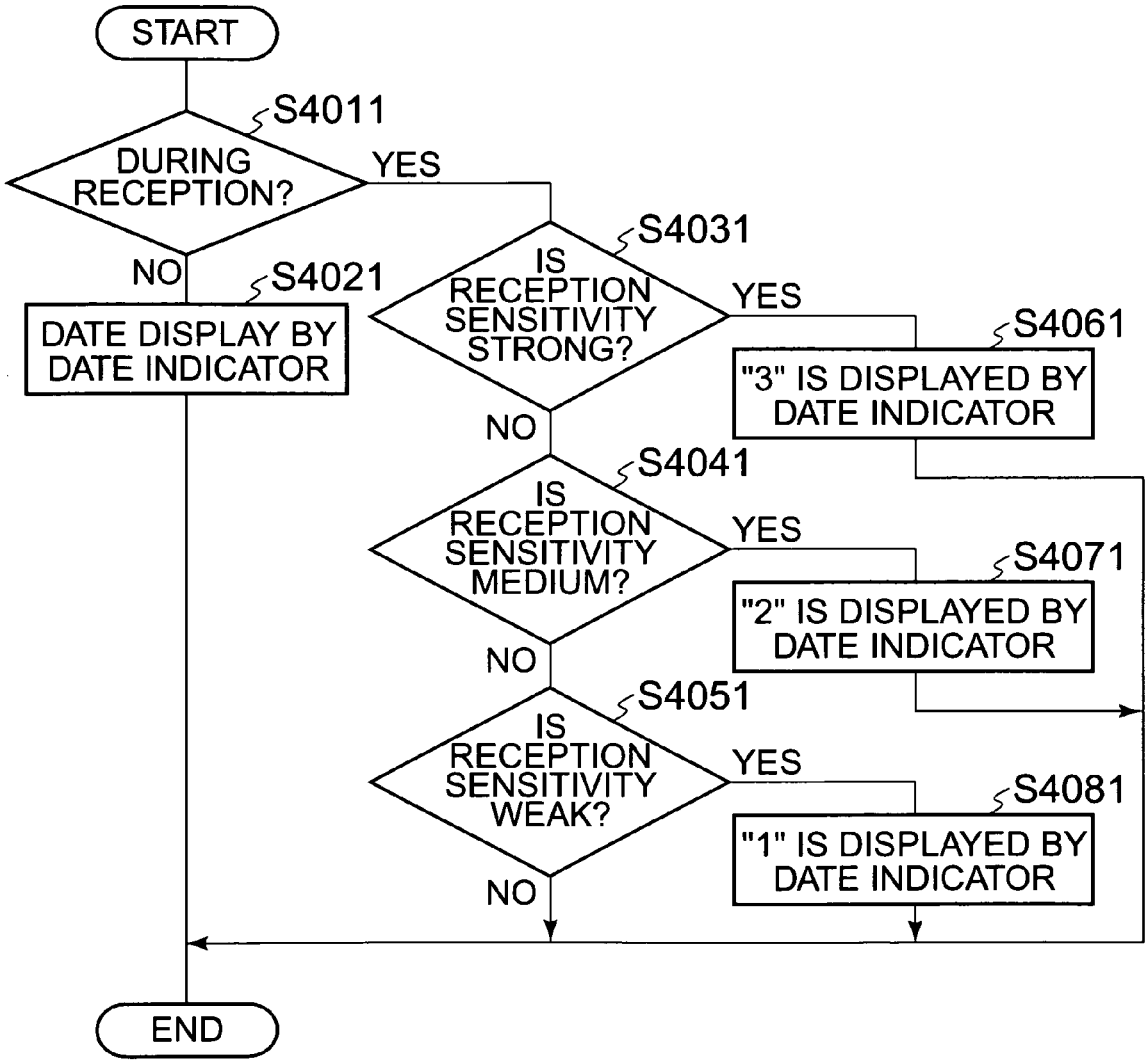
FIG. 4 is a flowchart showing processing in the analog radio-controlled timepiece concerned with the first embodiment of the present invention.
Figure 5:
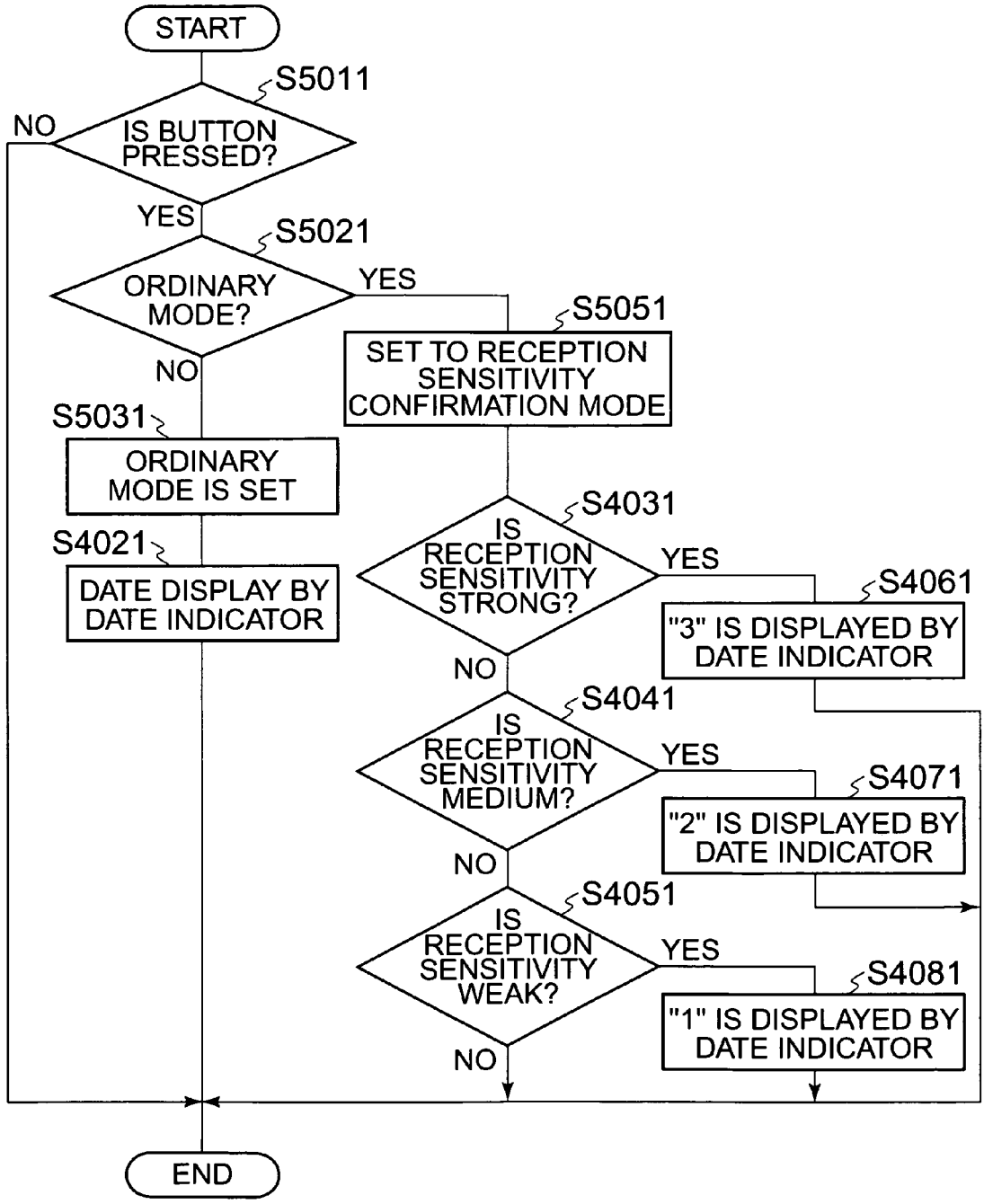
FIG. 5 is a flowchart showing processing in the analog radio-controlled timepiece concerned with the first embodiment of the present invention.
Figure 6:
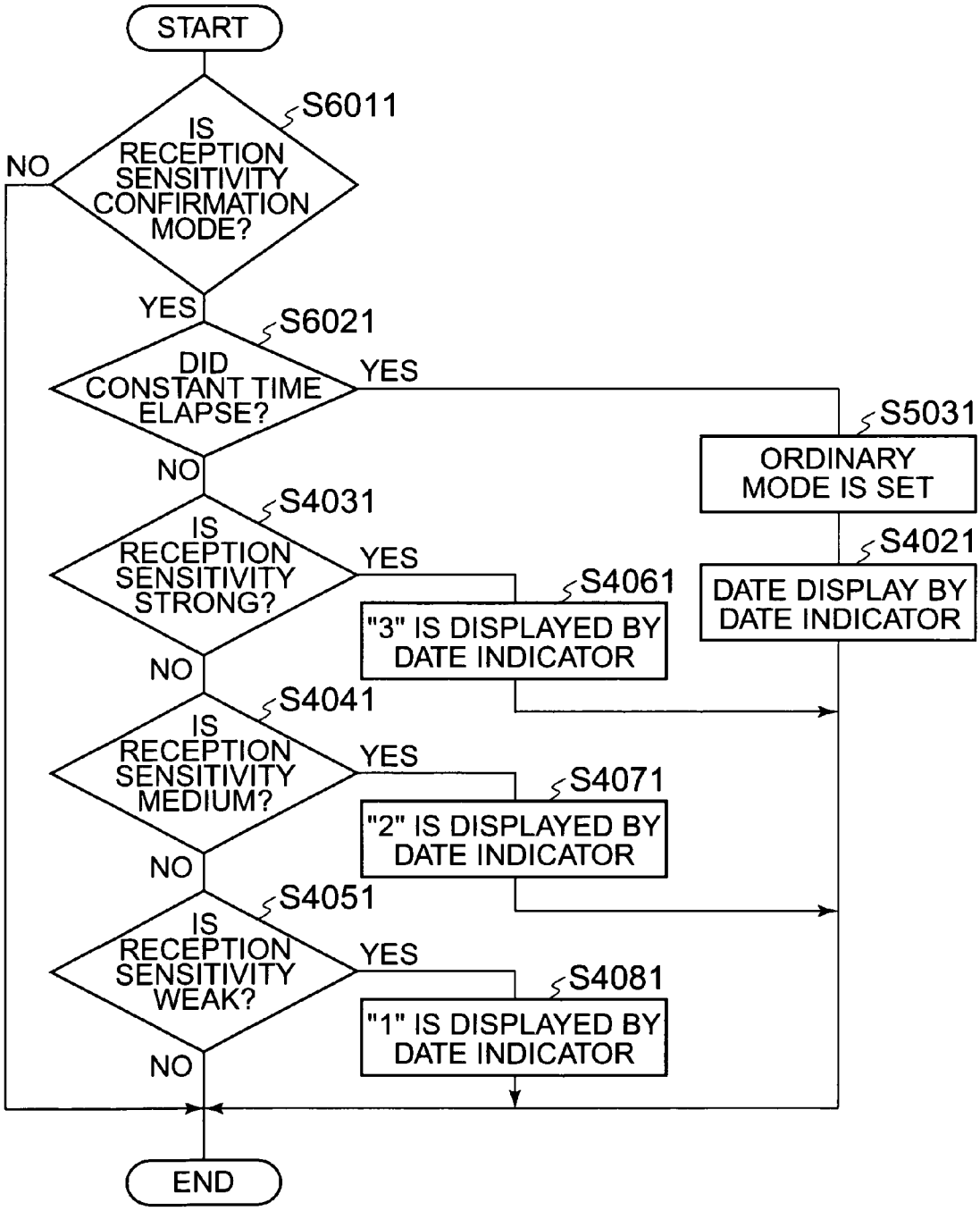
FIG. 6 is a flowchart showing processing in the analog radio-controlled timepiece concerned with the first embodiment of the present invention.

FIG. 4-FIG. 6 are flowcharts showing processing in the embodiment of the present invention, and show mainly processing in the control circuit 1031.

Hereunder, by using FIG. 1-FIG. 6, there are explained operations in the analog radio-controlled timepiece concerned with the present embodiment.

In the analog radio-controlled timepiece, in an ordinary mode performing a date and time display by performing a clock operation based on a timepiece signal from the oscillation circuit 1011 and the frequency dividing circuit 1021, the control circuit 1031 performs the clock operation by counting the timepiece signal from the frequency dividing circuit 1021 (At this time, the control circuit 1031 functions as the clock means.), and outputs control signals (a control signal for the date indicator, for rotation-controlling the date indicator 1071, and a control signal for the time instant hands, for rotation-controlling the time instant hands 1111), which correspond to the clocked time instant, to each of the motor driver circuits 1041, 1081 (At this time, the control circuit 1031 functions as the control means.).

The motor driver circuit 1081 rotation-drives the motor 1091 by a motor drive signal for the time instant hands, which corresponds to the control signal for the time instant hands. The motor 1091 rotation-drives the time instant hands 1111 through the train wheel 1101, thereby performing the analog display of the present time instant by the time instant hands 1111.

Further, if the clocked time instant becomes a predetermined time instant before a predetermined time from 12 o'clock in the afternoon, the control circuit 1031 outputs the control signal for the date indicator to the motor driver circuit 1041. The motor driver circuit 1041 rotation-drives the motor 1051 by the motor drive signal for the date indicator, which corresponds to the control signal for the date indicator. The motor 1051 rotation-drives the date indicator 1071 through the train wheel 1061, thereby altering a date to a date of the next day during a predetermined time.

In a time instant correction mode performing a time instant correction by receiving the time code included in the standard radio signal, when a predetermined time instant arrived or when a predetermined operation by the operation button 1131 was performed, the control circuit 1031 causes the reception circuit 1151 to perform a reception operation of the standard radio signal by making ON an electric source of the reception circuit 1151. The reception circuit 1151 outputs the time code included in the standard radio signal received by the antenna 1141 to the control circuit 1031.

At this time, in a case where the time instant hands 1111 are rotation-driven in order to continue to display the time instant that itself is clocking during the reception of the standard radio signal, the control circuit 1031 controls the motor 1091 so as to rotation-drive the time instant hands 1111 between a pulse signal and a pulse signal, which constitute the time code included in the standard radio signal. By this, even in a case where a noise is generated by the drive of the motor 1091, it is possible to prevent a false detection of the time code, which owes to the noise.

The control circuit 1031 corrects the own clocked time instant to an accurate present time instant corresponding to the time code (At this time, the control circuit 1031 functions as the time instant correction means.), and outputs a control signal corresponding to the accurate present time instant to the motor driver circuit 1081. The motor driver circuit 1081 rotation-drives the motor 1091 by a drive signal corresponding to the control signal, and the motor 1091 rotation-drives the time instant hands 1111 through the train wheel 1101, thereby performing an analog display of the above accurate present time instant corresponding to the time code.

Incidentally, in a case where the time instant is corrected by a manual operation, a time instant setting of the time instant hands 1111 is performed by rotation-driving the train wheel 1101 by manually operating the crown 1121, and a time instant information corrected by the crown 1121 is inputted to the control circuit 1031. By this, the clocked time instant of the control circuit 1031 is coincided with a displayed time instant by the time instant hands 1111.

Next, there are explained operations in a case where the reception sensitivity of the standard radio signal is displayed.

In FIG. 4, the control circuit 1031 judges whether or not the standard radio signal is during the reception by radio (step S4011) and, in a case of not during the reception, judges as the ordinary mode and performs a time instant display by the time instant hands 1111, and performs a date display by the date indicator 1071 (step S4021). By this, the analog radio-controlled timepiece performs an ordinary date and time display operation.

In a case where it was judged in the processing step S4011 that the standard radio signal was during the reception, the control circuit 1031 performs an operation of such a reception sensitivity confirmation mode performing a display by judging the reception sensitivity as mentioned below.

That is, if it is judged on the basis of the time code from the reception circuit 1151 that the reception sensitivity is strong (e.g., the standard radio signal is a signal exceeding a 1st reference level) (step S4031), the control circuit 1031 outputs the control signal for the date indicator to the motor driver circuit 1041 such that the date indicator 1071 displays "3" by referring to the reception sensitivity versus date indicator position correspondence table 1161 (step S4061). By this, the motor driver circuit 1041 rotation-drives the date indicator 1071 through the motor 1051 and the train wheel 1061, thereby displaying the date letters "3" by the date indicator 1071. By the date letters of the date indicator 1071, the user can know the fact that the reception sensitivity is strong.

In a case where it was judged in the processing step S4031 that the reception sensitivity of the standard radio signal was not strong, if it is judged that the reception sensitivity is medium (e.g., the standard radio signal is a signal which is below the 1st reference level and exceeds a 2nd reference level) (step S4041), the control circuit 1031 outputs the control signal for the date indicator to the motor driver circuit 1041 such that the date indicator 1071 displays "2" by referring to the reception sensitivity versus date indicator position correspondence table 1161 (step S4071). By this, the motor driver circuit 1041 rotation-drives the date indicator 1071 through the motor 1051 and the train wheel 1061, thereby displaying the date letters "2" by the date indicator 1071. By the date letters of the date indicator 1071, the user can know the fact that the reception sensitivity is medium.

In a case where it was judged in the processing step S4041 that the reception sensitivity of the standard radio signal was not medium, if it is judged that the reception sensitivity is weak (e.g., the standard radio signal is a signal which is below the 2nd reference level and exceeds a 3rd reference level) (step S4051), the control circuit 1031 outputs the control signal for the date indicator to the motor driver circuit 1041 such that the date indicator 1071 displays "1" by referring to the reception sensitivity versus date indicator position correspondence table 1161 (step S4081). By this, the motor driver circuit 1041 rotation-drives the date indicator 1071 through the motor 1051 and the train wheel 1061, thereby displaying the date letters "1" by the date indicator 1071. By the date letters of the date indicator 1071, the user can know the fact that the reception sensitivity is weak.

In a case where it was judged in the processing step 4051 that the reception sensitivity of the standard radio signal was not weak, the control circuit 1031 ends the processing. Incidentally, the processing steps S4031-S4051 in the control circuit 1031 constitute a reception sensitivity judgment means.

Incidentally, also in the reception sensitivity display mode, since the control circuit 1031 controls the motor 1091 such that the time instant hands 1111 display, a present time instant display by the time instant hands 1111 and a reception sensitivity display by the date indicator 1071 are simultaneously performed.

Next, along FIG. 5, there are explained operations in a case where a changeover between the ordinary mode and the reception sensitivity confirmation mode is performed by operating the operation button 1131. Incidentally, in FIG. 5, the same sign is applied to a portion performing the same processing as FIG. 4.

In FIG. 5, if it is judged that the operation button 1131 was manually operated (step S5011), the control circuit 1031 judges whether or not there exists in the ordinary mode (step S5021) and, in a case where there does not exist in the ordinary mode, sets to the ordinary mode (step S5031), thereby performing the time instant display by the time instant hands 1111 and performing the date display by the date indicator 1071 (the step S4021). By this, the analog radio-controlled timepiece performs the ordinary date and time display operation.

In a case where it was judged in the processing step S5021 that there existed in the ordinary mode, after there was set to the reception sensitivity confirmation mode (step S5051), the control circuit 1031 performs an operation of the above-mentioned reception sensitivity confirmation mode (the steps S4031-S4081).

By doing like this, by the manual operation of the operation button 1131, it becomes possible to operate by switching the ordinary mode performing the date and the time instant display and the reception sensitivity confirmation mode displaying the reception sensitivity of the standard radio.

Incidentally, in the present embodiment, although there is constituted such that the ordinary mode and the reception sensitivity confirmation mode are switched by providing the crown 1121 and the operation button 1131 as the operation means and operating the operation button 1131, there may be constituted such that the ordinary mode and the reception sensitivity confirmation mode are switched by providing only one of the crown 1121 or the operation button 1131 as the operation means and by an operation of the operation means concerned.

Next, along FIG. 6, there are explained operations in a case where there is automatically switched from the reception sensitivity confirmation mode to the ordinary mode. Incidentally, in FIG. 6, the same sign is applied to a portion performing the same processing as FIG. 5.

In FIG. 6, the control circuit 1031 judges whether or not there exists in the reception sensitivity confirmation mode (step S6011) and, in a case where there exists in the reception sensitivity confirmation mode, judges whether or not a constant time elapsed from a predetermined time instant (e.g., a time instant at which there became the reception sensitivity confirmation mode) (step S6021).

In a case where it was judged in the processing step S6021 that the constant time did not elapse, the control circuit 1031 performs the above-mentioned processings in the reception sensitivity confirmation mode (the steps S4031-S4081).

On the other hand, in a case where it was judged in the processing step S6021 that the constant time elapsed, the control circuit 1031 sets to the ordinary mode (step S5031), and performs the time instant display by the time instant hands 1111 and performs the date display by the date indicator 1071 (the step S4021). By this, the analog radio-controlled timepiece performs the ordinary date and time display operation.

By doing like this, in a case where a predetermined time elapsed from a predetermined time instant, it becomes possible to automatically switch to the ordinary mode from the reception sensitivity confirmation mode, so that the user can know the present date and time in the ordinary mode.

As mentioned above, according to the analog radio-controlled timepiece concerned with the present first embodiment, in the case where the reception sensitivity of the standard radio signal is displayed, since there is made such that the control circuit 1031 judges the reception sensitivity of the standard radio signal on the basis of the time code from the reception circuit 1151, rotation-controls the date indicator 1071 by referring to the reception sensitivity versus date indicator position correspondence table 1161, and displays the reception sensitivity by the date letters of the date indicator 1071, it becomes possible to display the reception sensitivity of the standard radio without adding the special constitution, such as symbols H, M and L denoting the reception sensitivity, to the case 2011.

Further, since the time instant hands 1111 are used exclusively for the time instant display without being used for the display of the reception sensitivity, the display of the present time instant becomes possible by the time instant hands 1111 even during the reception of the standard radio, and further it becomes possible to simultaneously display the time instant and the reception sensitivity being combined with the reception sensitivity display by the date indicator 1071.

Further, since the reception sensitivity is displayed by the numeral of the date indicator, there is brought about such an advantage that the reception sensitivity is easy to be understood.

Figures 7, 8:
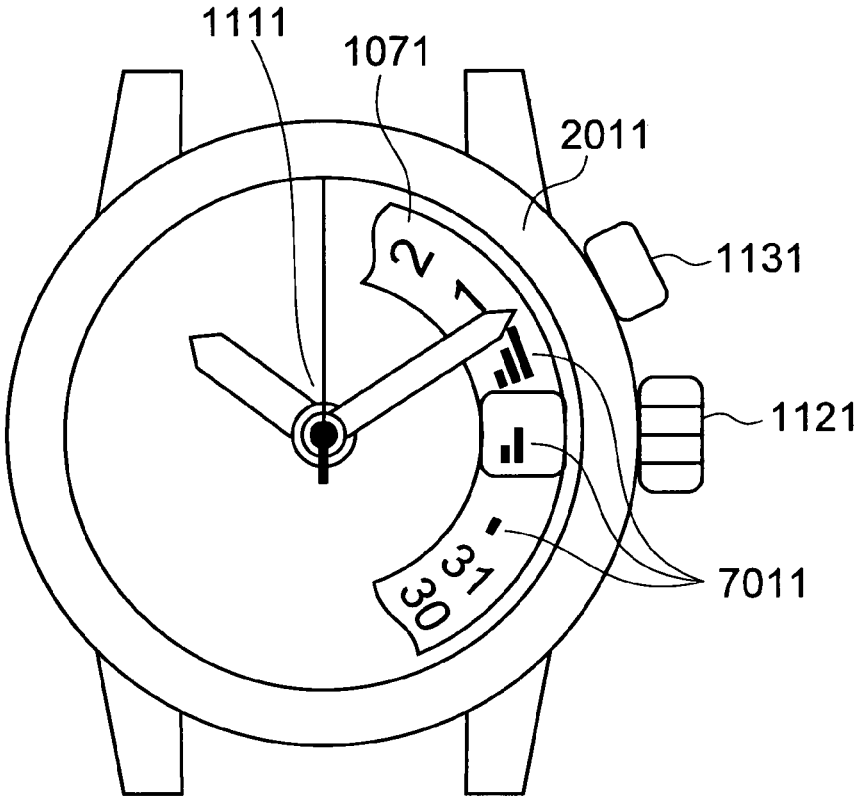
FIG. 7 is an external appearance view of an analog radio-controlled timepiece concerned with a second embodiment of the present invention.
FIG. 8 is a view showing a reception sensitivity versus date indicator position correspondence table used in the analog radio-controlled timepiece concerned with the second embodiment of the present invention.

FIG. 7 is a view showing an external appearance of an analog radio-controlled timepiece concerned with a second embodiment of the present invention, and a view in which one part is broken such that the date indicator 1071 is seen, and the same reference numeral is applied to the same portion as FIG. 2.

FIG. 8 is a view showing a content of a reception sensitivity versus date indicator position correspondence table used in the present second embodiment.

In the above first embodiment, although the date letters of the date indicator 1071 is used for denoting the reception sensitivity, in the present second embodiment there becomes a constitution in which three kinds of reception sensitivity display symbols 7011 for denoting strong, medium and weak reception sensitivities are additionally written to the date indicator 1071.

The reception sensitivity versus date indicator position correspondence table is used by being stored in the control circuit 1031 similarly to the above embodiment. The control circuit 1031 rotation-controls the motor 1051 such that the reception sensitivity display symbol complying with the reception sensitivity is displayed by referring to the reception sensitivity versus date indicator position correspondence table and, by this, rotation-controls the date indicator 1071.

Incidentally, in the present second embodiment and the above first embodiment, a display mode of the reception sensitivity, which is shown in FIG. 7 and FIG. 8, merely differs, and other portions such as circuit block diagram and processing flow are similar.

Also in the present second embodiment, there are brought about advantages similar to the above first embodiment by an addition of such an extremely simple constitution that the sensitivity display symbols 7011 are additionally written to the date indicator 1071 without adding the special constitution, such as symbols H, M and L denoting the reception sensitivity, to the case 2011.

Figure 9:
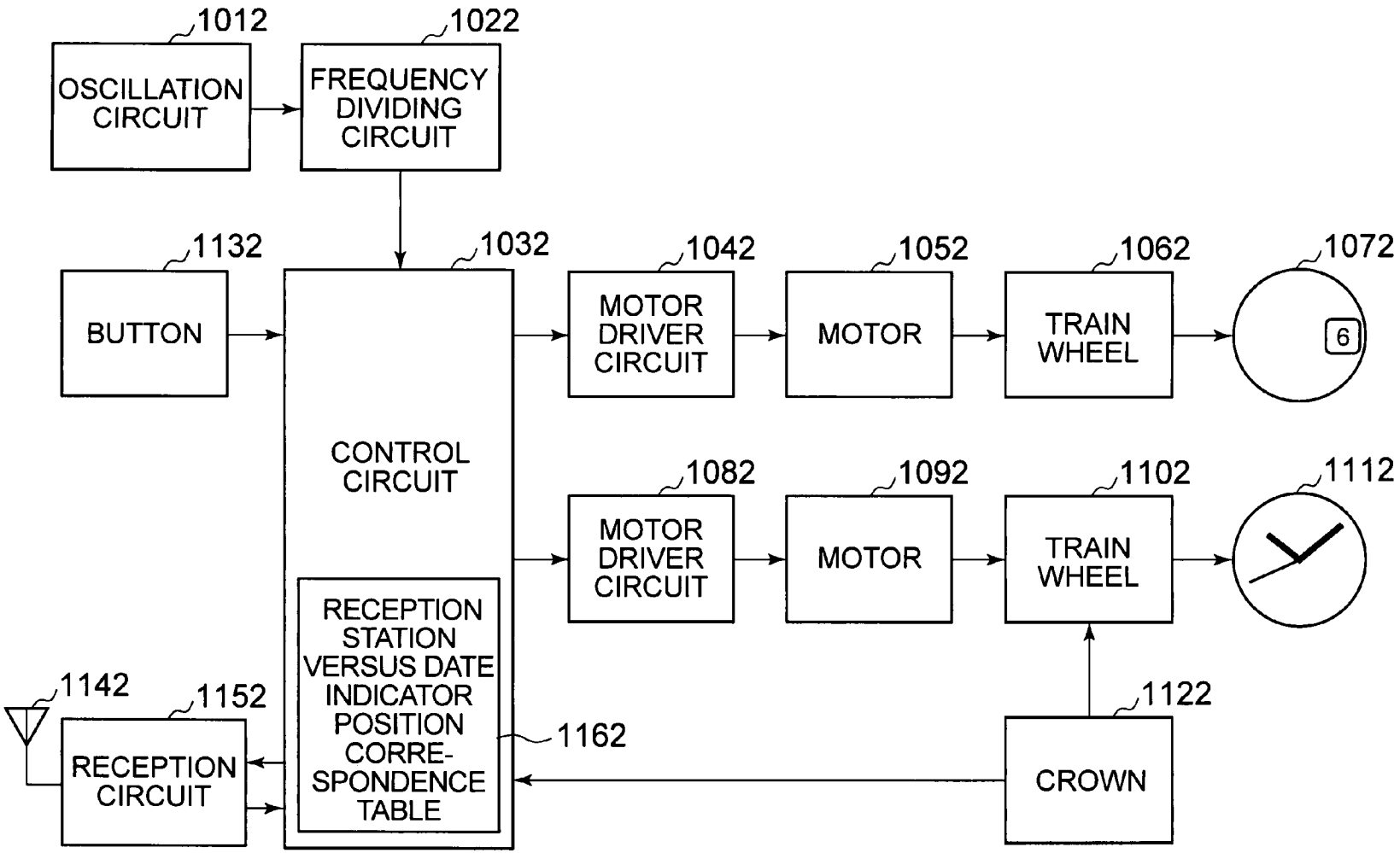
FIG. 9 is a block diagram of an analog radio-controlled timepiece concerned with a third embodiment of the present invention.

FIG. 9 is a block diagram of an analog radio-controlled timepiece concerned with a third embodiment of the present invention, and shows the example of the wristwatch type analog radio-controlled timepiece.

In FIG. 9, the analog radio-controlled timepiece possesses an oscillation circuit 1012 outputting the signal of the predetermined frequency, a frequency dividing circuit 1022 frequency-dividing the signal from the oscillation circuit 1012 to thereby output the time signal becoming the reference of the clock operation, a control circuit 1032 performing the clock operation based on the time signal to thereby perform the output processing of the control signal for the time instant display and the control processing of each constituent element of the analog radio-controlled timepiece or the later-mentioned processing and the like, a motor driver circuit 1082 responding to the control signal from the control circuit 1032 to thereby output the motor drive signal for time instant hands, a motor 1092 rotation-driven by the motor drive signal for time instant hands, a train wheel 1102 transmitting the rotation of the motor 1092, and time instant hands (the hour hand, the minute hand, and the second hand) 1112 rotation-driven by the train wheel 1102.

Further, the analog radio-controlled timepiece possesses a motor driver circuit 1042 responding to the control signal from the control circuit 1032 to thereby output the motor drive signal for the date indicator, a motor 1052 rotation-driven by the motor drive signal for the date indicator, a train wheel 1062 transmitting the rotation of the motor 1052, and a date indicator 1072 rotation-driven by the train wheel 1062. Incidentally, in FIG. 9, there is shown the state in which the date indicator 1072 displays the 6th day.

Further, the analog radio-controlled timepiece possesses an antenna 1142 receiving, by radio, the standard radio signal including the time code, a reception circuit 1152 outputting the time code included in the standard radio signal received by the antenna 1142, a crown 1122 driving the train wheel 1102 by the predetermined manual operation to thereby perform the time instant setting of the time instant hands 1112 and inputting the operation signal complying with the manual operation to the control circuit 1032, and an operation button 1132 capable of being manually operated.

The control circuit 1032 has the storage means in its inside and, in the storage means, there is stored a reception station versus date indicator position correspondence table 1162 which is a table in which a station (reception station) having transmitted the standard radio signal received by the antenna 1142 and the rotation position of the date indicator 1072 are corresponded. In the date indicator 1072, date letters denoting from 1st day to 31st day are provided by the imprinting or the like.

Here, the antenna 1142 and the reception circuit 1152 constitute the reception means receiving, by radio, the standard radio signal including the time code, the motor 1092 constitutes the 1st motor, and the motor 1052 constitutes the 2nd motor. The crown 1122 and the operation button 1132 constitute the operation means. Further, the control circuit 1032 constitutes the clock means clocking the present time instant by counting the time signal, the time instant correction means correcting the present time instant being clocked to the time instant corresponding to the time code, a judgment means judging the reception station of the standard radio signal received by the antenna 1142, and the control means.

Figures 10, 11:
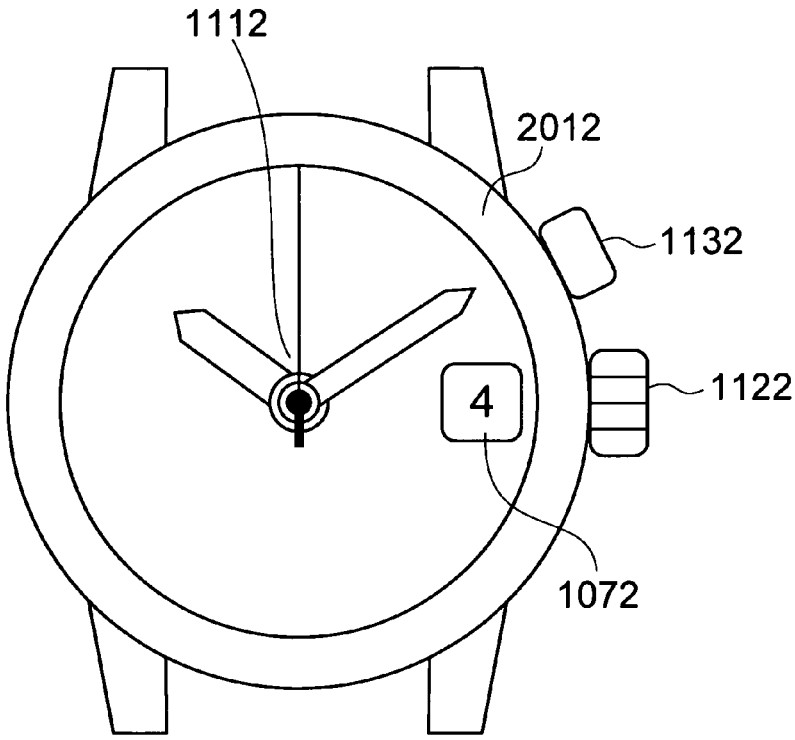
FIG. 10 is an external appearance view of the analog radio-controlled timepiece concerned with the third embodiment of the present invention.
FIG. 11 is a view showing a reception station versus date indicator position correspondence table used in the analog radio-controlled timepiece concerned with the third embodiment of the present invention.

FIG. 10 is a view showing an external appearance of the analog radio-controlled timepiece concerned with the embodiment of the present invention, and the same reference numeral is applied to the same portion as FIG. 9. Incidentally, 2012 is the case of the analog radio-controlled timepiece.

FIG. 11 is a view showing a content of a reception station versus date indicator position correspondence table 1162 stored in the control circuit 1032. In the present embodiment, a frequency of the standard radio signal transmitted from the reception station is 40 kHz in Japan 1, 60 kHz in Japan 2, the USA and UK, and 77.5 kHz in Germany. The date letters of the date indicator 1072, which displays each reception station, is the same date letters as a highest digit of the frequency in each reception station, and it is "4" in a case where the reception station is Japan 1, "6" in cases where the reception stations are Japan 2, the USA and UK, and "7" in a case where the reception station is Germany. In FIG. 10, the date indicator 1072 displays "4", so that it is understood that the reception station is Japan 1.

Although details of a reception station display operation of the received standard radio signal are mentioned later, in roughly explaining, by scanning a tuned frequency of the reception circuit 1152 under a control of the control circuit 1032, the time code in the standard radio signal tuning-received through the antenna 1142 is outputted from the reception circuit 1152, and the control circuit 1032 judges the reception station on the basis of the frequency of the tuning-received standard radio signal and a form of the time code included in the standard radio signal (At this time, the control circuit 1032 functions as a judgment means.), and rotation-controls the date indicator 1072 so as to display the date letters corresponding to the judged reception station by referring to the reception station versus date indicator position correspondence table 1162 (At this time, the control circuit 1032 functions as the control means.).

Figure 12:
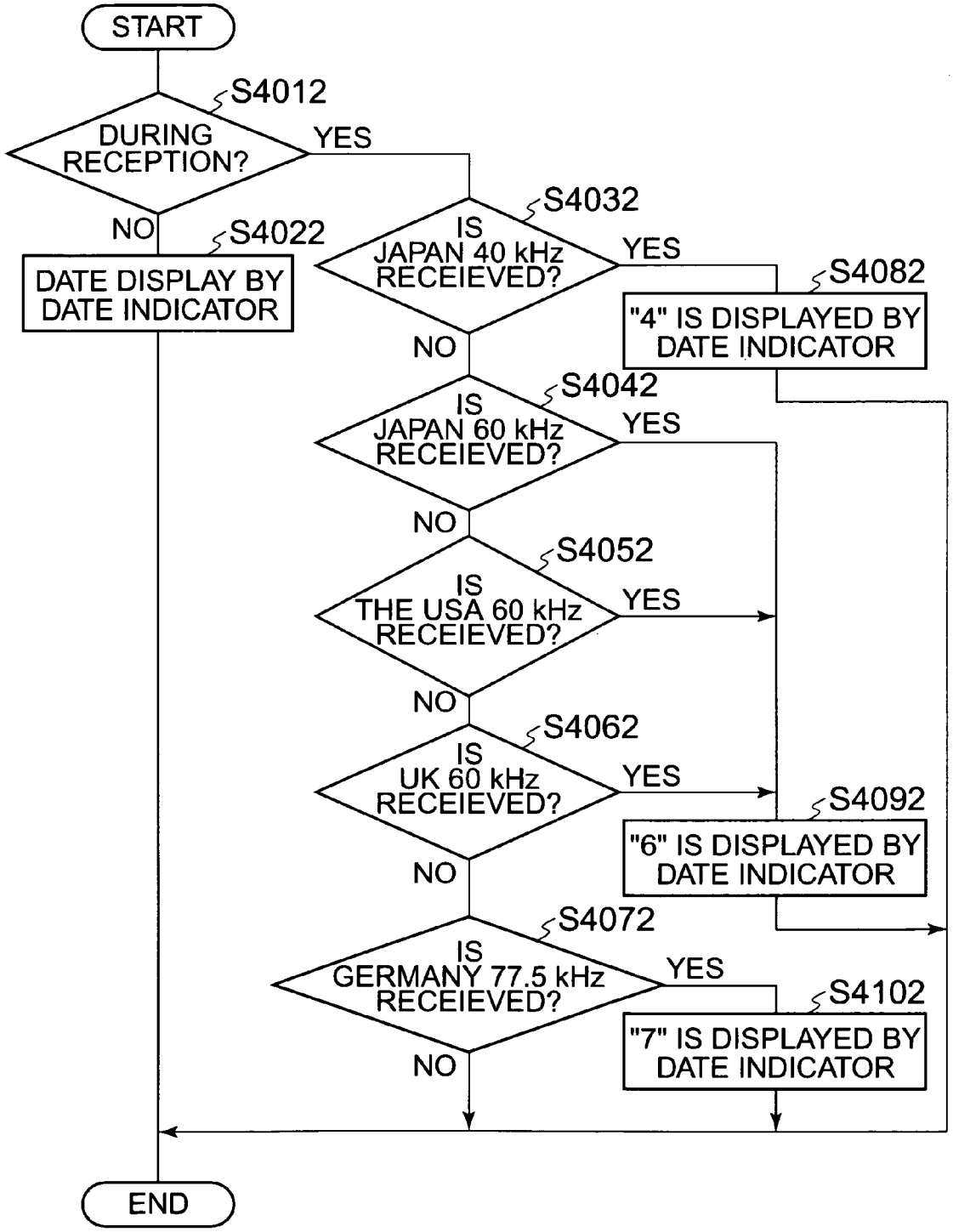
FIG. 12 is a flowchart showing processing in the analog radio-controlled timepiece concerned with the third embodiment of the present invention.
Figure 13:
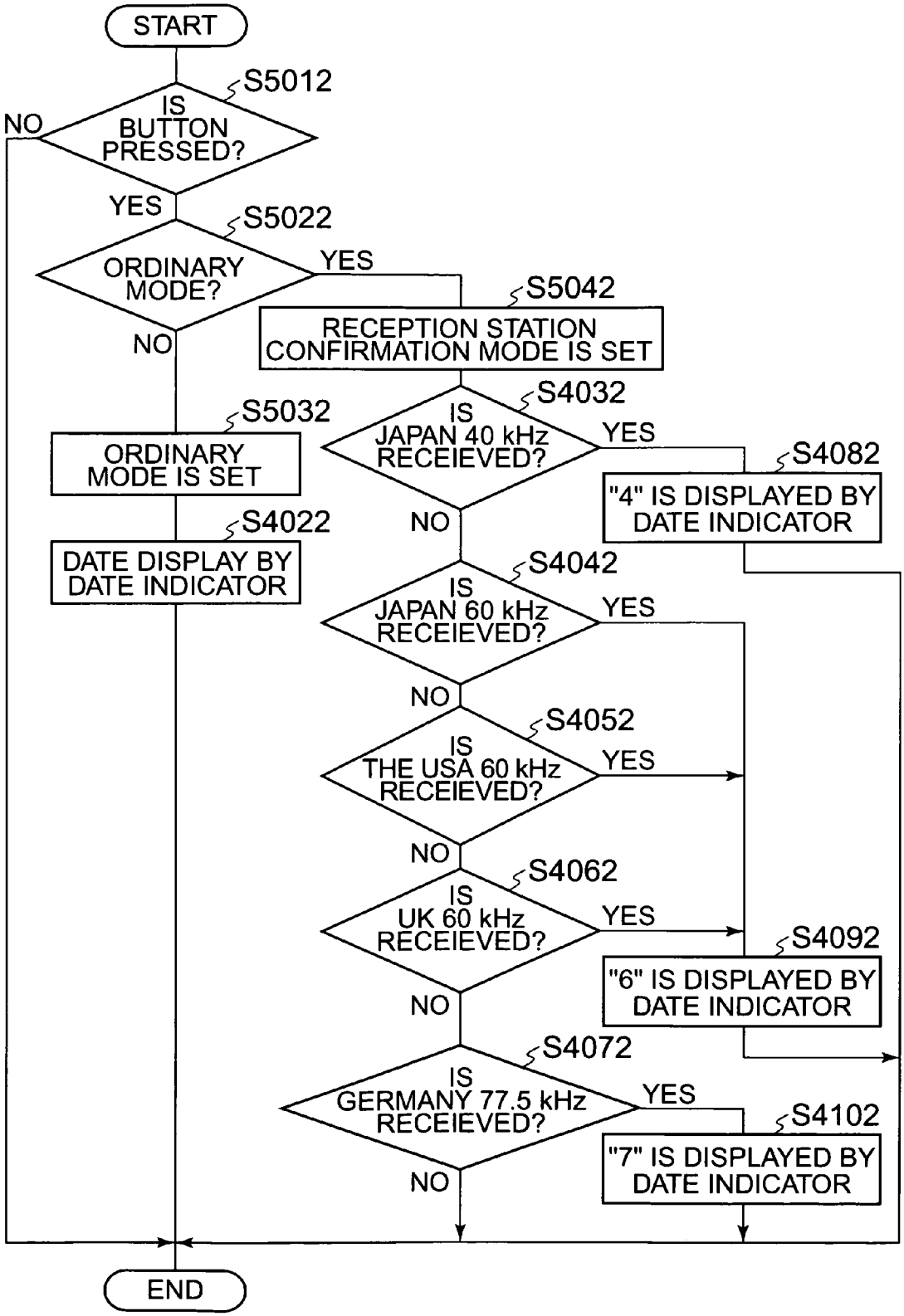
FIG. 13 is a flowchart showing processing in the analog radio-controlled timepiece concerned with the third embodiment of the present invention.
Figure 14:
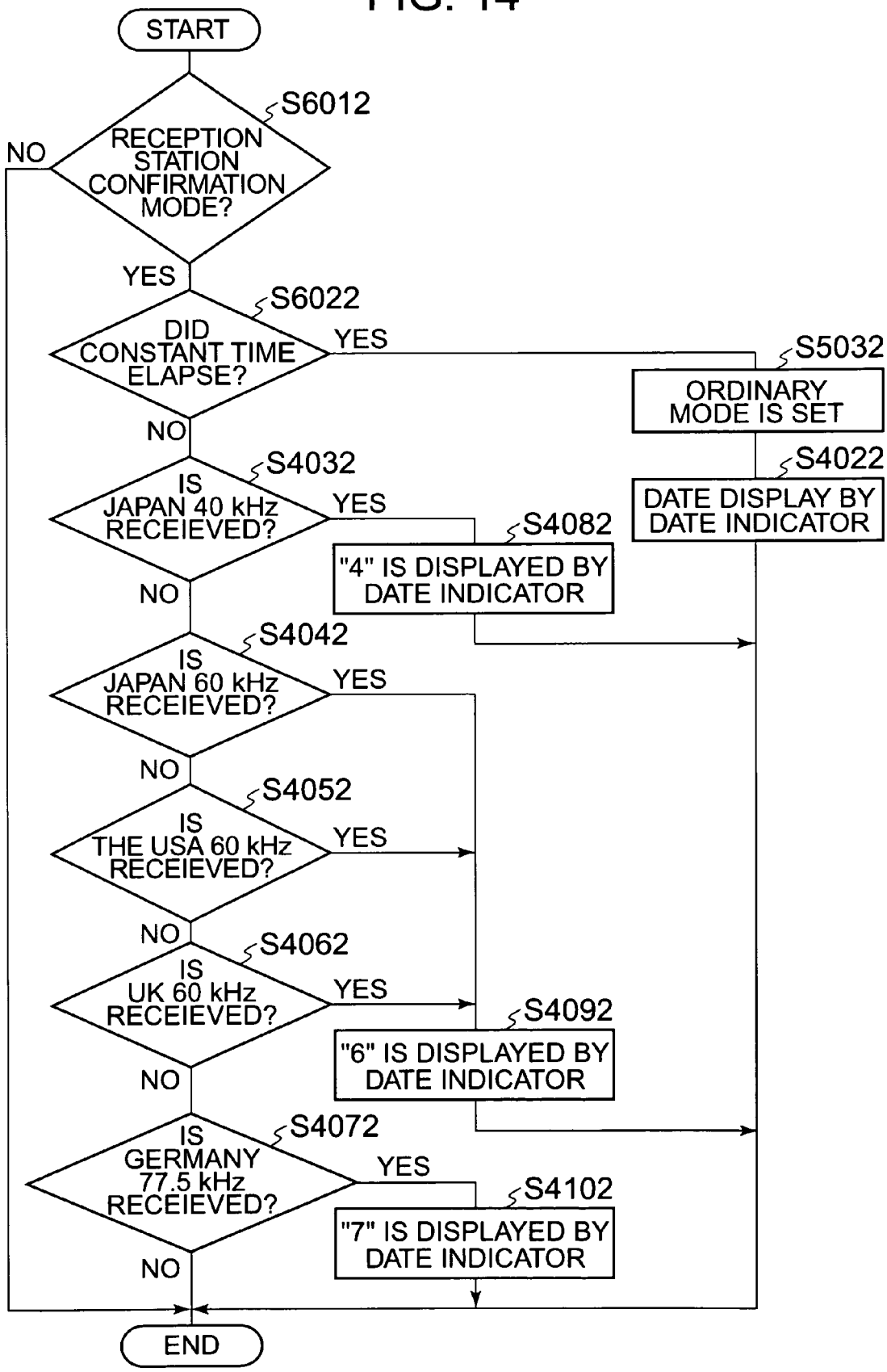
FIG. 14 is a flowchart showing processing in the analog radio-controlled timepiece concerned with the third embodiment of the present invention.

FIG. 12-FIG. 14 are flowcharts showing processing in the embodiment of the present invention, and show mainly processing in the control circuit 1032.

Hereunder, by using FIG. 9-FIG. 14, there are explained operations in the analog radio-controlled timepiece concerned with the present embodiment.

In the analog radio-controlled timepiece, in the ordinary mode performing the date and time display by performing the clock operation based on the timepiece signal from the frequency dividing circuit 1022, the control circuit 1032 performs the clock operation by counting the timepiece signal from the frequency dividing circuit 1022 (At this time, the control circuit 1032 functions as the clock means.), and outputs control signals (the control signal for the date indicator, for rotation-controlling the date indicator, and the control signal for the time instant hands, for rotation-controlling the time instant hands), which correspond to the clocked time instant, to each of the motor driver circuits 1042, 1082 (At this time, the control circuit 1032 functions as the control means.).

The motor driver circuit 1082 rotation-drives the motor 1092 by the motor drive signal for the time instant hands, which corresponds to the control signal for the time instant hands. The motor 1092 rotation-drives the time instant hands 1112 through the train wheel 1102, thereby performing the analog display of the present time instant by the time instant hands 1112.

Further, if the clocked time instant becomes the predetermined time instant before the predetermined time from 12 o'clock in the afternoon, the control circuit 1032 outputs the control signal for the date indicator to the motor driver circuit 1042. The motor driver circuit 1042 rotation-drives the motor 1052 by the motor drive signal for the date indicator, which corresponds to the control signal for the date indicator. The motor 1052 rotation-drives the date indicator 1072 through the train wheel 1062, thereby altering the date to the date of the next day during the predetermined time.

In the time instant correction mode performing the time instant correction by receiving the time code included in the standard radio signal, when a predetermined time instant for automatically performing the time instant correction arrived or when the predetermined operation by the operation button 1132 was performed, the control circuit 1032 causes the reception circuit 1152 to perform the reception operation of the standard radio signal by making ON the electric source of the reception circuit 1152. The reception circuit 1152 outputs the time code included in the standard radio signal received by the antenna 1142 to the control circuit 1032.

At this time, in the case where the time instant hands 1112 (especially, the secondhand) are rotation-driven in order to continue to display the time instant that itself is clocking during the reception of the standard radio signal, the control circuit 1032 controls the motor 1092 so as to rotation-drive the time instant hands 1112 between (interstice between pulse signals) the pulse signal and the pulse signal, which constitute the time code included in the standard radio signal. By this, drives of the time instant hands are performed. At this time, even in the case where the noise is generated by the drive of the motor 1092, it is possible to prevent the false detection of the time code, which owes to the noise.

In a case where the standard radio signal was able to normally received, the control circuit 1032 corrects the own clocked time instant to the accurate present time instant corresponding to the time code (At this time, the control circuit 1032 functions as the time instant correction means.), and outputs the control signal corresponding to the accurate present time instant to the motor driver circuit 1082. The motor driver circuit 1082 rotation-drives the motor 1092 by the drive signal corresponding to the control signal, and the motor 1092 rotation-drives the time instant hands 1112 through the train wheel 1102, thereby performing the analog display of the above accurate present time instant corresponding to the time code.

Incidentally, in the case where the time instant is corrected by the manual operation, the time instant setting of the time instant hands 1112 is performed by rotation-driving the train wheel 1102 by manually operating the crown 1122, and the time instant information corrected by the crown 1122 is inputted to the control circuit 1032. By this, the clocked time instant of the control circuit 1032 is coincided with the displayed time instant by the time instant hands 1112.

Next, there are explained operations in a case where the reception station of the standard radio signal is displayed.

In FIG. 12, the control circuit 1032 judges whether or not the standard radio signal is during the reception by radio (step S4012) and, in the case of not during the reception, judges as the ordinary mode to thereby perform the time instant display by the time instant hands 1112, and performs the date display by the date indicator 1072 (step S4022). By this, the analog radio-controlled timepiece performs the ordinary date and time display operation.

In the case/where it was judged in the processing step S4012 that the standard radio signal was during the reception, as mentioned below, the control circuit 1032 receives the standard radio signal while scanning a reception frequency of the reception circuit 1152, and judges the reception station of the received standard radio signal, thereby performing operations of a reception station confirmation mode performing a display.

That is, if it is judged that the standard radio signal of 40 kHz was able to received by scanning the reception frequency of the reception circuit 1152 (In a case where the frequency is 40 kHz, it is limited to the standard radio of 40 kHz in Japan 1) (step S4032), the control circuit 1032 outputs the control signal for the date indicator to the motor driver circuit 1042 such that the date indicator 1072 displays a numeral "4" which is the highest digit of the standard radio signal by referring to the reception station versus date indicator position correspondence table 1162 (step S4082). By this, the motor driver circuit 1042 rotation-drives the date indicator 1072 through the motor 1052 and the train wheel 1062, thereby displaying the date letters "4" by the date indicator 1072. By the date letters of the date indicator 1072, the user can know the fact that the reception station is Japan 1.

In a case where it was judged in the processing step S4032 that the reception circuit 1152 could not receive the standard radio signal of 40 kHz, the control circuit 1032 controls so as to receive the standard radio signal of 60 kHz by scanning the reception frequency of the reception circuit 1152. If the reception circuit 1152 receives the standard radio signal of 60 kHz and it is judged that the form of the time code included in the standard radio signal is the time code in Japan 2 (i.e., if it is judged that the standard radio signal of 60 kHz in Japan 2 was received) (step S4042), the control circuit 1032 outputs the control signal for the date indicator to the motor driver circuit 1042 such that the date indicator 1072 displays a numeral "6" which is the highest digit of the standard radio signal by referring to the reception station versus date indicator position correspondence table 1162 (step S4092). By this, the motor driver circuit 1042 rotation-drives the date indicator 1072 through the motor 1052 and the train wheel 1062, thereby displaying the date letters "6" by the date indicator 1072.

In the processing step S4042, since the reception circuit 1152 was able to receive the standard radio signal of 60 kHz but the form of the time code differs from one in Japan 2, in a case where there was judged that it was not the standard radio signal of 60 kHz in Japan 2, if a reception state of the standard radio signal of 60 kHz is maintained without altering the reception frequency of the reception circuit 1152 and it is judged that the form of the time code included in the standard radio signal is the time code in the USA (i.e., if it is judged that the standard radio signal of 60 kHz in the USA was received) (step S4052), the control circuit 1032 outputs the control signal for the date indicator to the motor driver circuit 1042 such that the date indicator 1072 displays the numeral "6" which is the highest digit of the standard radio signal by referring to the reception station versus date indicator position correspondence table 1162 (the step S4092). By this, the motor driver circuit 1042 rotation-drives the date indicator 1072 through the motor 1052 and the train wheel 1062, thereby displaying the date letters "6" by the date indicator 1072.

Next, in the processing step S4052, since the reception circuit 1152 was able to receive the standard radio signal of 60 kHz but the form of the time code differs from the one in the USA, in a case where there was judged that it was not the standard radio signal of 60 kHz in the USA, if the reception state of the standard radio signal of 60 kHz is maintained without altering the reception frequency of the reception circuit 1152 and it is judged that the form of the time code included in the standard radio signal is the time code in UK (i.e., if it is judged that the standard radio signal of 60 kHz in UK was received) (step S4062), the control circuit 1032 outputs the control signal for the date indicator to the motor driver circuit 1042 such that the date indicator 1072 displays the numeral "6" which is the highest digit of the standard radio signal by referring to the reception station versus date indicator position correspondence table 1162 (the step S4092). By this, the motor driver circuit 1042 rotation-drives the date indicator 1072 through the motor 1052 and the train wheel 1062, thereby displaying the date letters "6" by the date indicator 1072.

Incidentally, in the processing step 4092, although the same display is performed by the date indicator 1072, by seeing the date letters of the date indicator 1072 while considering a place where the user exists, it is possible to easily grasp which reception station it is among the three stations (Japan 2, the USA and UK), and it follows that the reception station was substantially displayed.

Next, in a case where it was judged in the processing step S4062 that reception circuit 1152 could not receive the standard radio signal of 60 kHz in UK, the control circuit 1032 controls so as to receive the standard radio signal of 77.5 kHz by scanning the reception frequency of the reception circuit 1152. When the reception circuit 1152 receives the standard radio signal of 77.5 kHz and if it is judged that the form of the time code included in the standard radio signal is the time code in Germany (i.e., if it is judged that the standard radio signal of 77.5 kHz in Germany ways received) (step S4072), the control circuit 1032 outputs the control signal for the date indicator to the motor driver circuit 1042 such that the date indicator 1072 displays a numeral "7" which is the highest digit of the standard radio signal by referring to the reception station versus date indicator position correspondence table 1162 (step S4102).

By this, the motor driver circuit 1042 rotation-drives the date indicator 1072 through the motor 1052 and the train wheel 1062, thereby displaying the date letters "7" by the date indicator 1072. By the date letters of the date indicator 1072, the user can know the fact that the reception station is Germany.

Further, also in the above reception station confirmation mode, since the control circuit 1032 controls the motor 1092 such that the time instant hands 1112 display the time instant, the present time instant display by the time instant hands 1112 and a reception station display of the standard radio signal by the date indicator 1072 are simultaneously performed.

Incidentally, the processing steps S4032-S4072 in the control circuit 1032 constitute a judgment means.

By doing like the above, it becomes possible to display the reception station of the received standard radio signal by the date letters of the date indicator 1072 without adding the special constitution such as marking a reception station name to a case 2012.

Further, since there is constituted such that the highest digit of the standard radio signal that each reception station transmits is displayed by the date letters of the date indicator 1072, there is brought about an advantage that the reception station is easy to be judged. In the processing step S4092, although the displays of the three reception stations become the same, as mentioned above, it becomes possible to easily grasp the reception station by seeing the date letters of the date indicator 1072 by considering the place where the user exists.

Further, also in the above reception station confirmation mode, it becomes possible to simultaneously display the present time instant and the reception station.

Next, along FIG. 13, there are explained operations in a case where a changeover between the ordinary mode and the reception station confirmation mode is performed by operating the operation button 1132. Incidentally, in FIG. 13, the same sign is applied to a portion performing the same processing as FIG. 12.

In FIG. 13, if it is judged that the operation button 1132 was manually operated (step S5012), the control circuit 1032 judges whether or not there exists in the ordinary mode (step S5022) and, in the case where there does not exist in the ordinary mode, sets to the ordinary mode (step S5032), thereby performing the time instant display by the time instant hands 1112 and performing the date display by the date indicator 1072 (step S4022). By this, the analog radio-controlled timepiece performs the ordinary date and time display operation.

In a case where it was judged in the processing step S5022 that there existed in the ordinary mode, after there was set to the reception station confirmation mode (step S5042), the control circuit 1032 performs an operation of the above-mentioned reception station confirmation mode (the steps S4032-S4102).

By doing like this, by the manual operation of the operation button 1132, it becomes possible to operate by switching the ordinary mode performing the date and the time instant display and the reception station confirmation mode displaying the reception station of the standard radio signal.

Incidentally, in the present embodiment, although there is constituted such that the ordinary mode and the reception station confirmation mode are switched by providing the crown 1122 and the operation button 1132 as the operation means and operating the operation button 1132, there may be constituted such that the ordinary mode and the reception station confirmation mode are switched by providing only one of the crown 1122 or the operation button 1132 as the operation means and by an operation of the operation means concerned.

Next, along FIG. 14, there are explained operations in a case where there is automatically switched from the reception station confirmation mode to the ordinary mode. Incidentally, in FIG. 14, the same sign is applied to a portion performing the same processing as FIG. 13.

In FIG. 14, the control circuit 1032 judges whether or not there exists in the reception station confirmation mode (step S6012) and, in a case where there exists in the reception station confirmation mode, judges whether or not a constant time elapsed from a predetermined time instant (e.g., a time instant at which there became the reception station confirmation mode) (step S6022).

In a case where it was judged in the processing step S6022 that the constant time did not elapse, the control circuit 1032 performs the above-mentioned processing of the reception station confirmation mode (the steps S4032-S4102).

On the other hand, in a case where it was judged in the processing step S6022 that the constant time elapsed, the control circuit 1032 sets to the ordinary mode (step S5032), and performs the time instant display by the time instant hands 1112 and performs the date display by the date indicator 1072 (the step S4022). By this, the analog radio-controlled timepiece performs the ordinary date and time display operation.

By doing like this, in the case where the predetermined time elapsed from the predetermined time instant, it becomes possible to automatically switch to the ordinary mode from the reception station confirmation mode, so that the user can know the present date and time in the ordinary mode.

As mentioned above, according to the analog radio-controlled timepiece concerned with the present third embodiment, in the case where the reception station of the received standard radio signal is displayed, since there is made such that the control circuit 1032 controls the reception circuit 1152 so as to scan the standard radio signal to be received, judges the reception station on the basis of the frequency and the form of the time code of the standard radio signal that the reception circuit 1152 received, and rotation-controls the date indicator 1072 to a position corresponding to the reception station by referring to the reception station versus date indicator position correspondence table 1162 to thereby display the reception station by the date letters of the date indicator 1072, it becomes possible to display the reception station without adding the special constitution, such as symbol denoting the reception station, to the case 2012.

Further, since the time instant hands 1112 (e.g., the second hand) are used exclusively for displaying the time instant without being used for the display of the reception station, even during the reception of the standard radio, the display of the present time instant becomes possible by the time instant hands 1112, and it becomes possible to simultaneously display the time instant and the reception station.

Further, since not only the reception station is displayed by the date letters of the date indicator but also the date letters coinciding with the numeral of the highest digit of the frequency of the standard radio signal that the reception station transmits is displayed by the date indicator, there is brought about such an advantage that it becomes possible to easily grasp the reception station.

Next, there is explained about a fourth embodiment of the present invention. In the above third embodiment, although the date letters of the date indicator 1072 is used in order to denote the reception station, in the present fourth embodiment, plural frequency display symbols 7012 denoting the frequency of the standard radio signal that the reception station transmits, which differ from the date, letters, are additionally provided in the date indicator 1072. There is constituted so as to be capable of indirectly grasping the reception station by displaying the frequency display symbols.

Figures 15, 16:
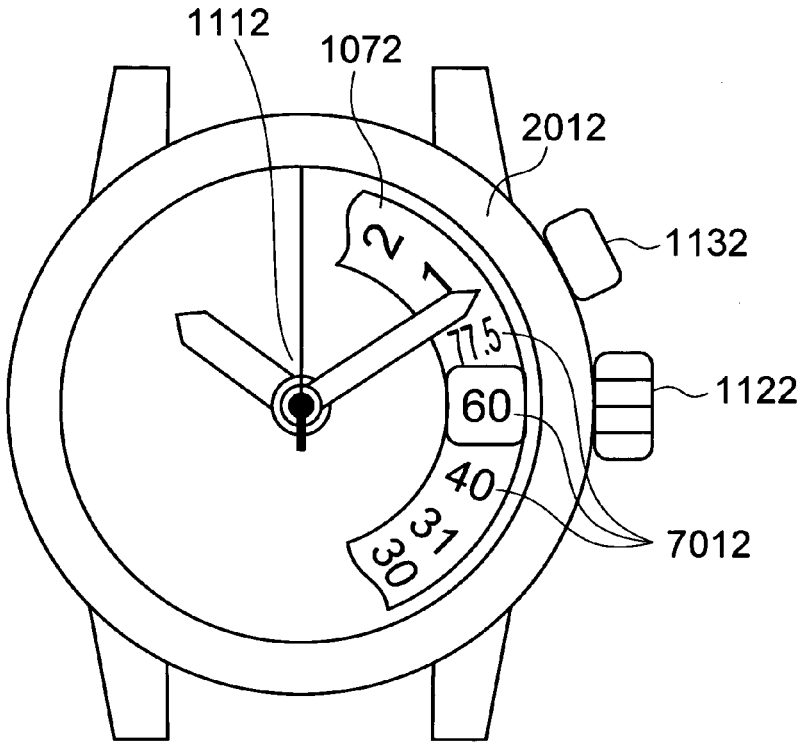
FIG. 15 is an external appearance view of an analog radio-controlled timepiece concerned with a fourth embodiment of the present invention.
FIG. 16 is a view showing a reception station versus date indicator position correspondence table used in the analog radio-controlled timepiece concerned with the fourth embodiment of the present invention.

FIG. 15 is a view showing an external appearance of an analog radio-controlled timepiece concerned with the present fourth embodiment, and a view in which one part is broken such that the date indicator 1072 is seen, and the same reference numeral is applied to the same portion as FIG. 10. In FIG. 15, there is shown the fact that the frequency of the standard radio signal is 60 kHz.

FIG. 16 is a view showing a content of a reception station versus date indicator position correspondence table used in the fourth embodiment.

The present fourth embodiment and the above third embodiment differ only in display modes shown in FIG. 15 and FIG. 16 and other portions of the circuit block diagram, the processing flow and the like are similar, and the reception station versus date indicator position correspondence table is used while being stored in the control circuit 1032 similarly to the above embodiment 3.

In the reception station confirmation mode, the control circuit 1032 controls the 2nd motor 1052 such that a judgment result of the judgment means is displayed by the frequency display symbol 7012 of the date indicator 1072. By this, the reception station of the received standard radio signal is indirectly displayed by its frequency display. For example, in a case where "60" is displayed as shown in FIG. 15, the reception station is any of Japan 2, the USA or UK, and which station it is can be easily discriminated by considering an existence position of the user.

Also in the present fourth embodiment, an advantage similar to the above third embodiment is brought about by adding such an extremely simple constitution as to additionally write the frequency display symbol 7012, which corresponds, to the frequency of the standard radio signal of the reception station, to the date indicator 1072 without adding the special constitution, such as symbol denoting the reception station, to the case 2012.

Figure 17:
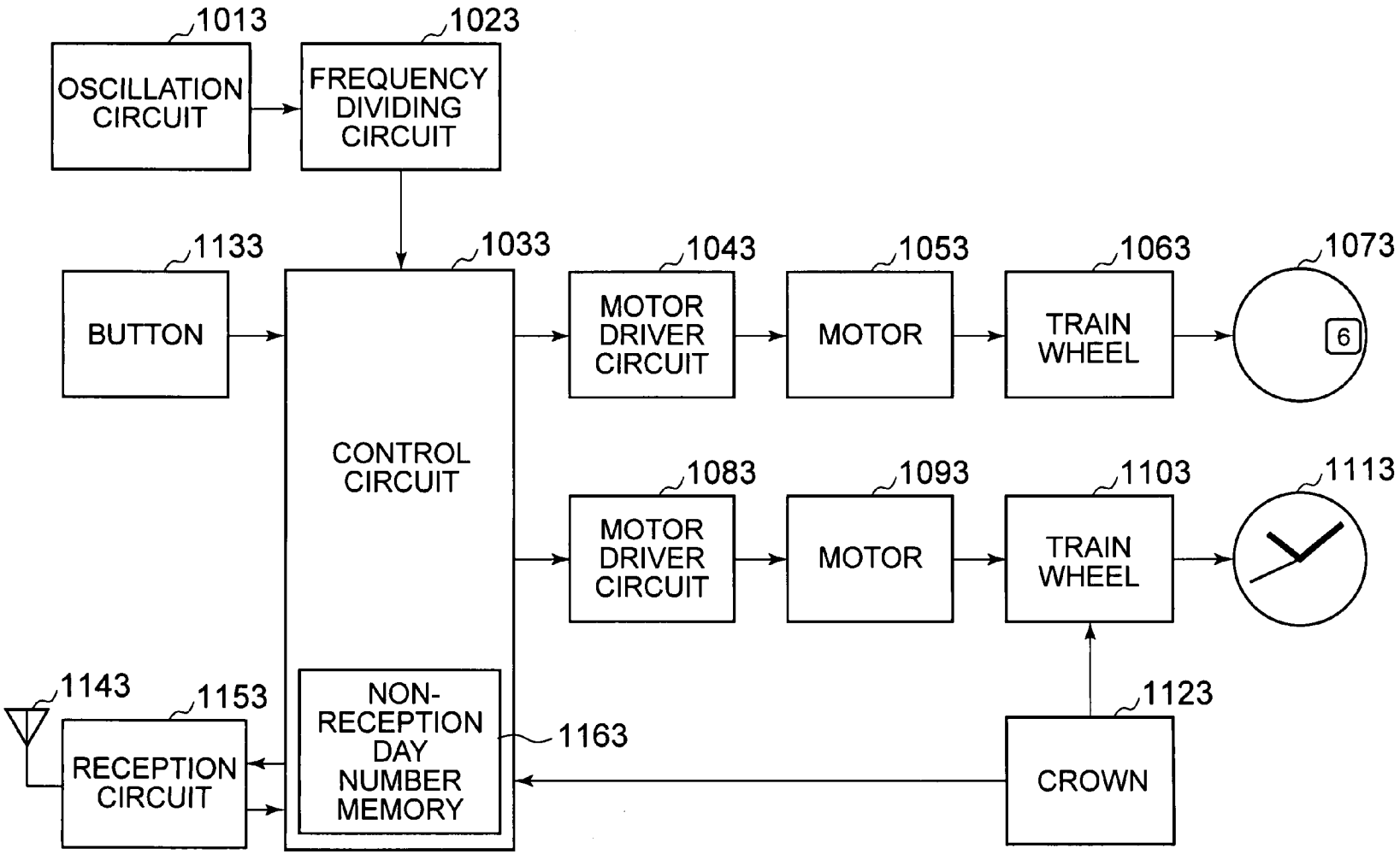
FIG. 17 is a block diagram of an analog radio-controlled timepiece concerned with a fifth embodiment of the present invention.

FIG. 17 is a block diagram of an analog radio-controlled timepiece concerned with a fifth embodiment of the present invention, and shows the example of the wristwatch type analog radio-controlled timepiece.

In FIG. 17, the analog radio-controlled timepiece possesses an oscillation circuit 1013 outputting the signal of the predetermined frequency, a frequency dividing circuit 1023 frequency-dividing the signal from the oscillation circuit 1013 to thereby output the time signal becoming the reference of the clock operation, a control circuit 1033 performing the clock operation based on the time signal to thereby perform the output processing of the control signal for the time instant display and the control processing of each constituent element of the analog radio-controlled timepiece or the later-mentioned processing and the like, a motor driver circuit 1083 responding to the control signal from the control circuit 1033-to thereby output the motor drive signal for time instant hands, a motor 1093 rotation-driven by the motor drive signal for time instant hands, a train wheel 1103 transmitting the rotation of the motor 1093, and time instant hands (the hour hand, the minute hand, and the second hand) 1113 rotation-driven by the train wheel 1103.

Further, the analog radio-controlled timepiece possesses a motor driver circuit 1043 responding to the control signal from the control circuit 1033 to thereby output the motor drive signal for the date indicator, a motor 1053 rotation-driven by the motor drive signal for the date indicator, a train wheel 1063 transmitting the rotation of the motor 1053, and a date indicator 1073 rotation-driven by the train wheel 1063. In the date indicator 1073, date letters denoting dates from the 1st day to the 31st day are provided by the imprinting or the like. Incidentally, in FIG. 17, there is shown the state in which the date indicator 1073 displays the 6th day.

Further, the analog radio-controlled timepiece possesses an antenna 1143 receiving, by radio, the standard radio signal including the time code, a reception circuit 1153 outputting the time code included in the standard radio signal received by the antenna 1143, a crown 1123 driving the train wheel 1103 by the predetermined manual operation to thereby perform the time instant setting of the time instant hands 1113 and inputting the operation signal complying with the manual operation to the control circuit 1033, and an operation button 1133 capable of being manually operated.

The control circuit 1033 has in its inside a non-reception day number memory 1163 storing a frequency (in the present embodiment, the number of days) of the standard radio signal could not be continuously received, and the like.

Here, the antenna 1143 and the reception circuit 1153 constitute the reception means receiving, by radio, the standard radio signal including the time code, the motor 1093 constitutes the 1st motor, and the motor 1053 constitutes the 2nd motor. The crown 1123 and the operation button 1133 constitute the operation means. The non-reception day number memory 1163 constitutes a storage means. Further, the control circuit 1033 constitutes the clock means clocking the present time instant by counting the time signal, the time instant correction means correcting the present time instant being clocked to the time instant corresponding to the time code, a judgment means judging a reception success or failure (e.g., whether or not the standard radio signal could be normally received, whether or not the standard radio signal could be normally received in the last time, how many times it could not be continuously, normally received till the last time, or whether or not there exists even one time the fact that the standard radio signal was normally received till now) of the standard radio signal by the antenna 1143 and the reception circuit 1153, and the control means.

Figure 18:
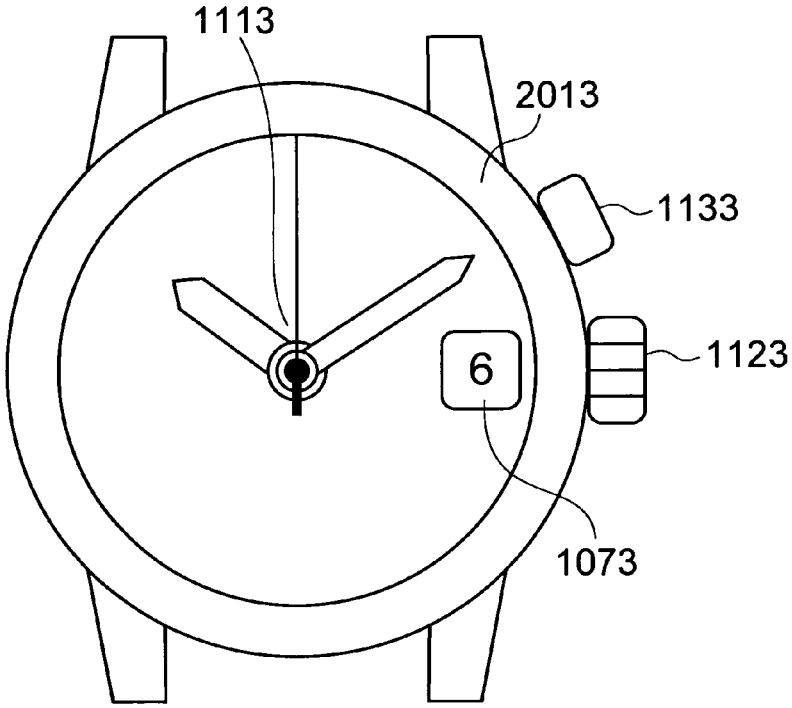
FIG. 18 is an external appearance view of the analog radio-controlled timepiece concerned with the fifth embodiment of the present invention.

FIG. 18 is a view showing an external appearance of the analog radio-controlled timepiece concerned with the embodiment of the present invention, and the same reference numeral is applied to the same portion as FIG. 17. 2013 is a case of the analog radio-controlled timepiece. Incidentally, in FIG. 18, similarly to FIG. 17, there is shown the state in which the date indicator 1073 displays the 6th day.

Figure 19:
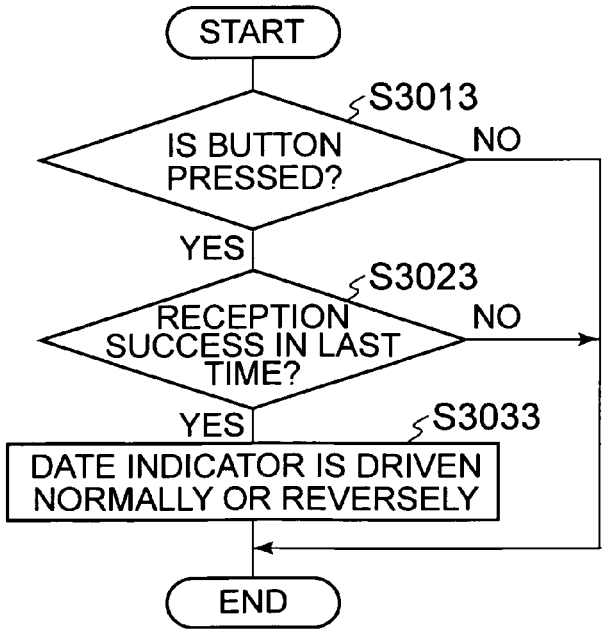
FIG. 19 is a flowchart showing processing in the analog radio-controlled timepiece concerned with the fifth embodiment of the present invention.

FIG. 19 is a flowchart showing processing in a reception success or failure display mode in the embodiment of the present invention, and mainly shows processing in the control circuit 1033.

FIG. 20 is an explanatory view showing operations in the embodiment of the present invention, and shows a motion of the date indicator 1073 when displaying the reception success or failure of the standard radio signal.

Hereunder, by using FIG. 17-FIG. 20, there are explained the operations in the analog radio-controlled timepiece concerned with the present embodiment.

In the analog radio-controlled timepiece, in the ordinary mode performing the date and time display by performing the clock operation based on the timepiece signal from the frequency dividing circuit 1023, the control circuit 1033 performs the clock operation by counting the timepiece signal from the frequency dividing circuit 1023 (At this time, the control circuit 1033 functions as the clock means.), and outputs control signals (the control signal for the date indicator, for rotation-controlling the date indicator 1073, and the control signal for the time instant hands, for rotation-driving the time instant hands 1113), which correspond to the clocked time instant, to each of the motor driver circuits 1043 and 1083 (At this time, the control circuit 1033 functions as the control means.).

The motor driver circuit 1083 rotation-drives the motor 1093 by the motor drive signal for the time instant hands, which corresponds to the control signal for the time instant hands. The motor 1093 rotation-drives time instant hands 1113 through the train wheel 1103, thereby performing the analog display of the present time instant by the time instant hands 1113.

Further, if the clocked time instant becomes the predetermined time instant before the predetermined time from 12 o'clock in the afternoon, the control circuit 1033 outputs the control signal for the date indicator to the motor driver circuit 1043. The motor driver circuit 1043 rotation-drives the motor 1053 by the motor drive signal for the date indicator, which corresponds to the control signal for the date indicator. The motor 1053 rotation-drives the date indicator 1073 through the train wheel 1063, thereby altering the date to the date of the next day during the predetermined time.

In the time instant correction mode performing the time instant correction by receiving the time code included in the standard radio signal, when the predetermined time instant for automatically performing the time instant correction arrived or when the predetermined operation by the operation button 1133 was performed, the control circuit 1033 causes the reception circuit 1153 to perform the reception operation of the standard radio signal by making ON the electric source of the reception circuit 1153. The reception circuit 1153 outputs the time code included in the standard radio signal received by the antenna 1143 to the control circuit 1033.

At this time, in the case where the time instant hands 1113 (especially, the second hand) are rotation-driven in order to continue to display the time instant being clocked during the reception of the standard radio signal, the control circuit 1033 controls the motor 1093 so as to rotation-drive the time instant hands 1113 between (an interstice between pulse signals) the pulse signal and the pulse signal, which constitute the time code included in the standard radio signal. By this, drives of the time instant hands are performed. At this time, even in the case where the noise is generated by the drive of the motor 1093, it is possible to prevent the false detection of the time code, which owes to the noise.

In a case where the standard radio signal was able to normally received, the control circuit 1033 corrects the own clocked time instant to the accurate present time instant corresponding to the time code (At this time, the control circuit 1033 functions as the time instant correction means.), and outputs the control signal corresponding to the accurate present time instant to the motor driver circuit 1083. The motor driver circuit 1083 rotation-drives the motor 1093 by the drive signal corresponding to the control signal, and the motor 1093 rotation-drives the time instant hands 1113 through the train wheel 1103, thereby performing the analog display of the above accurate present time instant corresponding to the time code. Further, the control circuit 1033 makes a non-reception day number (day number in which the standard radio signal could not be continuously received) stored in the non-reception day number memory 1163 into 0.

On the other hand, in a case where the standard radio signal could not be normally received, when it could not be normally received subsequent to the last time, the control circuit 1033 adds 1 to the non-reception day number (day number in which the standard radio signal could not be continuously received) stored in the non-reception day number memory 1163, thereby storing it. Further, in a case where the standard radio signal could not be normally received even one time till now, data denoting to that effect is previously stored in the non-reception day number memory 1163.

Incidentally, in the case where the time instant is corrected by the manual operation, the time instant setting of the time instant hands 1113 is performed by rotation-driving the train wheel 1103 by manually operating a crown 1123, and a time instant information corrected by the crown 1123 is inputted to the control circuit 1033. By this the clocked time instant of the control circuit 1033 is coincided with a displayed time by the time instant hands 1113.

Next, there is explained about operations in a case (reception success or failure display mode) where the reception success or failure of the standard radio signal is displayed.

In FIG. 19, the control circuit 1033' judges whether or not the operation button 1133 was press-operated (step S3013). In a case where it was judged that in the processing step S3013 the operation button 1133 was press-operated, the control circuit 1033 judges that there was switched to the reception success or failure display mode, and judges whether or not the reception circuit succeeded in the reception of the standard radio signal in the last time by referring to the non-reception day number memory 1163.

In the non-reception day number memory 1163, since the day number in which the standard radio signal could not be continuously received is stored, it follows that the day number stored in the non-reception day number memory 1163 is 0 in the case where there was able to be normally received in the last time, and the day number in which it could not be continuously received is stored in the non-reception day number memory 1163 in the case where there could not be normally received in the last time.

In a case where a stored content of the non-reception day number memory 1163 is 0 in a processing step S3023, the control circuit 1033 judges that there was able to be normally received in the last time (reception success in the last time), and outputs the control signal for the date indicator to the motor driver circuit 1043 so as to reciprocate the date indicator 1073 in a normal or reverse direction by a predetermined quantity at a time as shown in FIG. 20 (step S3033). Here, the processing step S3023 in the control circuit 1033 constitutes a judgment means judging the reception success or failure of the standard radio signal, and the processing step S3033 constitutes the control means.

Figure 20A:
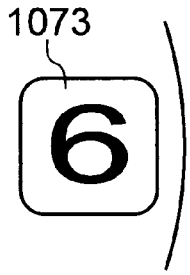
FIGS. 20A to 20C are explanatory views for explaining an operation in the analog radio-controlled timepiece concerned with the fifth embodiment of the present invention.
Figure 20B:
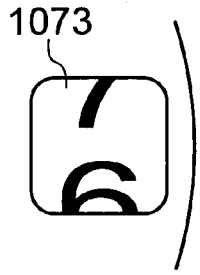
Figure 20C:
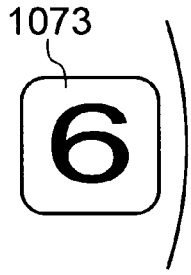

By this, the motor driver circuit 1043 reciprocation-rotation-drives the date indicator 1073 through the motor 1053 and the train wheel 1063 in the normal or reverse direction by the predetermined quantity at a time, and rotation-controls the date indicator 1073 so as to be returned to an original date display by being reversely rotated by the predetermined quantity as shown in FIG. 20C after being normally rotated by the predetermined quantity as shown in FIG. 20B from a date display state of FIG. 20A.

On the other hand, in a case where the day number stored in the non-reception day number memory 1163 is not 0 in the processing step S3023, the control circuit 1033 judges that there could not be normally received in the last time, thereby ending the processing without driving the date indicator 1073.

Accordingly, by operating the operation button 1133, the user can know whether or not there could be normally received in the last time, in dependence on whether or not the date indicator 1073 performed a predetermined operation (normal or reverse rotation operation in the present embodiment).

Further, also in the above reception success or failure display mode, since the control circuit 1033 controls the motor 1093 such that the time instant hands 1113 display the time instant, the present time instant display by the time instant hands 1113 and a reception success or failure display by the date indicator 1073 are simultaneously performed.

Figure 21:
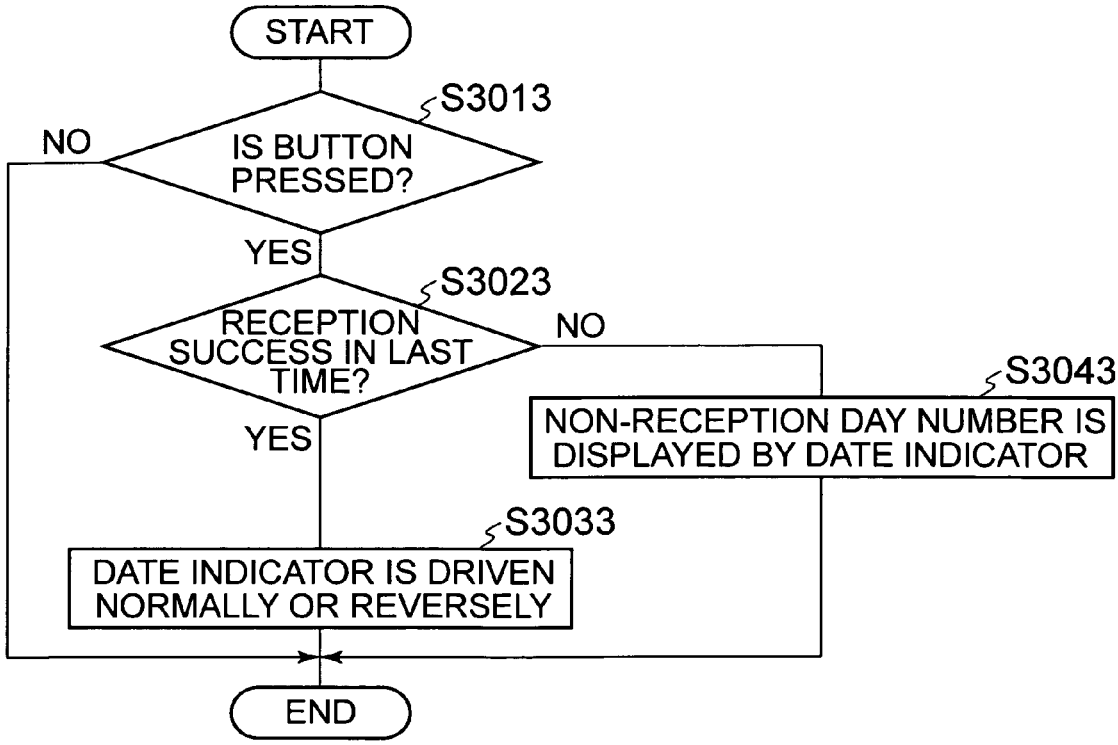
FIG. 21 is a flowchart showing processing in the analog radio-controlled timepiece concerned with the fifth embodiment of the present invention.

FIG. 21 is a flowchart showing other processing in the reception success or failure display mode in the embodiment of the present invention, and shows mainly the processing in the control circuit 1033. Incidentally, the same sign is applied to a portion performing the same processing as FIG. 19, and its explanation is omitted.

In the above-mentioned processing in FIG. 19, although there is made such that, in the case where there could not be normally received in the last time, the processing ends without driving the date indicator 1073, in the processing in FIG. 21, there is constituted such that the non-reception day number, which is the day number in which there could not be continuously, normally received till the last time, is displayed by the date indicator 1073.

That is, in FIG. 21, if there is judged in the processing step S3023 that there could not succeed in the reception in the last time because the day number stored in the non-reception day number memory 1163 is not 0, the control circuit 1033 outputs the control signal for the date indicator to the motor driver circuit 1043 so as to display the non-reception day number stored in the non-reception day number memory 1163 by the date number of the date indicator 1073 (step S3043). Here, the processing step S3043 in the control circuit 1033 constitutes the control means.

By this, the motor driver circuit 1043 rotation-drives the date indicator 1073 through the motor 1053 and the train wheel 1063 such that the date indicator 1073 displays the date letters which is the same as the day number stored in the non-reception day number memory 1163.

Accordingly, by the date letters displayed in the date indicator 1073, the user can know the day number in which there could not be continuously, normally received. Incidentally, since the date letters written in the date indicator 1073 generally used are 1st day-31st day, in a case where the general date indicator 1073 is used, the non-reception day number can be displayed till the 31st day.

Figure 22:
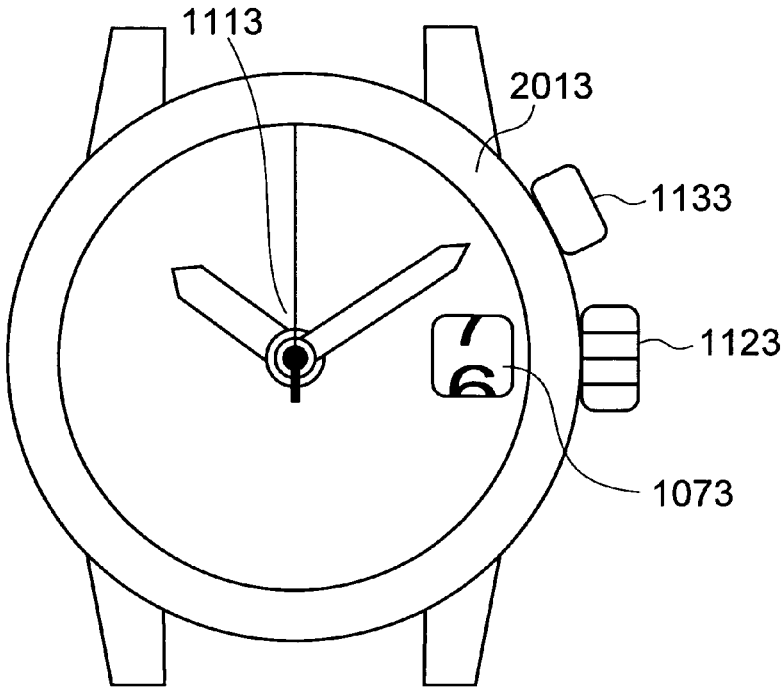
FIG. 22 is an explanatory view for explaining the operation in the analog radio-controlled timepiece concerned with the fifth embodiment of the present invention.

FIG. 22 is a view showing the display of the date indicator 1073 in a case where, in the reception success or failure display mode, the standard radio signal could not be normally received even one-time till now.

If it is judged in the reception success or failure display mode that data denoting to the fact that the standard radio signal could not be normally received even one time till now is stored in the memory 1163, the control circuit 1033 judges that the reception circuit 1153 could not normally receive the standard radio signal even one time till now, and outputs the control signal for the date indicator to the motor driver circuit 1043 such that the date indicator 1073 is stopped for a predetermined time under a state in which there is displayed an interstice between the date letters and the date letters.

The motor driver circuit 1043 rotation-drives the date indicator 1073 through the motor 1053 and the train wheel 1063 such that the date indicator 1073 is stopped for the predetermined time under the state in which there is displayed the interstice between the date letters and the date letters, and there is performed a display like FIG. 22. By this, the user can know the fact that the standard radio signal could not be normally received even one time till now.

As mentioned above, according to the analog radio-controlled timepiece concerned with the present fifth embodiment, in the reception success or failure display mode displaying the reception success or failure of the received standard radio signal, the control circuit 1033 judges the reception success or failure by referring to the non-reception day number memory 1163, and rotation-controls the date indicator 1073 in compliance with the reception success or failure, thereby controlling so as to display the reception success or failure by the date letters of the date indicator 1073 and perform the time instant display by the time instant hands 1113.

Accordingly, it becomes possible to display the reception success or failure of the standard radio signal by the date letters of the date indicator 1073 without adding such a special constitution as to mark the reception success or failure to a case 2013.

Further, it becomes possible to easily know whether or not the standard radio signal was able to be normally received in the last time.

Further, since the non-reception day number is displayed by the date letters of the date indicator, it becomes possible to easily know the day number in which the standard radio signal could not be continuously, normally received.

Further, the user can know the fact that the standard radio signal could not be normally received even one time till now.

Further, also in the reception success or failure display mode, there is brought about such an advantage that it becomes possible to simultaneously display the reception success or failure and the time instant.

Next, there is explained about a sixth embodiment of the present invention. In the above fifth embodiment, although the date letters of the date indicator 1073 is used in order to display the reception success or failure, the present sixth embodiment differs in a point that a reception success or failure display symbol for showing the reception success or failure, which differs from the date letters, is additionally provided in the date indicator 1073.

Figure 23:
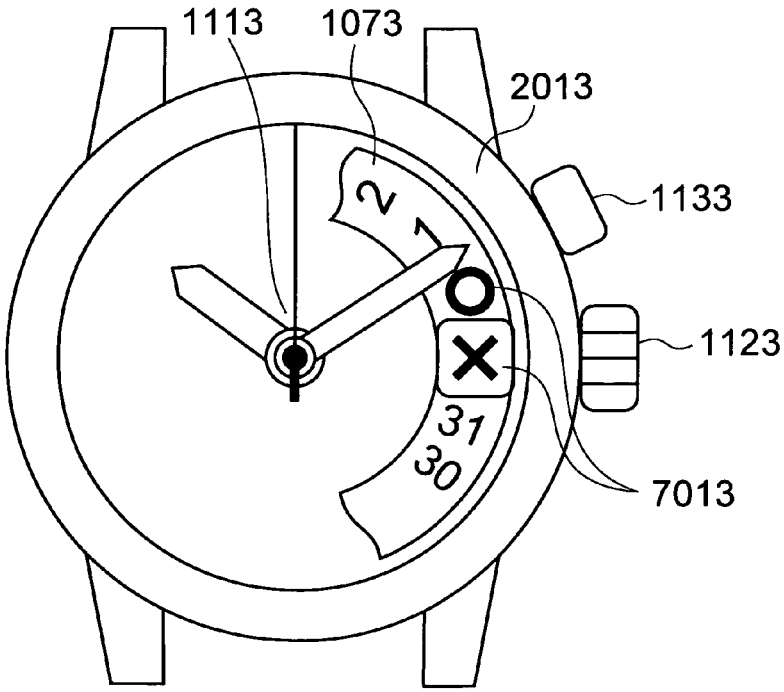
FIG. 23 is an explanatory view for explaining an operation in an analog radio-controlled timepiece concerned with a sixth embodiment of the present invention.

FIG. 23 is a view showing an external appearance of an analog radio-controlled timepiece concerned with the present sixth embodiment, and a view in which one part is broken such that the date indicator 1073 is seen, and the same reference numeral is applied to the same portion as FIG. 18.

In FIG. 23, as reception success or failure display symbols 7013, in the date indicator 1073 there are provided a symbol "0" showing the fact that there was able to be received in the last time, and a symbol "X" showing the fact that there could not be received in the last time. In FIG. 23, there is denoted the fact that the standard radio signal could not be received in the last time.

The present sixth embodiment and the above embodiments differ only in the display symbol when showing whether or not the there could be received in the last time, and other portions such as circuit block diagram and processing flow are similar.

Accordingly, also in the present sixth embodiment, it becomes possible to bring about an advantage similar to the above fifth embodiment by adding such an extremely simple constitution as to additionally write the reception success or failure display symbol 7013 showing the reception success or failure to the date indicator 1073 without adding the special constitution, such as symbol denoting the reception success or failure, to the case 2013.

Incidentally, in the fifth and sixth embodiments, in order that the day number in which the standard radio signal could not be continuously, normally received is understood, the control circuit 1033 constitutes so as to display the day number as a frequency in which the standard radio signal could not be continuously, normally received.

However, since it is general that the reception operation of the standard radio signal is performed by plural times in one day, there may be constituted so as to display an actual frequency in which there could not be continuously, normally received as the frequency in which the standard radio signal could not be continuously, normally received. In this case, there is constituted such that, in an inside of the control circuit 1033, there is provided a storage means storing the actual frequency in which the standard radio signal could not be continuously, normally received.

Further, in the fifth and sixth embodiments, although there is constituted such that, by providing the crown 1123 and the operation button 1133 as the operation means, and by shifting to the reception success or failure display mode by the operation button 1133, there may be constituted such that, by providing only one of the crown 1123 or the operation button 1133 as the operation means, and shifting to the reception success or failure display mode by an operation of the operation means concerned.

Figure 24:
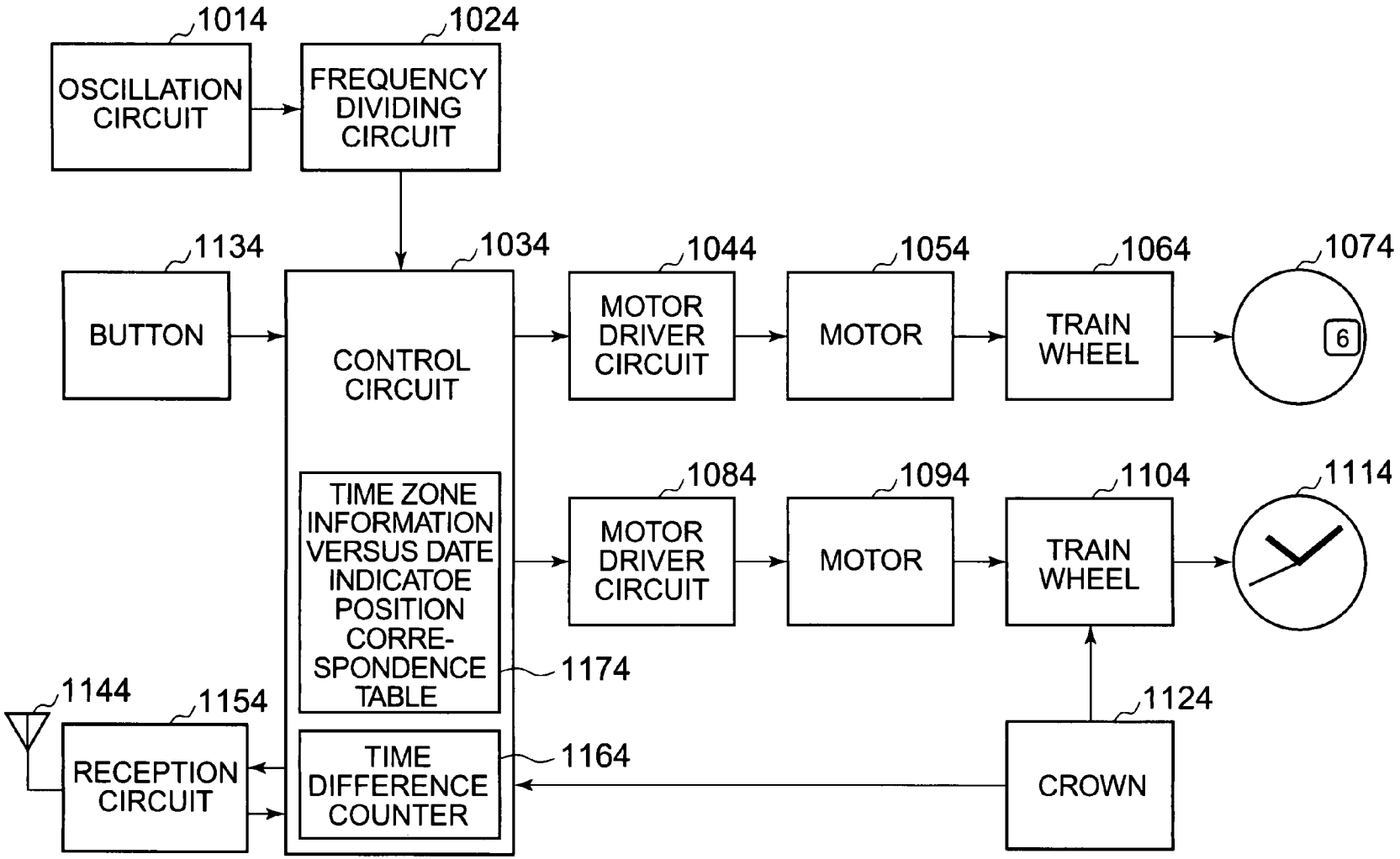
FIG. 24 is a block diagram of an analog radio-controlled timepiece concerned with a seventh embodiment of the present invention.

FIG. 24 is a block diagram of an analog radio-controlled timepiece concerned with a seventh embodiment of the present invention, and shows the example of the wristwatch type analog radio-controlled timepiece.

In FIG. 24, the analog radio-controlled timepiece possesses an oscillation circuit 1014 outputting the signal of the predetermined frequency, a frequency dividing circuit 1024 frequency-dividing the signal from the oscillation circuit 1014 to thereby output the time signal becoming the reference of the clock operation, a control circuit 1034 performing the clock operation based on the time signal to thereby perform the output processing of the control signal for the time instant display and the control processing of each constituent element of the analog radio-controlled timepiece or the later-mentioned processing and the like, a motor driver circuit 1084 responding to the control signal from the control circuit 1034 to thereby output the motor drive signal for time instant hands, a motor 1094 rotation-driven by the motor drive signal for time instant hands, a train wheel 1104 transmitting the rotation of the motor 1094, and time instant hands (the hour hand, the minute hand, and the second hand) 1114 rotation-driven by the train wheel 1104.

Further, the analog radio-controlled timepiece possesses a motor driver circuit 1044 responding to the control signal from the control circuit 1034 to thereby output the motor drive signal for the date indicator, a motor 1054 rotation-driven by the motor drive signal for the date indicator, a train wheel 1064 transmitting the rotation of the motor 1054, and a date indicator 1074 rotation-driven by the train wheel 1064. Incidentally, in FIG. 24, there is shown the state in which the date indicator 1074 displays the 6th day.

Further, the analog radio-controlled timepiece possesses an antenna 1144 receiving, by radio, the standard radio signal including the time code, a reception circuit 1154 outputting the time code included in the standard radio signal received by the antenna 1144, a crown 1124 driving the train wheel 1104 by the predetermined manual operation to thereby perform the time instant setting of the time instant hands 1114 and inputting the operation signal complying with the manual operation to the control circuit 1034, and an operation button 1134 capable of being manually operated.

The control circuit 1034 has a time difference counter 1164 counting and storing, in compliance with operations of the operation button 1134 and the crown 1124, a time difference between a time instant (e.g., Greenwich Mean Time) that the standard radio signal received by the antenna 1114 denotes and a local time instant in a region in which the present analog radio-controlled timepiece is used. Further, the control circuit 1034 has in its inside a storage means and, in the storage means, there is stored a time zone information versus date indicator position correspondence table 1174 which is a table in which a time zone information and a rotation position of the date indicator 1074 are corresponded.

Although details are mentioned later, the time zone information is an information denoting at least one of a region information denoting a region (including a country) and a time difference information denoting the time difference in the above region in which a predetermined reference time instant (e.g., Greenwich Mean Time) is made a reference. In the time zone information versus date indicator position correspondence table 1174, there are stored about plural regions under a state in which the above region information (Eastern region, Central region, Mountain region and Pacific region), the time difference information and the rotation position of the date indicator 1074 are corresponded.

In the date indicator 1074, date letters denoting dates from 1st day to 31st day are provided by the imprinting or the like.

Here, the antenna 1144 and the reception circuit 1154 constitute the reception means receiving, by radio, the standard radio signal including the time code, the motor 1094 constitutes the 1st motor, the motor 1054 constitutes the 2nd motor, and the time difference counter 1164 constitutes a time zone information storage means. The crown 1124 and the operation button 1134 constitute the operation means. Further, the control circuit 1034 constitutes the clock means clocking the present time instant by counting the time signal, a time instant correction means correcting the present time instant being clocked, by considering the time difference on the basis of the received time code, and the control means.

Figure 25:
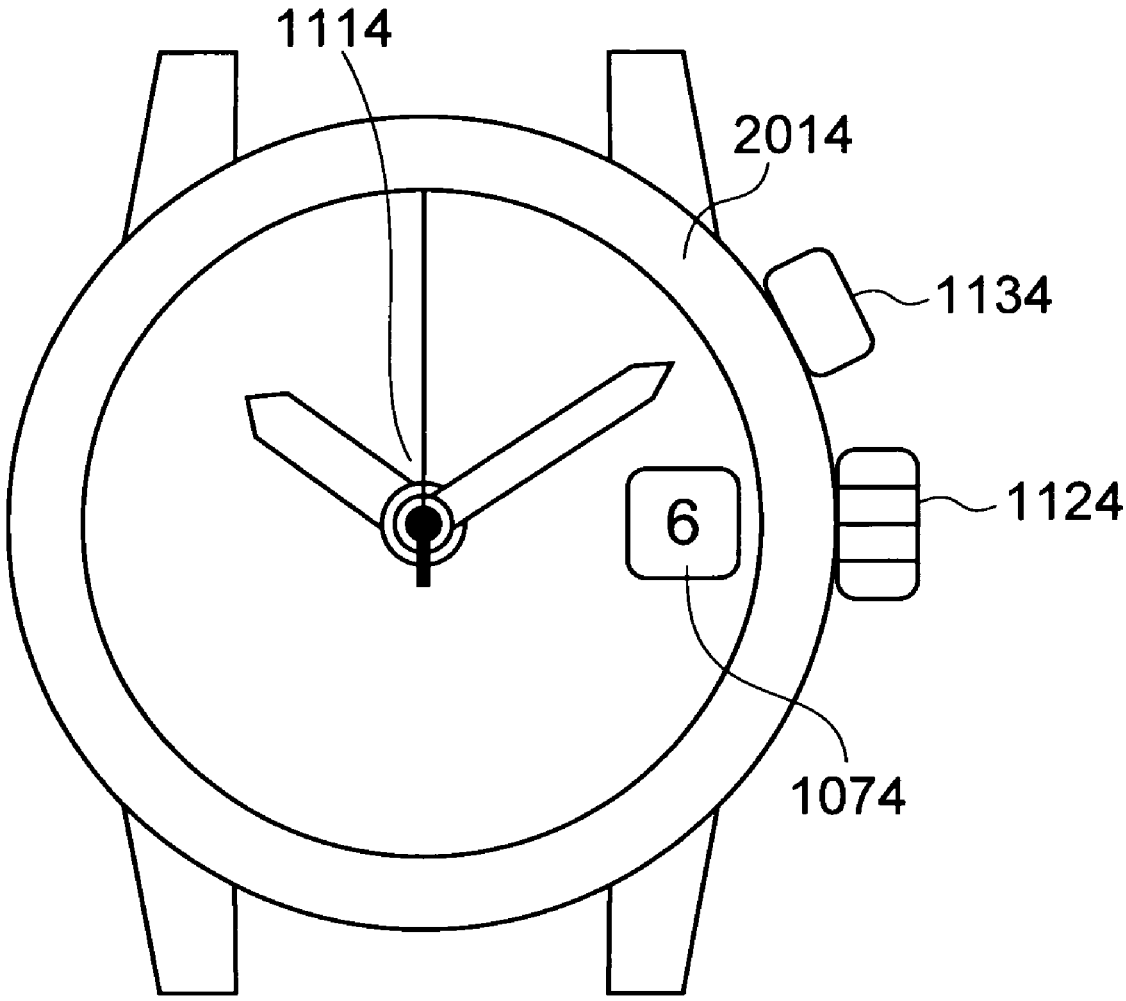
FIG. 25 is an external appearance view of the analog radio-controlled timepiece concerned with the seventh embodiment of the present invention.

FIG. 25 is a view showing the external-appearance of the analog radio-controlled timepiece concerned with the embodiment of the present invention, and the same reference numeral is applied to the same portion as FIG. 24. Incidentally, 2014 is a case of the analog radio-controlled timepiece.

FIG. 26 is a view showing a content of the time zone information versus date indicator position correspondence table 1174 stored in the control circuit 1034, and shows an example of the time zone information versus date indicator position correspondence table used in the USA. As mentioned before, in the USA, there is transmitted the standard radio signal including the GMT (Greenwich Mean Time) as the time code, and the whole land of the USA is divided into four time zones (Eastern region, Central region, Mountain region and Pacific region).

As shown in FIG. 26, as to the Eastern Standard Time (EST) in the Eastern region, the time difference from the GMT is −5 hours, and the local time instant in the Eastern region becomes (GMT−5 hours). Similarly, as to the Central Standard Time (CST) in the Central region, since the time difference from the GMT is −6 hours, the local time instant in the Central region becomes (GMT−6 hours); as to the Mountain Standard Time (MST) in the Mountain region, since the time difference from the GMT is −7 hours, the local time instant in the Mountain region becomes (GMT−7 hours); and as to the Pacific Standard Time (PST) in the Pacific region, since the time difference from the GMT is −8 hours, the local time instant in the Pacific region becomes (GMT−8 hours).

The time zone information versus date indicator position correspondence table 1174 becomes a table in which there are corresponded the region information (Eastern region, Central region, Mountain region and Pacific region) in the USA, which is a time zone information, a time difference information from a predetermined reference time instant (the GMT in the present embodiment), which is the time zone information, and the rotation position of the date indicator 1074.

Further, in the example of FIG. 26, the rotation position of the date indicator 1074 is corresponded so as to display the date letters (i.e., date letters denoting an absolute value of the time difference) corresponding to the time difference.

Figure 27:
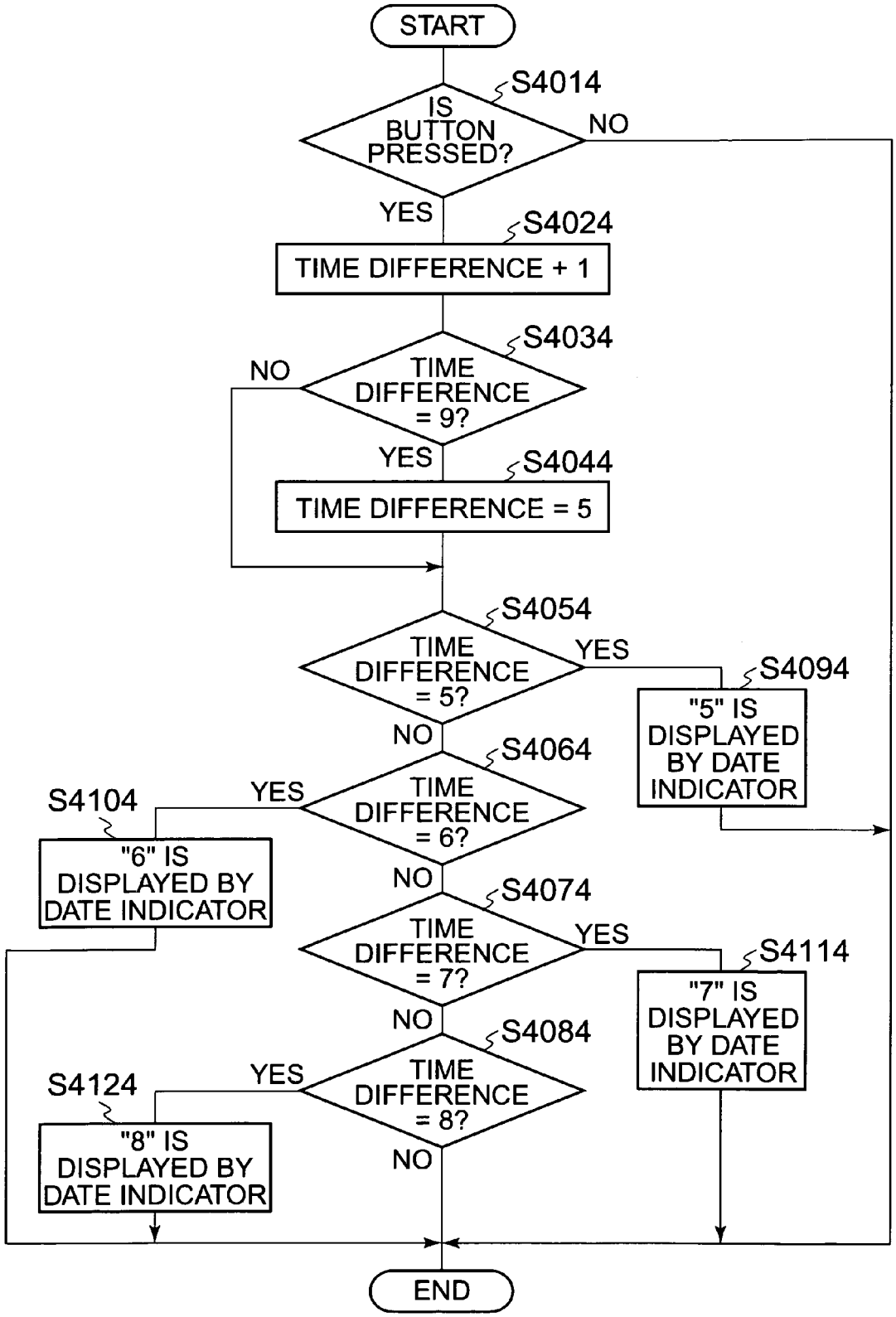
FIG. 27 is a flowchart showing processing in the analog radio-controlled timepiece concerned with the seventh embodiment of the present invention.
Figure 28:
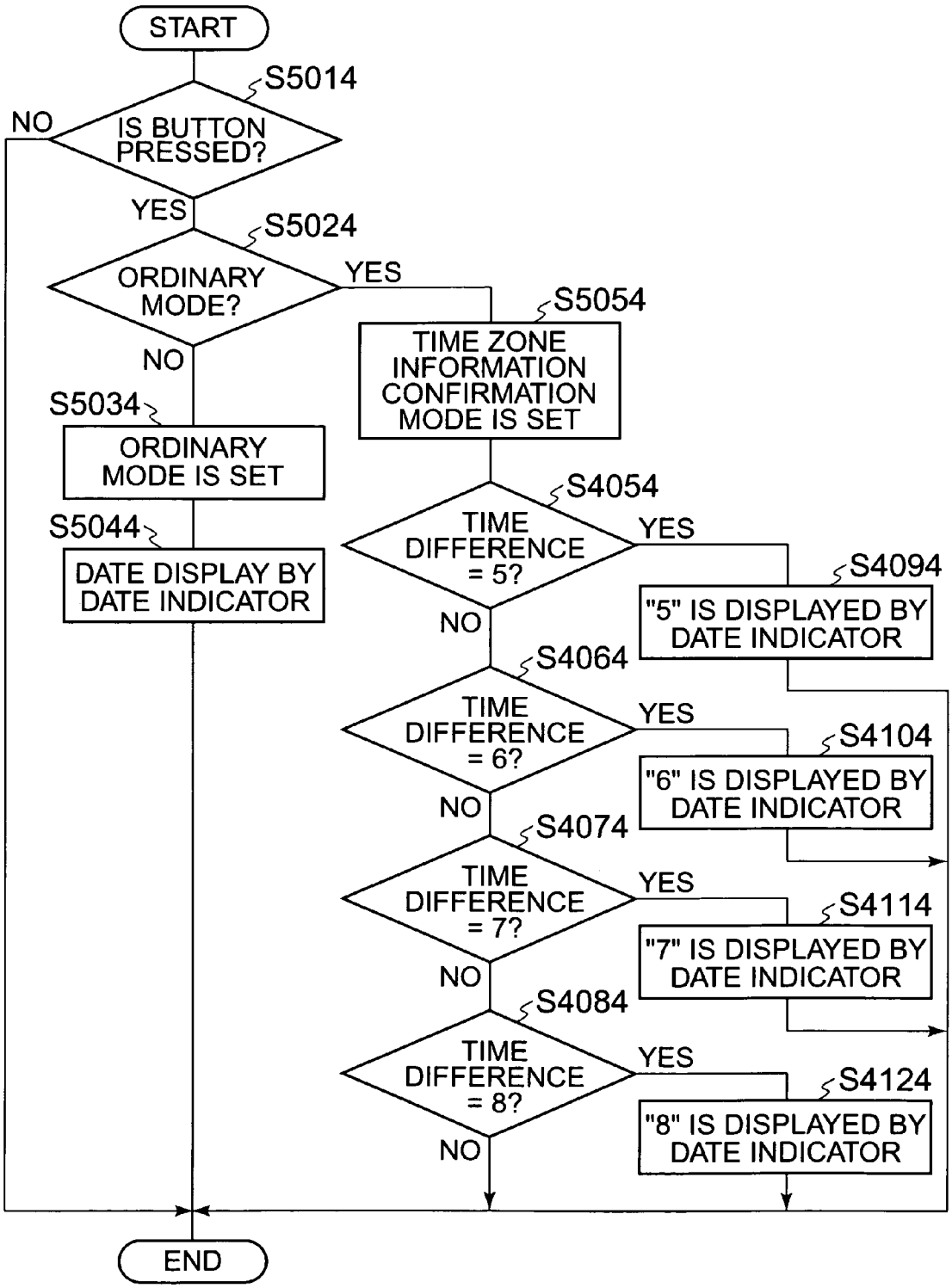
FIG. 28 is a flowchart showing processing in the analog radio-controlled timepiece concerned with the seventh embodiment of the present invention.
Figure 29:
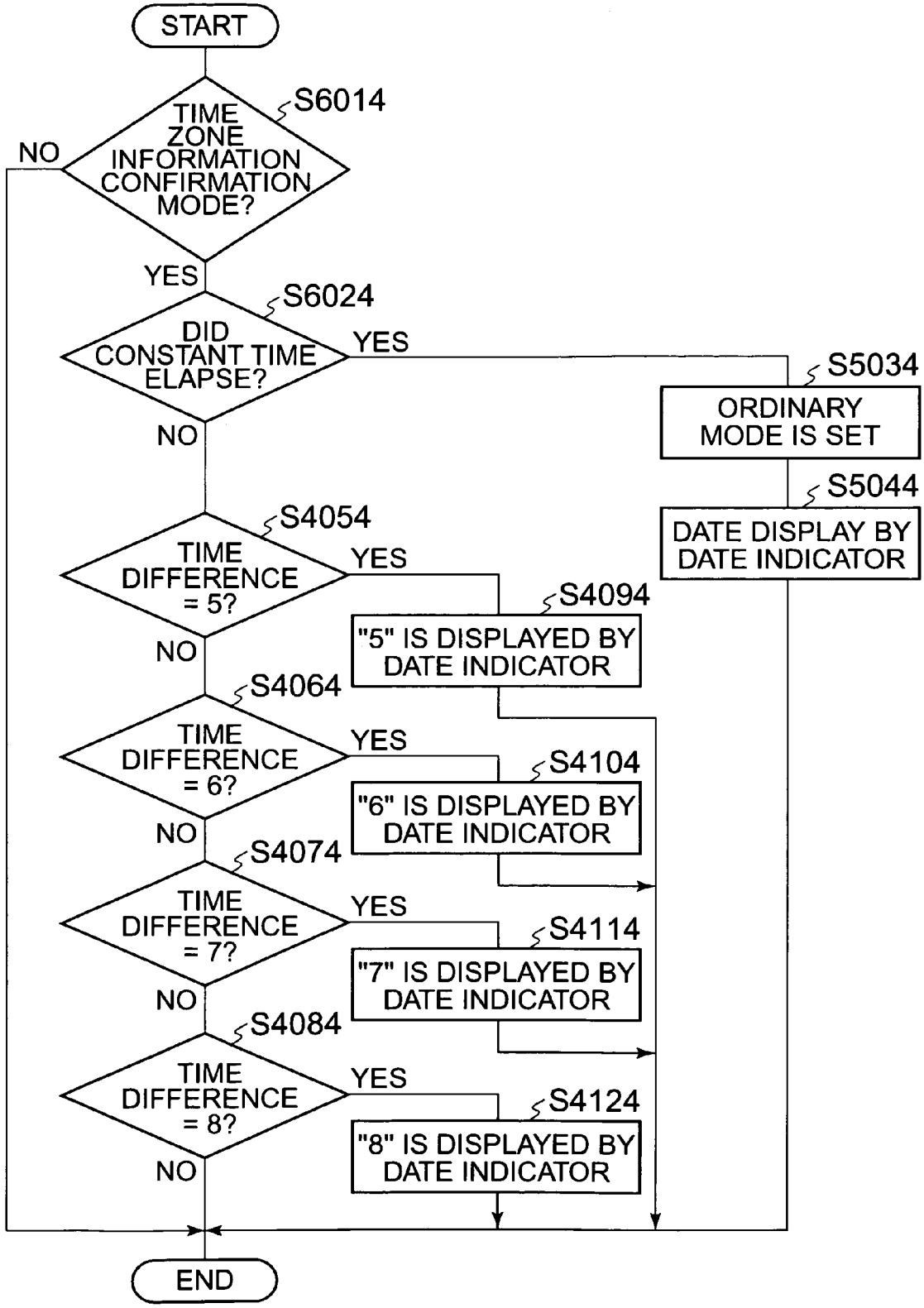
FIG. 29 is a flowchart showing processing in the analog radio-controlled timepiece concerned with the seventh embodiment of the present invention.

FIG. 27-FIG. 29 are flowcharts showing the processing in the embodiment of the present invention, and show mainly the processing in a case where the control circuit 1034 functions as the control means.

Hereunder, by using FIG. 24-FIG. 29, there are explained the operations in the analog radio-controlled timepiece concerned with the present embodiment.

In the analog radio-controlled timepiece, in the ordinary mode performing the date and time display by performing the clock operation based on the timepiece signal from the frequency dividing circuit 1024, the control circuit 1034 performs the clock operation by counting the timepiece signal from the frequency dividing circuit 1024 (At this time, the control circuit 1034 functions as the clock means.), and outputs control signals (the control signal for the date indicator, for rotation-controlling the date indicator, and the control signal for the time instant hands, for rotation-controlling the time instant hands), which correspond to the clocked time instant, to each of the motor driver circuits 1044 and 1084 (At this time, the control circuit 1034 functions as the control means.).

The motor driver circuit 1084 rotation-drives the motor 1094 by the motor drive signal for the time instant hands, which corresponds to the control signal for the time instant hands. The motor 1094 rotation-drive's the time instant hands 1114 through the train wheel 1104, thereby performing the analog display of the present time instant by the time instant hands 1114.

Further, if the clocked time instant becomes the predetermined time instant before the predetermined time from 12 o'clock in the afternoon, the control circuit 1034 outputs the control signal for the date indicator to the motor driver circuit 1044. The motor driver circuit 1044 rotation-drives the motor 1054 by the motor drive signal for the date indicator, which corresponds to the control signal for the date indicator. The motor 1054 rotation-drives the date indicator 1074 through the train wheel 1064, thereby altering the date to the date of the next day during the predetermined time.

In the time instant correction mode performing the time instant correction by receiving the time code included in the standard radio signal, when the predetermined time instant for automatically performing the time instant correction arrived or when the predetermined operation by the operation button 1134 was performed, the control circuit 1034 causes the reception circuit 1154 to perform the reception operation of the standard radio signal by making ON the electric source of the reception circuit 1154. The reception circuit 1154 outputs the time code included in the standard radio signal received by the antenna 1144 to the control circuit 1034.

At this time, although the control circuit 1034 rotation-drives the time instant hands 1114 (especially, the second hand) in order to continue to display the time instant that itself is clocking during the reception of the standard radio signal, in the case where the time instant hands 1114 is rotation-driven, it controls the motor 1094 so as to rotation-drive the time instant hands 1114 between (interstice between pulse signals) the pulse signal and the pulse signal, which constitute the time code included in the standard radio signal. By this, although drives of the time instant hands 1114 are performed, at this time, even in the case where the noise is generated by the drive of the motor 1094, it is possible to prevent the false detection of the time code, which owes to the noise.

In the case where the standard radio signal was able to be normally received, the control circuit 1034 corrects, on the basis of the time code received by the reception circuit 1154, the time instant that itself is clocking by considering the time zone information (The time zone information used in the time instant correction is a time difference information.) stored in the time difference counter 1164.

For example, in a case where the analog radio-controlled timepiece is used in the Eastern region of the USA, the time difference information stored in the time difference counter 1164 in such a manner as mentioned later is −5 hours with the GMT being made the reference. If the reception circuit 1154 receives as the standard radio signal and the control circuit 1034 receives the time code of a GMT time instant included in the standard radio-signal from the reception circuit 1154, an Eastern standard time instant is calculated by subtracting the above time difference (5 hours) from the GMT, and own clocked time instant is corrected to an accurate Eastern standard time instant (local time instant) (At this time, the control circuit 1034 functions as the time instant correction means), and a control signal corresponding to the above accurate local time instant is outputted to the motor driver circuit 1084.

The motor driver circuit 1084 rotation-drives the motor 1094 by a drive signal corresponding to the above control signal, thereby analog-displaying an accurate local present time instant on the basis of the time code by considering the time zone information stored in the time difference counter 1164.

Incidentally, in a case where the time instant is corrected by the manual operation, the time instant setting of the time instant hands 1114 is performed by rotation-driving the train wheel 1104 by manually operating the crown 1124, and the time instant information corrected by the crown 1124 is inputted to the control circuit 1034. By this, the clocked time instant in the control circuit 1034 is coincided with the displayed time instant by the time instant hands 1114.

Next, along FIG. 27, there are explained operations when the time zone information is displayed in a time zone information confirmation mode for displaying the time zone information such as the region in which the analog radio-controlled time piece is placed or the time difference from the predetermined reference time instant.

In the time zone information confirmation mode of FIG. 27, if it is judged that the operation button 1134 was predetermination-operated (step S4014), the control circuit 1034 judged, after adding 1 to a counted value stored in the time difference counter 1164 (i.e., 1 hour is added to the time difference from the GMT time instant, which is stored in the time difference counter 1164) (step S4024), whether or not the time difference from the GMT became 9 hours (step S4034) and, in a case where it was judged that the time difference from the GMT became 9 hours, the above time difference is altered to 5 hours (i.e., the counted value of the time difference counter 1164 is made 5) (step S4044), and there is shifted to a processing step S4054.

In a case where it was judged in the processing step 4034 that the time difference from the GMT did not become 9 hours, the control circuit 1034 shifts the processing to the processing step S4054.

In a case where it was judged in the processing step 4054 that the time difference from the GMT was 5 hours, the control circuit 1034 outputs the control signal for the date indicator to the motor driver circuit 1044 such that the date indicator 1074 displays the date letters. "5", by referring to the time zone information versus date indicator position correspondence table 1174 (step S4094).

By this, the motor driver circuit 1044 rotation-drives the date indicator 1074 through the motor 1054 and the train wheel 1064, thereby displaying the date letters "5" by the date indicator 1074. By the date letters of the date indicator 1074, the user can know the facts that the region in which the analog radio-controlled timepiece is placed at present is the Eastern region, the time instant being displayed by the time instant hands 1114 is the Eastern Standard Time, and further the time difference from the GMT is 5 hours.

In a case where it was judged in the processing step S4054 that the time difference from the GMT was not 5 hours, the control circuit 1034 judges whether or not the time difference from the GMT is 6 hours (step S4064) and, in a case where it was judged that the time difference was 6 hours, outputs the control signal for the date indicator to the motor driver circuit 1044 such that the date indicator 1074 displays the date letters "6", by referring to the time zone information versus date indicator position correspondence table 1174 (step S4104).

By this, the motor driver circuit 1044 rotation-drives the date indicator 1074 through the motor 1054 and the train wheel 1064, thereby displaying the date letters "6" by the date indicator 1074 as shown in FIG. 25. By the date letters of the date indicator 1074, the user can know the facts that the region in which the analog radio-controlled timepiece is placed at present is the Central region, the time instant being displayed by the time instant hands 1114 is the Central Standard Time, and further the time difference from the GMT is 6 hours.

In FIG. 25, there is shown the example in which "6" is displayed by the date letters by doing like the above. In FIG. 25, although directly the time difference is displayed as the time zone information, indirectly it follows that the region information corresponding to the time difference is displayed and, as a result, it follows that the time instant information is being displayed by the date indicator 1074.

Incidentally, although the date letters of the date indicator 1074 is "6" in the case of the Central Standard Time, there are displayed "5" in the case of the Eastern Standard Time, "7" in the case of the Mountain Standard Time, which is mentioned later, and "8" in the case of the Pacific Standard Time.

In a case where it was judged in the processing step S4064 that the time difference from the GMT was not 6 hours, the control circuit 1034 judges whether or not the time difference from the GMT is 7 hours (step S4074) and, in a case where it was judged that the time difference was 7 hours, outputs the control signal for the date indicator to the motor driver circuit 1044 such that the date indicator 1074 displays the date letters "7", by referring to the time zone information versus date indicator position correspondence table 1174 (step S4114).

By this, the motor driver circuit 1044 rotation-drives the date indicator 1074 through the motor 1054 and the train wheel 1064, thereby displaying the date letters "7" by the date indicator 1074. By the date letters of the date indicator 1074, the user can know the facts that the region in which the analog radio-controlled timepiece is placed at present is the Mountain region, the time instant being displayed by the time instant hands 1114 is the Mountain Standard Time, and further the time difference from the GMT is 7 hours.

In a case where it was judged in the processing step S4074 that the time difference from the GMT was not 7 hours, the control circuit 1034 judges whether or not the time difference from the GMT is 8 hours (step S4084) and, in a case where it was judged that the time difference was 8 hours, outputs the control signal for the date indicator to the motor driver circuit 1044 such that the date indicator 1074 displays the date letters "8", by referring to the time zone information versus date indicator position correspondence table 1174 (step S4124).

By this, the motor driver circuit 1044 rotation-drives the date indicator 1074 through the motor 1054 and the train wheel 1064, thereby displaying the date letters "8" by the date indicator 1074. By the date letters of the date indicator 1074, the user can know the facts that the region in which the analog radio-controlled timepiece is placed at present is the Pacific region, the time instant being displayed by the time instant hands 1114 is the Pacific Standard Time, and further the time difference from the GMT is 8 hours.

Like the above, according to the present embodiment, since there is constituted such that, in the time zone information confirmation mode, the date letters corresponding to the time difference in the region, in which the analog radio controlled timepiece is placed, is displayed by the date indicator with the predetermined time instant being made as the reference, it becomes possible to easily know, by the numeral of the date letters, the time zone information such as the region in which the analog radio-controlled timepiece is placed, and the time difference from the predetermined time instant.

Further, even when the time zone information is being displayed, since the control circuit 1034 is driving the time instant hands 1114, it becomes possible to simultaneously display the time zone information and the time instant.

Further, since it is unnecessary to provide, in the case 2014, the symbol etc. denoting the time zone information, a constitution is simple.

Next, along FIG. 28, there are explained operations in a case where a switchover between the ordinary mode and the time zone information confirmation mode is performed by predetermination-operating the operation button 1134. Incidentally, in FIG. 28, the same sign is applied to a portion performing the same processing as FIG. 27.

In FIG. 28, if it is judged that the operation button 1134 was predetermination-operated (step S5014), the control circuit 1034 judges whether or not the processing is the ordinary mode (step S5024) and, in a case where it is not the ordinary mode, sets to the ordinary mode (step S5034), thereby performing the time instant display by the time instant hands 1114 and performing the date display by the date indicator 1074 (step S5044). By this, the analog radio-controlled timepiece performs an ordinary date and time display operation.

In a case where it was judged in the processing step S5024 that the processing was the ordinary mode, the control circuit 1034 performs, after setting to the above time zone information confirmation mode (step S5054), an operation of the above-mentioned time zone information confirmation mode (the steps S4054-S4124).

In this manner, by predetermination-operating the operation button 1134, it becomes possible to operate by switching the ordinary mode performing the date ant time instant display and the time zone information confirmation mode displaying the time zone information such as the time difference and the region.

Incidentally, in the present embodiment, although there is constituted such that the crown 1124 and the operation button 1134 are provided as the operation means, and the ordinary mode and the time zone information confirmation mode are switched by predetermination-operating the operation button 1134, there may be constituted such that only one of the crown 1124 or the operation button 1134 is provided as the operation means, and the ordinary mode and the time zone information confirmation mode are switched by the operation of the operation means concerned and, further, there may be constituted such that both of the crown 1124 and the operation button 1134 are provided as the operation means, and the ordinary mode and the reception station confirmation mode are switched by predetermination-operating both of the crown 1124 and the operation button 1134. These are also similar about the operation in the above-mentioned time zone information confirmation mode.

Next, along FIG. 29, there are explained operations in a case where there is automatically switched from the time zone information confirmation mode to the ordinary mode. Incidentally, in FIG. 29, the same sign is applied to a portion performing the same processing as FIG. 28.

In FIG. 29, the control circuit 1034 judges whether or not the processing is the time zone information confirmation mode (step S6014) and, in a case where it is the time zone information confirmation mode, judges whether or not a constant time elapsed from a predetermined time instant (e.g., time instant at which there became the time zone information confirmation mode) (step S6024).

In a case where there was judged in the processing step S6024 that the constant time did not elapse, the control-circuit 1034 performs the processing in the above-mentioned time zone information confirmation mode (the steps S4054-S4124).

On the other hand, in a case where it was judged in the processing step S6024 that the constant time elapsed, the control circuit 1034 sets to the ordinary mode (step S5034), thereby performing the time instant display by the time instant hands 1114 and performing the date display by the date indicator 1074 (step S5044). By this, the analog radio-controlled timepiece performs the ordinary date and time display operation.

By doing like this, in the time zone information confirmation mode, in a case where, a predetermined time elapsed from the predetermined time instant, it becomes possible to automatically switch from the time zone information confirmation mode to the ordinary mode, so that the user can know the present date and time in the ordinary mode.

As mentioned above, according to the analog radio-controlled timepiece concerned with the present embodiment, the control circuit 1034 corrects, on the basis of the time code received by the reception circuit 1154, the time instant that itself is clocking by considering the time difference stored in the time difference counter 1164, thereby displaying the time instant by the time instant hands 1114 by controlling the motors 1094 and 1054 in compliance with own clocked time instant in the ordinary mode for performing the date and time display, and displaying the date by the date indicator 1074.

Further, in the time zone information confirmation mode displaying the time zone information in the region in which the analog radio-controlled timepiece is placed, there is constituted such that the time zone information is displayed by the date letters of the date indicator 1074, by referring to the time difference information stored in the time difference counter 1164 and the time zone information versus date indicator position correspondence table 1174.

Accordingly, it becomes possible to display the time zone information without adding the special constitution, such as a symbol denoting the time zone information, to the case 2014.

Further, since the time instant hands 1114 (e.g., the second hand) are used exclusively as the time instant display without being used in the display of the time zone information, even during the reception of the standard radio, it becomes possible to simultaneously display the time instant and the time zone information. Further, even during the display of the time zone information, the display of the present time instant becomes possible by the time instant hands 1114.

Further, since there is constituted such that the time difference is displayed by the date letters of the date indicator 1074, there is brought about such an advantage that it becomes possible to easily grasp the time difference from the reference time instant, and the region.

Figure 30:
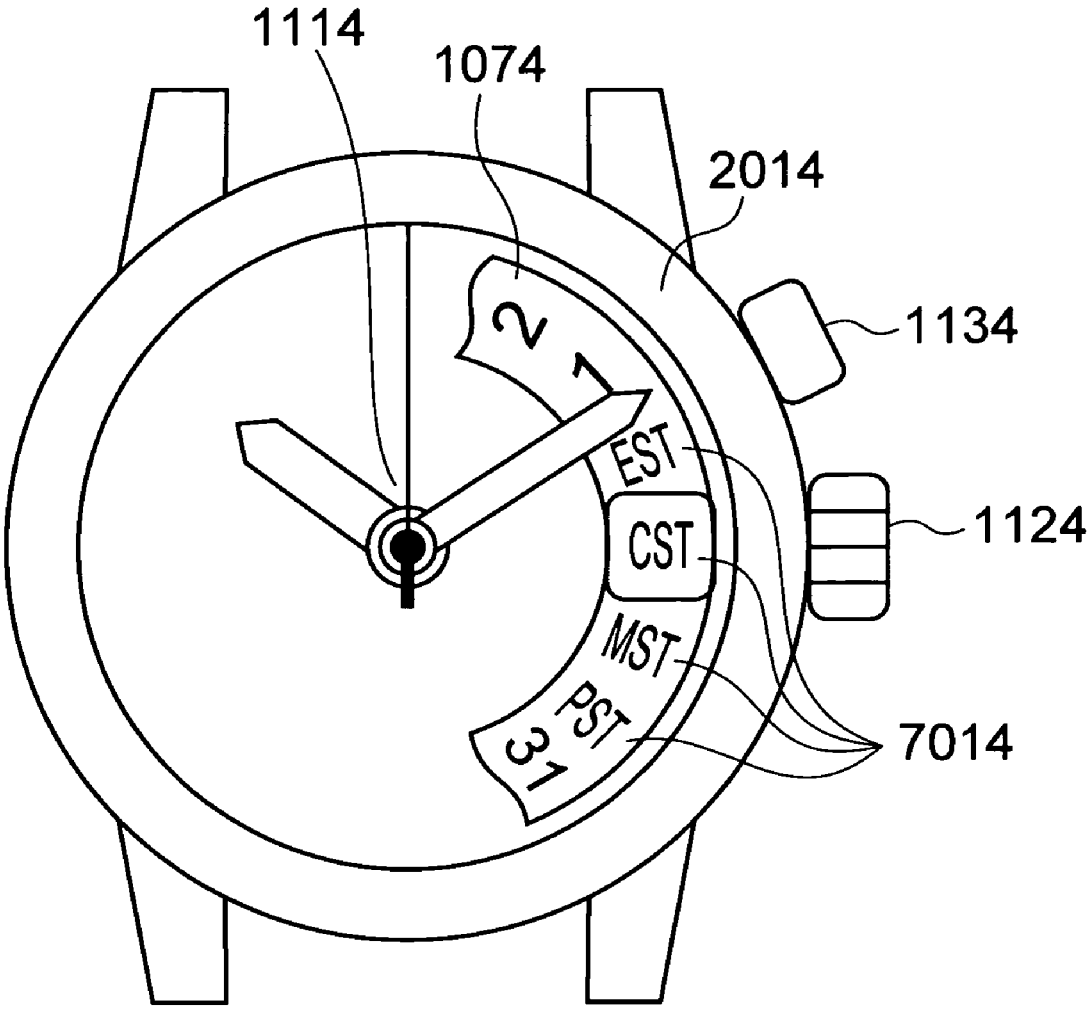
FIG. 30 is an external appearance view of an analog radio-controlled timepiece concerned with an eighth embodiment of the present invention.

Next, there is explained about an eighth embodiment of the present invention. FIG. 30 is an external appearance view in which one part of an analog radio-controlled timepiece concerned with the eighth embodiment of the present invention is broken.

In the above seventh embodiment, although the date letters of the date indicator 1074 is used in order to display the time zone information, in the present eighth embodiment, as shown in FIG. 30, plural region standard time display symbols (EST, CST, MST, PST) 7014 denoting the fact that they are standard times in the various regions, which differ from the date letters, are additionally provided as time zone information display symbols. Incidentally, also in FIG. 30, an example in the USA is enumerated.

FIG. 31 is a view showing a content of time zone information versus date indicator position correspondence table in the present eighth embodiment and, similarly to the above seventh embodiment, there is used while being stored in the control circuit 1034.

In FIG. 31, the time zone information versus date indicator position correspondence table becomes a table in which there are corresponded the region information (Eastern region, Central region, Mountain region, Pacific region) that are time zone information in the USA, a time difference information from the predetermined reference time instant (the GMT in the present embodiment) that is the time zone information, and positions of the region standard time display symbols (EST, CST, MST, PST) 7014 additionally written to the date indicator 1074.

In the present eighth embodiment, although the region standard time display symbol 7014 is directly displayed as the time zone information by rotation-controlling the date indicator 1074, it follows that indirectly there is displayed the time difference information in the region denoted by the region standard time display symbol 7014.

Also in the present eighth embodiment, it becomes possible to bring about an advantage similar to the above seventh embodiment by an addition of such a simple constitution as to additionally write the region standard time display symbol 7014 which is the time zone information display symbol.

Incidentally, in the seventh and eighth embodiments, although the example in the USA is explained, there can be applied to the analog radio-controlled timepiece used in other country or region in such a manner that the display of the time zone information in a specified country or a specified region is performed with Japanese time instant etc. being made as the reference.

Figure 32:
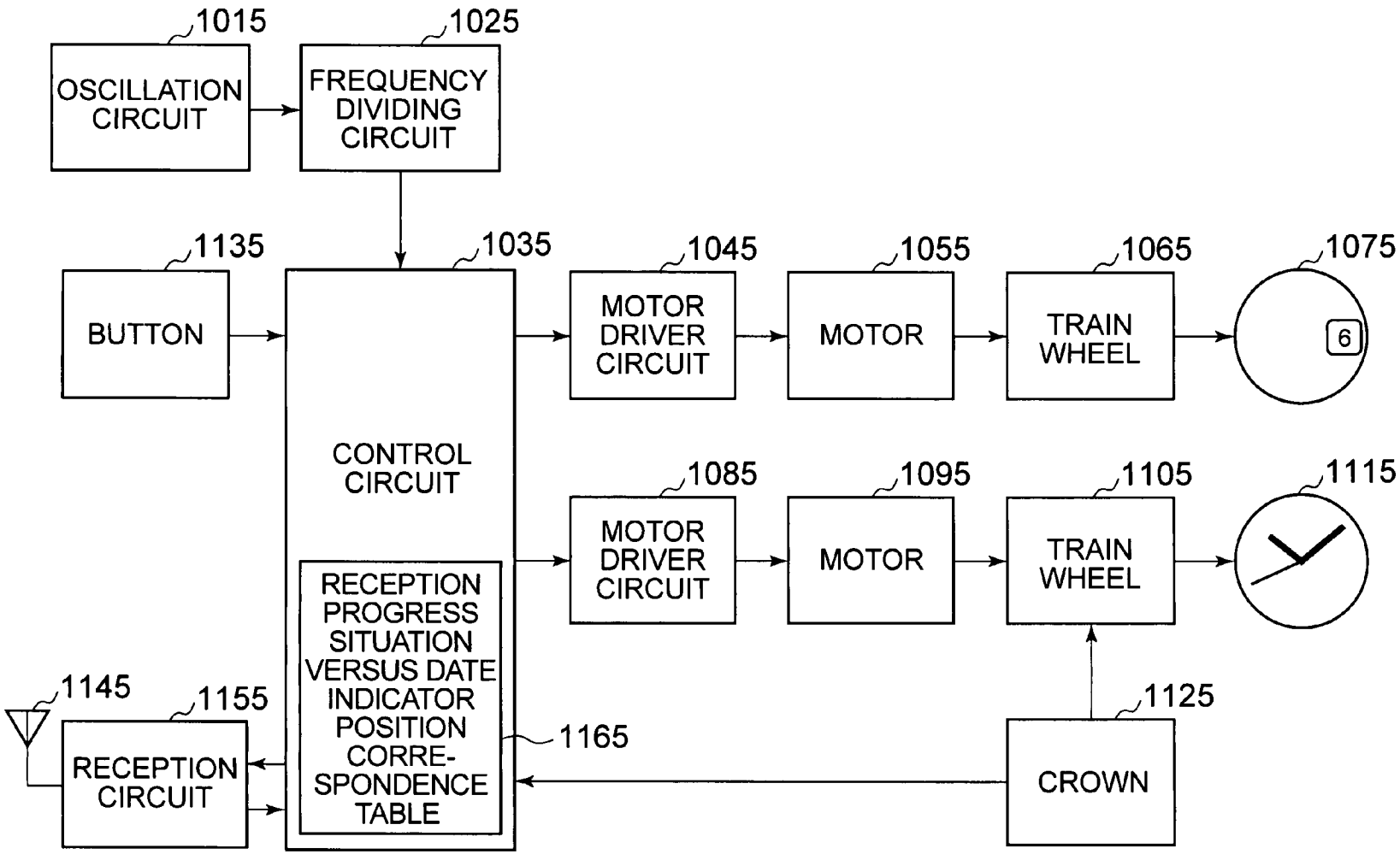
FIG. 32 is a block diagram of an analog radio-controlled timepiece concerned with a ninth embodiment of the present invention.

FIG. 32 is a block diagram of an analog radio-controlled timepiece concerned with a ninth embodiment of the present invention, and shows the example of the wristwatch type analog radio-controlled timepiece.

In FIG. 32, the analog radio-controlled timepiece possesses an oscillation circuit 1015 outputting the signal of the predetermined frequency, a frequency dividing circuit 1025 frequency-dividing the signal from the oscillation circuit 1015 to thereby output the time signal becoming the reference of the clock operation, a control circuit 1035 performing the clock operation based on the time signal to thereby perform the output processing of the control signal for the time instant display and the control processing of each constituent element of the analog radio-controlled timepiece or the later-mentioned processing and the like, a motor driver circuit 1085 responding to the control signal from the control circuit 1035 to thereby output the motor drive signal for time instant hands, a motor 1095 rotation-driven by the motor drive signal for time instant hands, a train wheel 1105 transmitting the rotation of the motor 1095, and time instant hands (the hour hand, the minute hand, and the second hand) 1115 rotation-driven by the train wheel 1105.

Further, the analog radio-controlled timepiece possesses a motor driver circuit 1045 responding to the control signal from the control circuit 1035 to thereby output the motor drive signal for the date indicator, a motor 1055 rotation-driven by the motor drive signal for the date indicator, a train wheel 1065 transmitting the rotation of the motor 1055, and a date indicator 1075 rotation-driven by the train wheel 1065. Incidentally, in FIG. 32, there is shown the state in which the date indicator 1075 displays the 6th day.

Further, the analog radio-controlled timepiece possesses an antenna 1145 receiving, by radio, the standard radio signal including the time code, a reception circuit 1155 outputting the time code included in the standard radio signal received by the antenna 1145, a crown 1125 driving the train wheel 1105 by the predetermined manual operation to thereby perform the time instant setting of the time instant hands 1115 and inputting the operation signal complying with the manual operation to the control circuit 1035, and an operation button 1135 capable of being manually operated.

The control circuit 1035 has in its inside a storage means and, in the storage means, there is stored a reception progress situation versus date indicator position correspondence table 1165 in which there are corresponded a reception progress situation of the standard radio signal received by the antenna 1145 and the rotation position of the date indicator 1075. In the date indicator 1075, date letters denoting dates from 1st day to 31st day are provided by the imprinting or the like.

Here, the antenna 1145 and the reception circuit 1155 constitute the reception means receiving, by radio, the standard radio signal including the time code, the motor 1095 constitutes the 1st motor, and the motor 1055 constitutes the 2nd motor. The crown 1125 and the operation button 1135 constitute the operation means. Further, the control circuit 1035 constitutes the clock means clocking the present time instant by counting the time signal, the time instant correction means correcting the present time instant being clocked to a time instant corresponding to the received time code, a reception progress situation judgment means judging the reception progress situation of the standard radio signal received by the antenna 1145, and the control means.

Figure 33:
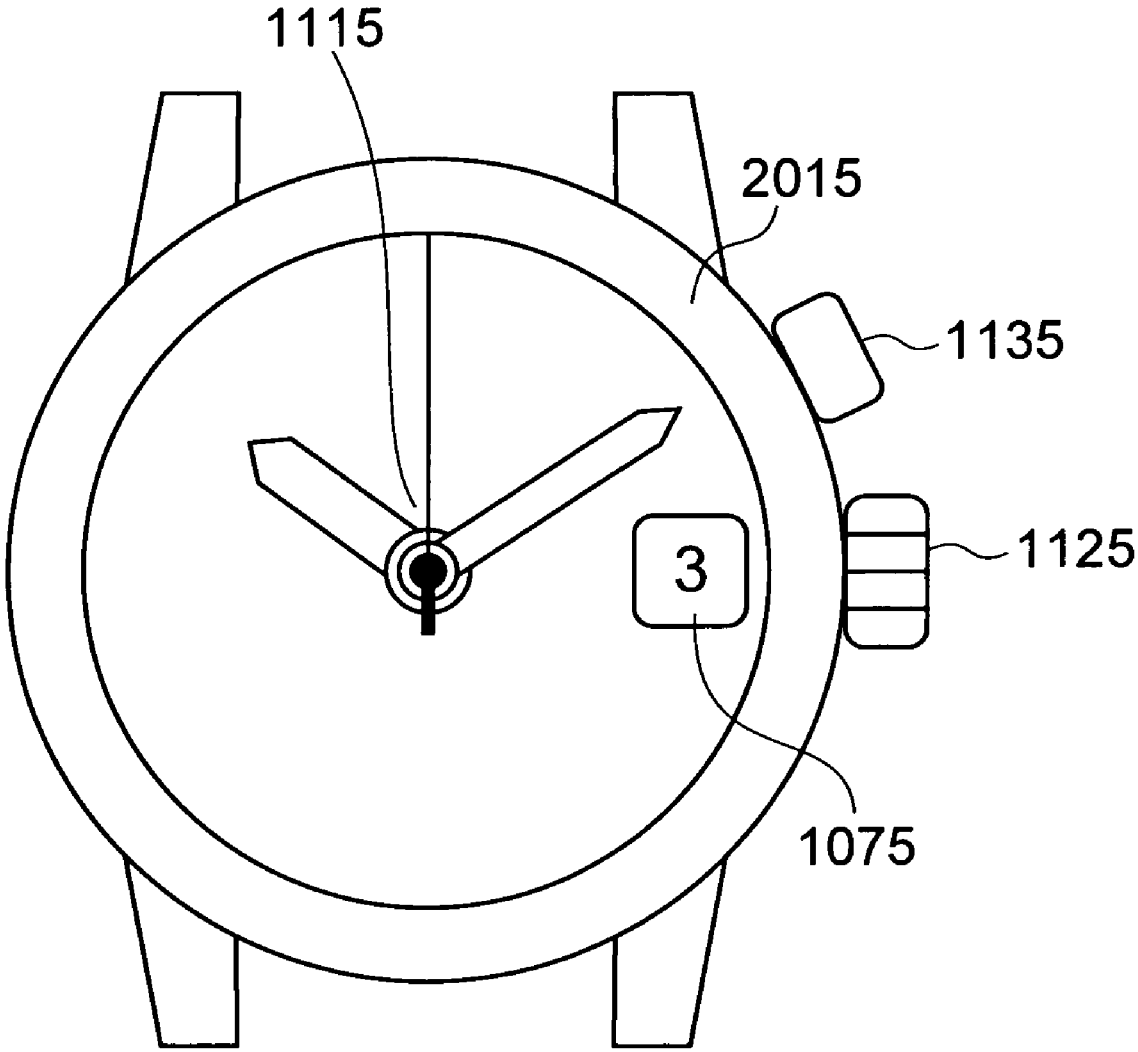
FIG. 33 is an external appearance view of the analog radio-controlled timepiece concerned with the ninth embodiment of the present invention.

FIG. 33 is a view showing the external appearance of the analog radio-controlled timepiece concerned with the embodiment of the present invention, and the same reference numeral is applied to the same portion as FIG. 32. Incidentally, 2015 is a case of the analog radio-controlled timepiece.

FIG. 34 is a view showing a content of the reception progress situation versus date indicator position correspondence table 1165. A reception progress situation stage is divided into plural stages and, in the present embodiment, there are divided into four stages of a reception station selection stage which is an operation stage performing a selection of the reception station, a first time data obtainment stage denoting the fact that an operation receiving the standard radio signal from the selected reception station is a first time reception operation stage, a second time data obtainment stage denoting the fact that the operation receiving the standard radio signal from the selected reception station is a second time reception operation stage, and a reception success stage which is a stage in which it was able to normally receive the standard radio signal.

Date letters "1", "2", "3" and "4" are corresponded respectively to the reception station selection stage, the first time data obtainment stage, the second time data obtainment stage, and the reception success stage. In FIG. 33, the date letters displayed by a date indicator 1075 is "3", and there is shown the fact that the reception progress situation is the second time data obtainment stage.

Although details of a reception progress situation display operation are mentioned later, in roughly explaining, the control circuit 1035 selects, by scanning the reception frequency of the reception circuit 1155, the reception station capable of receiving the standard radio signal (the reception station selection stage), thereby receiving the standard radio signal by the antenna 1145 from the selected reception station, and the reception circuit 1055 outputs the time code in the standard radio signal. In a case where the time code was able to be continuously, normally received twice (the first time data obtainment stage and the second time data obtainment stage), the control circuit 1035 judges as the reception success (the reception success stage), thereby correcting own clocked time instant to the time instant corresponding to the time code (At this time, the control circuit 1035 functions as the time instant correction means.).

Further, the control circuit 1035 judges in which stage there exists at present among the respective stages from the reception station selection stage till the reception success stage of the standard radio signal (At this time, the control circuit 1035 constitutes a reception progress situation judgment means), and rotation-controls the date indicator 1075 so as to display the date letters corresponding to the above stage, by referring to the reception progress situation versus date indicator position correspondence table 1165 (At this time, the control circuit 1035 functions as the control means.).

As a method that the control circuit 1035 judges whether or not the reception is successful, although various methods can be adopted, in the present embodiment, there is made such that it is judged that the reception is successful in a case where the time codes obtained in the first time data obtainment stage and the second time data obtainment stage coincide.

Incidentally, also during the reception progress situation display operation is being performed, the control circuit 1035 displays the present time instant that itself is clocking, by rotation-controlling the time instant hands 1115. In this case, although the control circuit 1035 rotation-drives the time instant hands 1115 (e.g., the second hand) in order to continue to display the time instant that itself is clocking, in the case where the time instant hands 1115 are rotation-driven, it controls the motor 1095 so as to rotation-drive the time instant hands 1115 between (the interstice between the pulse signals) the pulse signal and the pulse signal, which constitute the time code included in the standard radio signal. By this, although drives of the time instant hands 1115 are performed, even in the case where, at this time, the noise is generated by the drive of the motor 1095, it is possible to prevent the false detection of the time code, which owes to the noise.

Figure 35:
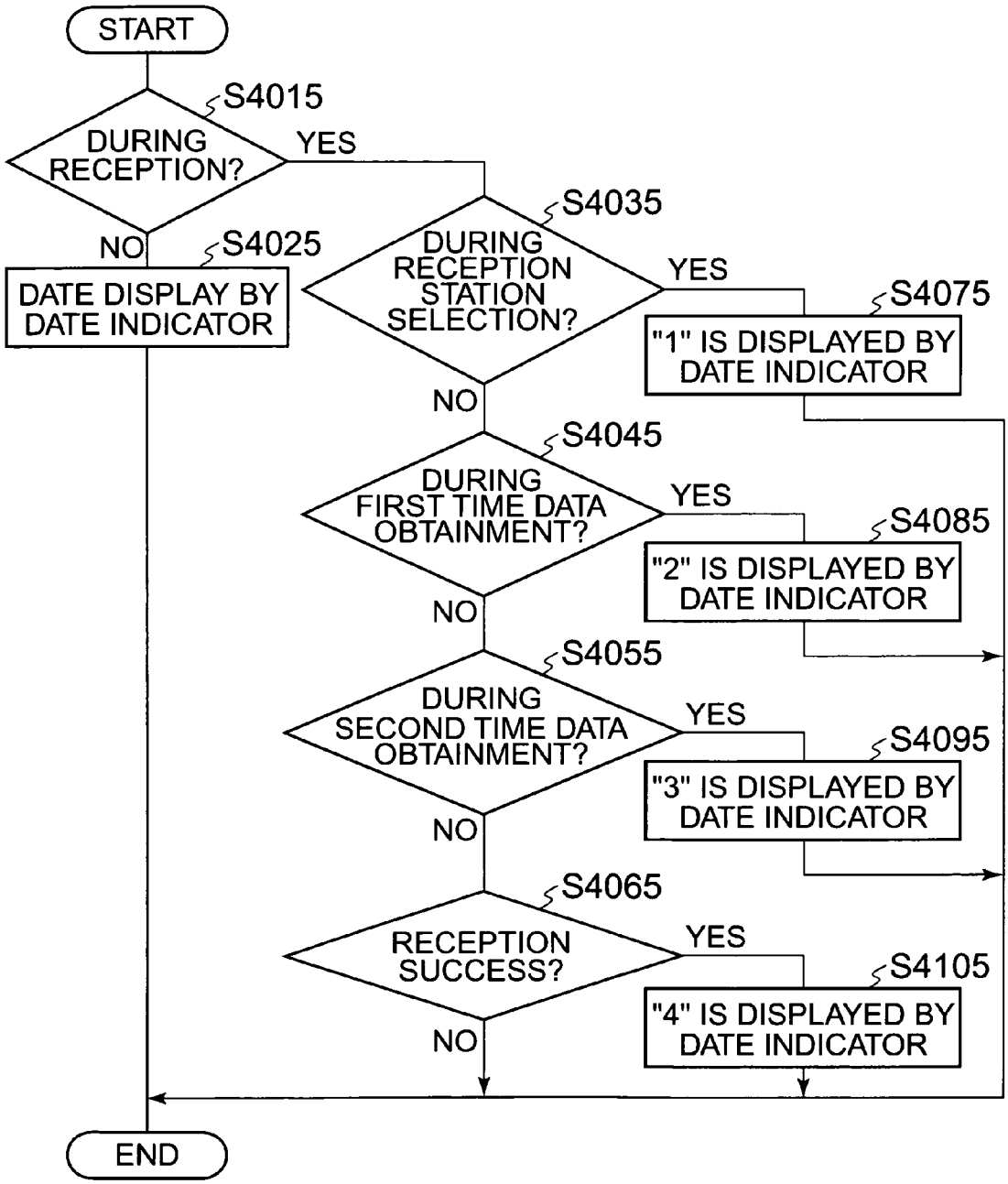
FIG. 35 is a flowchart showing processing in the analog radio-controlled timepiece concerned with the ninth embodiment of the present invention.

FIG. 35 is a flowchart showing processing in the embodiment of the present invention, and mainly shows processing in the control circuit 1035

Hereunder, by using FIG. 32-FIG. 35, there are explained the operations in the analog radio-controlled timepiece concerned with the present embodiment.

The control circuit 1035 judges whether or not the standard radio signal is during the reception (i.e., whether or not the processing is a reception mode receiving the standard radio signal) (step S4015) and, if it is judged that the processing is not the reception mode, performs the operation in the ordinary mode performing the date and time display (step S4025).

In the analog radio-controlled timepiece, there is performed the clock operation based on the timepiece signal from the oscillation circuit 1015 and the frequency dividing circuit 1025 and, in the ordinary mode displaying the date and time, the control circuit 1035 performs the clock operation by counting the timepiece signal from the frequency dividing circuit 1025 (At this time, the control circuit 1035 functions as a clock means.), and outputs control signals (a control signal for the date indicator, for rotation-controlling the date indicator 1075, and a control signal for the time instant hands, for rotation-controlling the time instant hands 1115), which correspond to the clocked time instant, to each of the motor driver circuits 1045 and 1085.

The motor driver circuit 1085 rotation-drives the motor 1095 by a motor drive signal for the time instant hands, which corresponds to the above control signal for the time instant hands. The motor 1095 rotation-drives the time instant hands 1115 through the train wheel 1105, thereby performing the analog display of the present time instant by the time instant hands 1115.

Further, if the above clocked time instant becomes the predetermined time instant before the predetermined time from 12 o'clock in the afternoon, the control circuit 1035 outputs the control signal for the date indicator to the motor driver circuit 1045. The motor driver circuit 1045 rotation-drives the motor 1055 by a motor drive signal for the date indicator, which corresponds to the above control signal for the date indicator. The motor 1055 rotation-drives the date indicator 1075 through the train wheel 1065, thereby altering the date to the next date during the predetermined time.

On the other hand, in the processing step S4015, if it is judged that the processing is the reception mode, the control circuit 1035 judges, by scanning the reception frequency of the reception circuit 1155, whether or not a present stage is the reception station selection stage selecting the reception station capable of receiving the standard radio signal (step S4035) and, in a case where it is judged that the processing is the reception station selection stage at present, outputs the control signal for the date indicator to the motor driver circuit 1045 such that the date indicator 1075 displays "1", by referring to the reception progress situation versus date indicator position correspondence table 1165 (step S4075). By this, the motor driver circuit 1045 rotation-drives the date indicator 1075 through the motor 1055 and the train wheel 1065, thereby displaying the date letters "1" by the date, indicator 1075. By the date letters of the date indicator 1075, the user can know the fact that the reception progress situation at present is the reception station selection stage.

In a case where it was judged in the processing step S4035 that the processing was not the reception station selection stage, if it is judged that the processing is during a first time data obtainment (the first time data obtainment stage) (step S4045), the control circuit 1035 outputs the control signal for the date indicator to the motor driver circuit 1045 such that the date indicator 1075 displays "2", by referring to the reception progress situation versus date indicator position correspondence table 1165 (step S4085). By this, the motor driver circuit 1045 rotation-drives the date indicator 1075 through the motor 1055 and the train wheel 1065, thereby displaying the date letters "2" by the date indicator 1075. By the date letters of the date indicator 1075, the user can know the fact that the reception progress situation at present is the first time data obtainment stage.

In a case where it was judged in the processing step S4045 that the processing was not the first time data obtainment stage, if it is judged that the processing is during a second time data obtainment (the second time data obtainment stage) (step S4055), the control circuit 1035 outputs the control signal for the date indicator to the motor driver circuit 1045 such that the date indicator 1075 displays "3", by referring to the reception progress situation versus date indicator position correspondence table 1165 (step S4095). By this, the motor driver circuit 1045 rotation-drives the date indicator 1075 through the motor 1055 and the train wheel 1065, thereby displaying the date letters "3" by the date indicator 1075. By the date letters of the date indicator 1075, the user can know the fact that the reception progress situation at present is the second time data obtainment stage.

In, a case where it was judged in the processing step S4055 that the processing was not the second time data obtainment stage, if it is judged that the processing is a reception success (step S4065), the control circuit 1035 outputs the control signal for the date indicator to the motor driver circuit 1045 such that the date indicator 1075 displays "4", by referring to the reception progress situation versus date indicator position correspondence table 1165 (step S4105). By this, the motor driver circuit 1045 rotation-drives the date indicator 1075 through the motor 1055 and the train wheel 1065, thereby displaying the date letters "4" by the date-indicator 1075. By the date letters of the date indicator 1075, the user can know the fact that the reception progress situation at present is the second time data obtainment stage.

In a case where it was judged in the processing step S4065 that the processing was the reception success, the control circuit 1035 corrects own clocked time instant to the time instant corresponding to the received time code. In a case where it was judged in the processing step S4065 that the processing was a reception failure because the standard radio signal could not be normally, continuously received twice, the control circuit 1035 ends the processing without performing the time instant correction.

Also in the above reception mode, the control circuit 1035 performs the time instant display by drive-controlling the time instant hands 1115.

Here, the processing steps S4035-S4065 constitute the reception progress situation judgment means judging the reception progress situation of the standard radio signal, and the processing steps S4025 and S4045-S4095 constitute the control means.

Incidentally, there may be made such that the operation performing the time instant correction by receiving the standard radio signal is previously constituted so as to commence when a predetermined operation by the operation button 1135 or the crown 1125 was performed or when a predetermined time instant arrived, by discriminating the fact that the predetermined operation of the operation button 1135 was performed and thus the reception operation of the standard radio was commenced, or discriminating the fact that the electric source was supplied to the reception circuit 1155 when the above predetermined time instant arrived to thereby be driven and thus the reception operation of the standard radio was commenced and it may be made such that it is judged in the processing step S4015 whether or not the processing is during the reception. In a case of the former, there may be constituted such that, by providing at least one of the crown 1125 or the operation button 1135 as the operation means, it is judged whether or not the processing is during the reception, on the basis of the operation of the above operation means.

As mentioned above, according to the analog radio-controlled timepiece concerned with the present ninth embodiment, in the case where the reception progress situation of the standard radio signal is displayed, there is made such that the date indicator 1075 is rotation-controlled to positions complying with reception situation stages (the reception station selection stage, the first time data obtainment stage, the second time data obtainment stage, and the reception success stage in the present embodiment) of the standard radio signal by referring to the reception progress situation versus date indicator position correspondence table 1165, the reception progress situation is displayed by the date letters of the date indicator 1075, and the time instant display is performed by the time instant hands 1115.

Accordingly, it becomes possible to display the reception progress situation of the standard radio signal without adding the special constitution, such as a symbol for denoting the reception progress situation, to the case 2015.

Further, since the time instant hands 1115 are used exclusively as the time instant display without being used in the display of the reception progress situation, even during the reception of the standard radio, the display of the present time instant becomes possible by the time instant hands 1115 and, further, it becomes possible to simultaneously display the time instant and the reception progress situation in combination with the reception progress situation display by the date indicator 1075.

Further, since it is the display by the date indicator 1075, not the time instant hands, there is brought about such an advantage that the display is easy to be understood.

Figure 36:
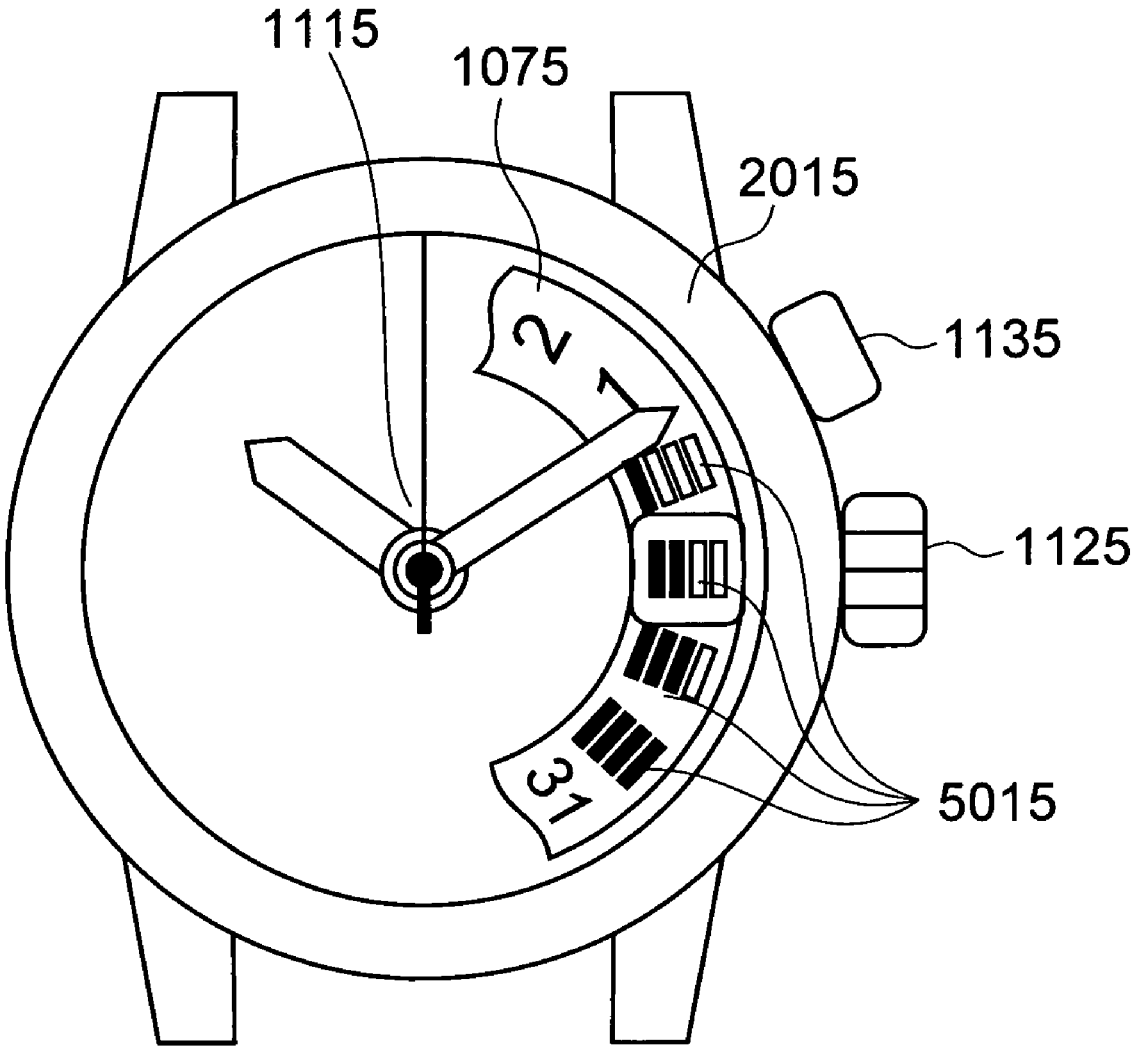
FIG. 36 is an external appearance view of an analog radio-controlled timepiece concerned with a tenth embodiment of the present invention.

FIG. 36 is a view showing an external appearance of an analog radio-controlled timepiece concerned with a tenth embodiment of the present invention, and a view in which one part is broken such that the date indicator 1075 is seen, and the same reference numeral is applied to the same portion as FIG. 33.

FIG. 37 is a view showing a content of a reception progress situation versus date indicator position correspondence table used in the present tenth embodiment.

In the above ninth embodiment, although the date letters of the date indicator 1075 is used in order to denote the reception progress situation, in the present tenth embodiment, there is made a constitution in which there are provided plural kinds (four kinds in the present embodiment) of reception progress situation display symbols 5015 for denoting the reception progress situation.

Similarly to the above ninth embodiment, the reception progress situation versus date indicator position correspondence table is used by being stored in the control circuit 1035. The control circuit 1035 rotation-controls the motor 1055 such that the reception progress situation display symbol 5015 complying with the reception progress situation is displayed, by referring to the reception progress situation versus date indicator position correspondence table and, by this, the date indicator 1075 is rotation-controlled.

Incidentally, the present tenth embodiment and the above ninth embodiment differ only in display modes of the reception progress situation, which are shown in FIG. 36 and FIG. 37, and other portions of the circuit block diagram, the processing flow and the like are similar.

Also in the present tenth embodiment, there is brought about an advantage similar to the above ninth embodiment by an addition of such an extremely simple constitution as to additionally write the reception progress situation display symbols 5015 to the date indicator 1075 without adding the special constitution, such as the symbol denoting the reception progress situation, to the case 2015.

The present invention can be applied to the analog radio-controlled timepiece analog-displaying at least the time instant and possessing the date indicator.

The present invention can be applied to the analog radio-controlled timepiece utilized in countries, such as not only Japan but also the USA for instance, in which there is used the standard radio signal for the time instant correction.

Further, the present invention is suitable for the analog radio-controlled timepiece used in plural regions, such as Japan and the USA, in which there is used the standard radio signal for the time instant correction.

What is claimed is:

1. An analog radio-controlled timepiece comprising:

a reception means receiving, by radio, a standard radio signal including a time code denoting a present time instant, a clock means clocking a time instant, time instant hands analog-displaying a time instant, a 1st motor rotation-driving the time instant hands, a date indicator having a symbol including at least date letters and performing a date display by the date letters, a 2nd motor rotation-driving the date indicator, a time instant correction means correcting the time instant that the clock means is clocking to a time instant corresponding to the time code received by the reception means, and a control means which, by controlling the 1st motor and the 2nd motor in compliance with a clocked time instant of the clock means in an ordinary mode for performing a date and time display, displays a time instant by the time instant hands and displays a date by the date indicator, wherein the control means controls, in a reception information confirmation mode for displaying a reception information of the standard radio signal, the 2nd motor so as to display the reception information by using the date indicator.

2. An analog radio-controlled timepiece according to claim 1, wherein the control means controls, in the reception information confirmation mode for displaying the reception information of the standard radio signal, the 2nd motor so as to digitally display the reception information by using the symbol of the date indicator.

3. An analog radio-controlled timepiece comprising:

a reception means receiving, by radio, a standard radio signal including a time code denoting a present time instant, a clock means clocking a time instant, time instant hands analog-displaying a time instant, a 1st motor-rotation-driving the time instant hands, a date indicator having date letters and performing a date display by the date letters, a 2nd motor rotation-driving the date indicator, a time instant correction means correcting the time instant that the clock means is clocking to a time instant corresponding to the time code received by the reception means, a control means which, by controlling the 1st motor and the 2nd motor in compliance with a clocked time instant of the clock means in an ordinary mode for performing a date and time display, displays a time instant by the time instant hands and displays a date by the date indicator, and a reception sensitivity judgment means judging a reception sensitivity of the standard radio signal received by the reception means, wherein the control means controls, in a reception sensitivity confirmation mode for displaying a reception sensitivity of the standard radio signal, the 2nd motor so as to perform a display complying with a judgment result of the reception sensitivity judgment means by a display of the date indicator.

4. An analog radio-controlled timepiece according to claim 3, wherein the control means controls, in the reception sensitivity confirmation mode, the 2nd motor so as to display the judgment result of the reception sensitivity judgment means by the date letters of the date indicator.

5. An analog radio-controlled timepiece according to claim 3, wherein:

in the date indicator there is additionally provided a reception sensitivity display symbol denoting the reception sensitivity, which differs from the date letters, and the control means controls, in the reception sensitivity confirmation mode, the 2nd motor so as to display the judgment result of the reception sensitivity judgment means by the reception sensitivity display symbol of the date indicator.

6. An analog radio-controlled timepiece according to claim 3, wherein the control means stores a reception sensitivity versus date indicator position correspondence table in which the reception sensitivity of the standard radio signal and a position of the date indicator are corresponded, and controls, in the reception sensitivity confirmation mode, the 2nd motor so as to rotation-drive the date indicator to a position complying with the judgment result of the reception sensitivity judgment means by referring to the reception sensitivity versus date indicator position correspondence table, thereby displaying the judgment result of the reception sensitivity judgment means.

7. An analog radio-controlled timepiece comprising:

a reception means receiving, by radio, a standard radio signal including a time code denoting a present time instant, a clock means clocking a time instant, time instant hands analog-displaying a time instant, a 1st motor rotation-driving the time instant hands, a date indicator having at least date letters and performing a date display by the date letters, a 2nd motor rotation-driving the date indicator, a time instant correction means correcting the time instant that the clock means is clocking to a time instant corresponding to the time code received by the reception means, a control means which, by controlling the 1st motor and the 2nd motor in compliance with a clocked time instant of the clock means in an ordinary mode for performing a date and time display, displays a time instant by the time instant hands and displays a date by the date indicator, and a judgment means judging a reception station of the standard radio signal received by the reception means, wherein the control means controls, in a reception station confirmation mode for displaying the reception station of the standard radio signal, the 2nd motor so as to perform a display of the reception station, that the judgment means judges, by a display of the date indicator.

8. An analog radio-controlled timepiece according to claim 7, wherein the control means controls, in the reception station confirmation mode, the 2nd motor so as to display a numeral of a highest digit of a frequency of the standard radio signal transmitted from the reception station.

9. An analog radio-controlled timepiece according to claim 7, wherein:

in the date indicator there are additionally provided plural frequency display symbols denoting a frequency of the standard radio signal, which differ from the date letters, and the control means controls, in the reception station confirmation mode, the 2nd motor so as to display the frequency display symbol corresponding to the frequency of the standard radio signal transmitted from the reception station.

10. An analog radio-controlled timepiece according to claim 7, wherein the control means stores a reception station versus date indicator position correspondence table in which the reception station and a position of the date indicator are corresponded, and controls, in the reception station confirmation mode, the 2nd motor so as to rotation-drive the date indicator to a position complying with the judgment result of the judgment means by referring to the reception station versus date indicator position correspondence table.

11. An analog radio-controlled timepiece comprising:

a reception means receiving, by radio, a standard radio signal including a time code denoting a present time instant, a clock means clocking a time instant, time instant hands analog-displaying a time instant, a 1st motor rotation-driving the time instant hands, a date indicator having at least date letters and performing a date display by the date letters, a 2nd motor rotation-driving the date indicator, a time instant correction means correcting the time instant that the clock means is clocking to a time instant corresponding to the time code received by the reception means, a control means which, by controlling the 1st motor and the 2nd motor in compliance with a clocked time instant of the clock means in an ordinary mode for performing a date and time display, displays a time instant by the time instant hands and displays a date by the date indicator, and a judgment means judging a reception success or failure of the standard radio signal by the reception means, wherein the control means controls, in a reception success or failure display mode for displaying the reception success or failure that the judgment means judges, the 2nd motor so as to display the reception success or failure by the date indicator.

12. An analog radio-controlled timepiece according to claim 11, wherein the control means controls, in the reception success or failure display mode, the 2nd motor so as to display the reception success or failure by the date letters of the date indicator.

13. An analog radio-controlled timepiece according to claim 11, wherein:

in the date indicator there is additionally provided a reception success or failure display symbol denoting the reception success or failure, which differs from the date letters, and the control means controls, in the reception success or failure display mode, the 2nd motor so as to display the reception success or failure by the reception success or failure display symbol.

14. An analog radio-controlled timepiece according to claim 11, wherein the control means controls, in the reception success or failure display mode, the 2nd motor so as to display a reception result in the last time by the reception means, by the date indicator.

15. An analog radio-controlled timepiece according to claim 11, wherein the control means controls, in the reception success or failure display mode the 2nd motor such that the date indicator performs a predetermined motion, thereby displaying the fact that a reception in the last time by the reception means was normally performed.

16. An analog radio-controlled timepiece according to claim 11, wherein the control means has a storage means storing a frequency in which the reception means could not continuously, normally receive the standard radio signal, and controls, in the reception success or failure display mode, the 2nd motor such that the date indicator displays the date letters corresponding to a number stored in the storage means.

17. An analog radio-controlled timepiece according to claim 11, wherein, in a case where the reception means could not normally receive the standard radio signal even one time till now, the control means controls, in the reception success or failure display mode, the 2nd motor so as to display an interstice between the date letters and the date letters of the date indicator.

18. An analog radio-controlled timepiece comprising:

a reception means receiving, by radio, a standard radio signal including a time code denoting a present time instant, a clock means clocking a time instant, time instant hands analog-displaying a time instant, a 1st motor rotation-driving the time instant hands, a date indicator having at least date letters and performing a date display by the date letters, a 2nd motor rotation-driving the date indicator, a time zone information storage means storing a time zone information in a region in which a time instant display is performed, a time instant correction means correcting the time instant that the clock means is clocking, on the basis of a time instant that the time code received by the reception means denotes, by considering the time zone information stored in the time zone information storage means, and a control means which, by controlling the 1st motor and the 2nd motor in compliance with a clocked time instant of the clock means in an ordinary mode for performing a date and time display, displays a time instant by the time instant hands and displays a date by the date indicator, wherein the control means controls, in a time zone information confirmation mode for displaying the time zone information stored in the time zone information storage means, the 2nd motor so as to perform a display of the time zone information by a display of the date indicator.

19. An analog radio-controlled timepiece according to claim 18, wherein the control means controls, in the time zone information confirmation mode, the 2nd motor so as to display the time zone information by the date letters of the date indicator.

20. An analog radio-controlled timepiece according to claim 19, wherein the control means controls, in the time zone information confirmation mode, the 2nd motor so as to display the date letters of the date indicator, which corresponds to a time difference included in the time zone information.

21. An analog radio-controlled timepiece according to claim 18, wherein:

in the date indicator there are additionally provided plural time zone information display symbols denoting the time zone information, which differ from the date letters, and the control means controls, in the time zone information confirmation mode, the 2nd motor so as to display the time zone information display symbol corresponding to the time zone information stored in the time zone information storage means.

22. An analog radio-controlled timepiece according to claim 18, wherein it has a time zone information versus date indicator position correspondence table in which the time zone information and a position of the date indicator are corresponded, and the control means controls, in the time zone information confirmation mode, the second motor so as to rotation-drive the date indicator to a position corresponding to the time zone information stored in the time zone information storage means, by referring to the time zone information versus date indicator position correspondence table.

23. An analog radio-controlled timepiece according to claim 18, wherein it has an operation means, the time zone information storage means is constituted by a time difference counter, and the time difference counter stores, as the time zone information, a time difference set in compliance with an operation frequency of the operation means.

24. An analog radio-controlled timepiece according to claim 18, wherein the control means responds to an operation of the operation means, thereby switching the ordinary mode and the time zone information confirmation mode.

25. An analog radio-controlled timepiece according to claim 18, wherein the control means shifts a processing to the ordinary mode in a case where a predetermined time elapsed in the time zone information confirmation mode.

26. An analog radio-controlled timepiece according to claim 18, wherein:

in the time zone information storage means there is stored, as the time zone information, a time difference from Greenwich Mean Time in Eastern region, Central region, Mountain region or Pacific region in the USA, and the reception means receives the standard radio signal including the time code denoting the Greenwich Mean Time, and the time instant correction means calculates a time instant on the basis of the Greenwich Mean Time and the time difference stored in the time zone information storage means, thereby correcting the time instant that the clock means is clocking to the calculated time instant.

27. An analog radio-controlled timepiece according to claim 26, wherein the control means controls, in the time zone information confirmation mode, the 2nd motor such that, in a case where the region concerned with the time zone information displayed by the date letters is the Eastern region, the Central region, the Mountain region or the Pacific region, the date letters "5", "6", "7" or "8" is respectively displayed.

28. An analog radio-controlled timepiece comprising:

a reception means receiving, by radio, a standard radio signal including a time code denoting a present time instant, a clock means clocking a time instant, time instant hands analog-displaying a time instant, a 1st motor rotation-driving the time instant hands, a date indicator having date letters and performing a date display by the date letters, a 2nd motor rotation-driving the date indicator, a time instant correction means correcting the time instant that the clock means is clocking to a time instant corresponding to the time code received by the reception means, a control means which, by controlling the 1st motor and the 2nd motor in compliance with a clocked time instant of the clock means in an ordinary mode for performing a date and time display, displays a time instant by the time instant hands and displays a date by the date indicator, and a reception progress situation judgment means judging a reception progress situation of the standard radio signal by the reception means, wherein the control means controls, in a reception mode receiving the standard radio signal, the 2nd motor so as to perform a display complying with a judgment result of the reception progress situation judgment means by a display of the date indicator.

29. An analog radio-controlled timepiece according to claim 28, wherein the control means controls, in the reception mode, the 2nd motor so as to display the judgment result of the reception progress situation judgment means by the date letters of the date indicator.

30. An analog radio-controlled timepiece according to claim 28, wherein:

in the date indicator there is additionally provided a reception progress situation display symbol denoting the reception progress situation, which differs from the date letters, and the control means controls, in the reception mode, the 2nd motor so as to display the judgment result of the reception progress situation judgment means by the reception progress situation display symbol of the date indicator.

31. An analog radio-controlled timepiece according to claim 28, wherein the control means stores a reception progress situation versus date indicator position correspondence table in which the reception progress situation of the standard radio signal and a position of the date indicator are corresponded, and controls, in the reception mode, the 2nd motor so as to rotation-drive the date indicator to a position complying with the judgment result of the reception progress situation judgment means by referring to the reception progress situation versus date indicator position correspondence table.

* * * * *